US008851238B2

(12) United States Patent
Byers

(10) Patent No.: US 8,851,238 B2
(45) Date of Patent: Oct. 7, 2014

(54) LIFTING SYSTEM

(71) Applicant: Thomas L. Byers, Mustang, OK (US)

(72) Inventor: Thomas L. Byers, Mustang, OK (US)

( * ) Notice: Subject to any disclaimer, the term of this patent is extended or adjusted under 35 U.S.C. 154(b) by 0 days.

(21) Appl. No.: 13/844,812

(22) Filed: Mar. 16, 2013

(65) Prior Publication Data

US 2013/0214224 A1 Aug. 22, 2013

Related U.S. Application Data

(63) Continuation of application No. 11/732,282, filed on Apr. 3, 2007, now Pat. No. 8,418,814.

(60) Provisional application No. 60/788,660, filed on Apr. 3, 2006.

(51) Int. Cl.

| | |
|---|---|
| ***B66B 9/00*** | (2006.01) |
| ***B66B 11/06*** | (2006.01) |
| ***B66D 1/26*** | (2006.01) |
| ***B66F 11/00*** | (2006.01) |
| ***B66D 1/54*** | (2006.01) |
| ***B66D 1/12*** | (2006.01) |
| ***B66D 3/04*** | (2006.01) |

(52) U.S. Cl.

CPC .. *B66D 1/54* (2013.01); *B66D 1/12* (2013.01); *B66D 3/04* (2013.01); *B66B 9/00* (2013.01)

USPC ..... 187/259; 187/261; 187/342; 182/150; 254/278; 254/286

(58) Field of Classification Search

CPC ..... B66D 1/485; B66D 3/24; B66D 1/26; B66D 1/50; B66B 11/0075; B66F 11/00

USPC ..... 187/259, 261, 342; 182/144, 150; 254/278, 286

IPC ..... B66B 11/06

See application file for complete search history.

(56) References Cited

U.S. PATENT DOCUMENTS

| | | | |
|---|---|---|---|
| 130,889 | A | 8/1872 | Anderston et al. |
| 259,105 | A | 6/1882 | Demorest |
| 265,012 | A | 9/1882 | Bobzien |
| 364,863 | A | 6/1887 | Schollian et al. |

(Continued)

FOREIGN PATENT DOCUMENTS

| | | | | |
|---|---|---|---|---|
| CH | 678145 | A5 * | 8/1991 | ..... A47C 19/02 |
| FR | 2710627 | A1 * | 4/1995 | ..... B66F 11/00 |

*Primary Examiner* — Michael Mansen
*Assistant Examiner* — Stefan Kruer
(74) *Attorney, Agent, or Firm* — Hall Estill Attorneys at Law

(57) ABSTRACT

Apparatus for raising and lowering objects. In accordance with some embodiments, a winch motor is adapted to rotate a winch member in opposing first and second directions to wrap/unwrap a portion of a cable on/from the winch member to raise and lower a lifting platform assembly, respectively. A tension detection switch assembly includes an on/off switch connected to the winch motor and a biasing member which exerts a bias force upon the winch member to nominally deflect the winch member to a first position which sets the switch to deactivate the winch motor in an absence of tension in the cable from the lifting platform assembly. A presence of tension in the cable from the lifting platform assembly deflects the winch member to a second position which sets the switch to facilitate activation of the winch motor.

24 Claims, 29 Drawing Sheets

(56) References Cited

U.S. PATENT DOCUMENTS

| | | | | | |
|---|---|---|---|---|---|
| 592,756 | A | | 11/1897 | Anderson | |
| 982,056 | A | | 1/1911 | Hammell | |
| 1,030,410 | A | | 6/1912 | Kees | |
| 2,086,002 | A | | 7/1937 | Shepard | |
| 2,246,732 | A | | 6/1941 | Hymans | |
| 2,499,791 | A | | 3/1950 | Spencer | |
| 3,467,460 | A | | 9/1969 | Acker | |
| 3,608,674 | A | | 9/1971 | Phillips | |
| 3,627,397 | A | | 12/1971 | Rominsky | |
| 3,743,287 | A | | 7/1973 | Liermann | |
| 4,060,292 | A | | 11/1977 | Medina | |
| 4,309,023 | A | * | 1/1982 | Plumettaz et al. | 254/273 |
| 4,412,601 | A | | 11/1983 | Cooper | |
| 5,020,641 | A | | 6/1991 | Olsen et al. | |
| 5,152,369 | A | * | 10/1992 | Nakaoka | 182/129 |
| 5,203,619 | A | | 4/1993 | Welsch et al. | |
| 5,348,273 | A | * | 9/1994 | Sandell et al. | 254/385 |
| 5,366,203 | A | | 11/1994 | Huffman | |
| 5,535,852 | A | | 7/1996 | Bishop et al. | |
| 5,626,208 | A | | 5/1997 | Sprague et al. | |
| 6,095,344 | A | | 8/2000 | White | |
| 6,131,702 | A | | 10/2000 | Berridge | |
| 6,367,757 | B1 | | 4/2002 | Aramaki | |
| 6,507,962 | B2 | | 1/2003 | Thurston | |
| 6,668,980 | B2 | | 12/2003 | Smith | |
| 6,676,233 | B1 | | 1/2004 | Evans et al. | |
| 6,962,236 | B2 | | 11/2005 | Penn | |
| 7,523,919 | B2 | | 4/2009 | Hanlon | |
| 7,575,098 | B2 | | 8/2009 | Hartley | |
| 2005/0098387 | A1 | | 5/2005 | Penn et al. | |
| 2006/0000675 | A1 | | 1/2006 | Penn et al. | |
| 2006/0032706 | A1 | | 2/2006 | Penn | |
| 2006/0066188 | A1 | | 3/2006 | Crawford | |
| 2007/0272490 | A1 | * | 11/2007 | Blasek | 187/254 |
| 2009/0224221 | A1 | * | 9/2009 | Monroe | 254/4 R |
| 2010/0051888 | A1 | | 3/2010 | Taylor et al. | |

* cited by examiner

LIFTING SYSTEM

RELATED APPLICATIONS

The present application is a continuation of co-pending parent U.S. application Ser. No. 11/732,282 filed Apr. 3, 2007, which in turn makes a claim of domestic priority under 35 U.S.C. 119(e) to U.S. Provisional Application No. 60/788,660 filed Apr. 3, 2006.

BACKGROUND

The present disclosure relates generally to the field of lifting systems used to raise and lower objects and more particularly, but not by way of limitation, to a lifting system configured to raise and lower objects to and from an attic for storage of objects therein, for example in a building such as a residential structure.

The need to move storage items up stairs or ladders to a second level floor in a home, such as an attic floor or second floor living space, is common among home owners. As stairs are narrow and steep, moving large or heavy boxes and other bulky items up stairs presents a difficult and often dangerous task.

Home owners commonly store seasonal items in their attic to save space in their garages or closets. Seasonal items, including items like artificial Christmas trees, wreaths, wrapping paper, holiday lights, yard decorations, candles, garlands, centerpieces and dishes, to name a few, are all desirable to store out of sight in the attic until the next seasonal use. Other storage items include hobby supplies, keepsakes, seasonal clothing, seasonal sporting goods like skis, sleds, and hunting gear, for example.

It has become common practice to install flooring in the attic space to provide a place to store these items. The problem that has long existed is that attic storage space is normally accessible only by a fold-down ladder (which is often flimsy or unstable) or stairway that is both steep and narrow and sometimes slick. Climbing one of these ladders is dangerous enough with both hands free. Trying to carry boxes and other heavy or bulky items up or down is virtually impossible to do and usually requires two persons: one pushing from below and the other pulling from above. The person above must try to back up the ladder while using both hands to pull the storage item. This is extremely dangerous and can result in serious accidental injury. The consumer Products Safety Commission reports, "Each year there are over 164,000 emergency room-treated injuries in the U.S. relating to ladders." Undoubtedly, some portion of this number involves injuries obtained while using attic ladders.

For these reasons there has been a longstanding need for a way for home owners to safely move or retrieve storage items to or from a second level (such as an attic, second floor, or basement) without lifting or carrying them up or down stairs or ladders. One solution is to install an elevator in the home. However, elevators are complex devices that must be installed by skilled engineers, electricians and contractors and are therefore very expensive. The cost is too high to be afforded by the average home owner.

In particular, there are a number of specific problems associated with the lift systems of the prior art which are encountered by the users of such systems. These are identified below and bear on issues of safety, affordability, effectiveness, simplicity, and installability.

1. Prior art lift systems often require an excessive amount of skilled labor to install. Often, installation requires hiring an electrician to install special wiring, which can be costly. The systems often require specially trained persons to make custom modifications to the apparatus to fit each individual installation.
2. Prior art systems are seldom readily adaptable to a wide variety of ceiling heights, and rafter (joist) dimensions. Home ceilings typically range from 8 to 11 feet high, even 15 feet high, especially in the garage. Ceiling joists range from 2×4 inches to 2×12 inches in lumber and from 2×14 inches to 2×36 inches in fabricated joists and laminated beams, thus causing wide variation in the thickness of the ceiling opening that the lift device must be adapted to fit through.
3. Prior art systems often require roller guide tracks, telescoping columns, rails or other expensive and cumbersome guide means. Telescoping columns are inherently costly. Guide track and rails are also costly as well as unsightly. These devices are not readily adaptable to widely different ceiling heights and other structural variations and often require the device to be custom built or to be specifically modified to fit each particular installation.
4. Prior art systems lacking such guide means, however, cannot reliably guide themselves and the maximum load into and out of the ceiling opening. The platform assembly of the prior art systems often incur misalignment between the ceiling opening and the platform assembly when loaded to capacity so that the platform or cargo thereon catches on the edge of the ceiling opening and cannot pass through the opening.
5. Systems of the prior art are often not completely installable with ordinary tools and often do not include a reliable means to adjust the length of the cables for each installation using ordinary tools. Typically, cables used in these systems must be modified to have permanently swaged sleeves forming loops at each end and are not adjustable. It requires special tools to swage sleeves or lugs for lifting applications. These systems do not include a secure and easily adjustable means to connect the cables which depends only ordinary tools common to home owners.
6. Most prior art systems leave the opening in the ceiling open whenever it is not in use (in the raised position). This is esthetically unpleasing and leads to loss of heating or cooling into the attic space, and allows access by unwanted entry of insects and small animals from the attic space into the home.
7. Other prior art systems that close the opening in the ceiling do not elevate the storage items level with the floor above the opening and would require lifting of the storage items manually merely to remove them from the platform and onto the floor surface or vice versa. The home owner is then required to lift each storage item out of (or lower each storage item into) a recessed hole in the upper floor that can very in depth from a few inches to over 2 feet, depending on the joist height and ceiling thickness as previously discussed. This increases the chance of back injuries, and is inconvenient to the home owner, substantially reducing the usefulness of such a lifting device.
8. Prior art systems often provide unstable lifting platforms thus rendering them less capable of safely lifting a variety of objects of different sizes and weights. For example the lifting platform of these systems is often designed in such a way to increase the risk of becoming top heavy when loaded with large objects, creating a potential hazard of tipping over and spilling the load off of the platform.

9. Systems of the prior art may not stop automatically when raised to the highest position, sometimes causing the system to be stressed or jammed when it reaches the uppermost limit of its travel. Similarly these systems may not automatically stop as close to level (flush) with the attic floor as possible, unless the operator releases the switch at an exactly optimal instant. Devices of the prior art systems used to stop the upward travel of the platform usually require user intervention or must be preset by a trained installer.
10. The prior art systems generally do not stop automatically when lowered to the lowest (floor) position and the platform often comes into contact with the lower floor abruptly so that the motor may not stop instantly, allowing the cable (or other connecting means) to continue to spool out. This can lead to tangling or fouling and may leave the cable requiring repair. Systems which do have automatic downward stopping mechanisms require a mechanism of considerable complexity and expense due to the necessity of routing wires to a moving platform or employing a wireless remote switching device and may require installation and setting by a trained installer.
11. Typically, in prior art systems, if the platform assembly becomes lodged or caught in the ceiling opening when traveling downward, motor action of the apparatus is not immediately stopped. This causes a vitally unsafe situation. If the platform becomes lodged while the cable continues to pay out the cables will accumulate slack, possibly becoming fouled or jammed. Then if the platform is dislodged while the cables are slack, it can free-fall some distance from the opening, possibly spilling the load or even breaking the cable, causing costly damage and possible serious personal injury.
12. The platform assembly of prior art systems tend to flip over and thereby spill the load whenever one of the cables becomes jammed while the other cables continue to pay out. If this occurs, costly damage and serious personal injury is possible.
13. Many prior art systems do not include a momentary switch for safety so that the lifting mechanism will stop immediately when the switch is released by the operator and do not include a security locking device to prevent unauthorized use, for example, by children.
14. Systems which are installed where the upper floor is a living space occupied by or accessible to small children, often leave the opening in the upper floor open when the platform is lowered, potentially allowing a person or child to inadvertently step or fall through the opening to the floor below likely suffering serious injury or death.
15. Prior art systems are often too costly to be affordable to the average home owner, while still meeting the stated minimum needs and requirements and may be unnecessarily complex thereby adding cost without adding benefits or usefulness.

As indicated above, a variety of mechanical lifting systems have been proposed in the prior art, but all have shortcomings, problems, and disadvantages. A number of prior art systems require tracks or telescoping columns to guide the platform and would be inherently complex and costly while not readily adapting to different heights and locations. Other propose controlling the lifting platform using only cables to provide support and stability. This arrangement will support vertical loads but lacks dynamic stability. Large loads on such systems will inherently become unstable if the platform becomes tipped due to an obstruction or any fouling or jamming of one of the supporting cables. Once the platform and load thereon become unbalanced, the platform could flip completely over, dumping the load. This is because cables or tethers can resist downward forces but cannot resist the upward forces created by an unbalanced platform. In addition to the balance problem, supporting the platform directly with four cable attachment points as taught in the prior art, leaves another important safety problem unsolved. Such a cable attachment configuration naturally allow some swaying of the lifting platform as it moves upward.

When the platform carries a load that approaches the maximum load dimensions, then any swaying of the upwardly moving platform can allow misalignment of the load and the ceiling opening. When this occurs, the load and platform can become jammed or the load spilled. In order to provide adequate lifting platform stability or guidance of the load into the ceiling opening, the prior art systems require telescoping columns, tracks or rails or the like.

While some of the prior art systems make vague references to limit switches that would stop the lifting platform when it reaches the lower floor, none have provided a specific solution to the problem of how to implement these lower limit switches while suitably managing the associated wiring. For example, Penn suggests placing limit switches in the underside of the lifting platform in one application and in another application he suggests putting them at the bottom of a folding ladder having tracks to guide the platform. Penn fails to demonstrate a plausible means to connect the switches in the underside of the movable platform with the drive mechanism above. Penn also fails to show how to mount a switch on the lowest end of a folding ladder and how to safely manage the wiring through a series of joints in the ladder that fold and could pinch or cut the wires. Both of these approaches would be inherently problematic, difficult and costly to implement.

The prior art systems also leave open the opening in the ceiling after raising the loaded platform level with the upper floor. Also, the platforms of the prior art systems often leave the raised, loaded platform substantially below the upper floor surface, causing the user to lean over the opening and lift out the storage items. This could be difficult and dangerous with heavy items. Most recently or newly constructed garages use fabricated joists to support large ceilings without support columns in double and triple car garages. These joists are typically 16 inches to 24 inches tall. The platforms of the prior art systems are made as low as possible for easy loading on the lower floor, but require loads to be lifted out of recesses 12 inches to 20 inches deep on the upper floor where 16-24 inch joists have been used. Conversely if the platform in the prior art system is built to be tall enough to reach the upper floor when raised, then the platform would be 16 inches to 24 inches high when resting on the lower floor. That would require the user to do much lifting to load and unload the elevated platform causing much inconvenience to the home owner while increasing the risk of back injury.

Further, none of the prior art systems has provided a practical means to automatically halt the apparatus in the event the platform assembly becomes jammed or lodged in the ceiling opening while descending. Moreover, none of the prior art has provided a practical means to automatically halt the apparatus in the event one cable should become jammed or fouled while the platform is descending.

It is to providing a lifting and closure system which solves these problems and deficiencies that the present disclosure is directed.

SUMMARY

Various embodiments of the present disclosure are generally directed to a lifting system suitable for use in safely and securely lifting/lowering an object between a lower floor surface and an upper floor surface.

In accordance with some embodiments, a winch motor is adapted to rotate a winch member in opposing first and second directions to wrap/unwrap a portion of a cable on/from the winch member to raise and lower a lifting platform assembly, respectively.

A tension detection switch assembly includes an on/off switch connected to the winch motor and a biasing member which exerts a bias force upon the winch member to nominally deflect the winch member to a first position which sets the switch to deactivate the winch motor in an absence of tension in the cable from the lifting platform assembly. A presence of tension in the cable from the lifting platform assembly deflects the winch member to a second position which sets the switch to facilitate activation of the winch motor.

DETAILED DESCRIPTION

Figure 1:
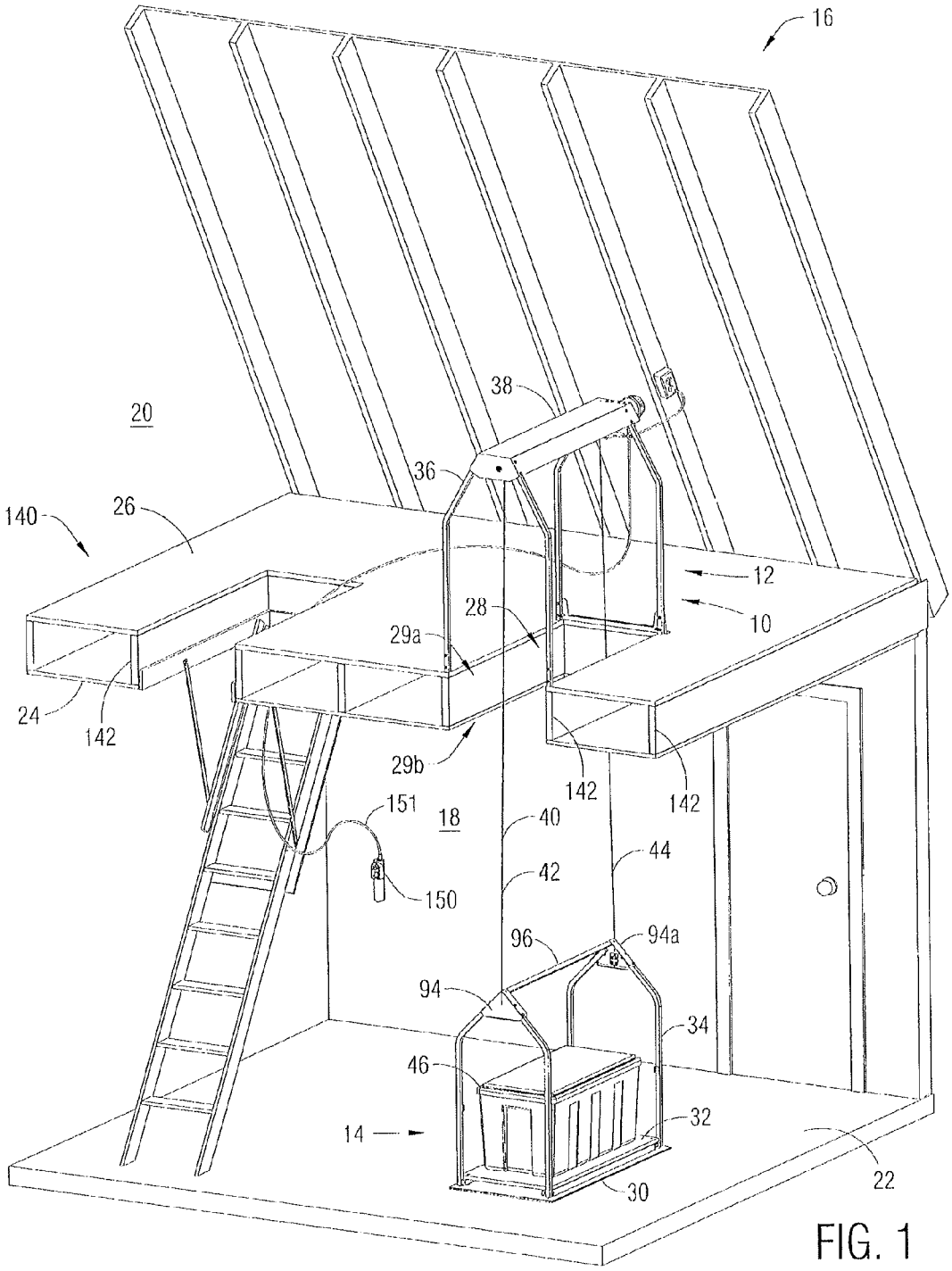
FIG. 1 shows a perspective view of a lifting system constructed and operated in accordance with the present invention, wherein the lifting system is in a lowered position.

Various embodiments set forth herein are generally directed to a storage lifting system suitable for use in safely and securely lifting an object from a lower floor surface to an upper floor surface and/or lowering an object from the upper surface to the lower floor surface.

One embodiment of the lifting system of the present invention is shown in FIGS. 1-11 and is designated therein by the general reference numeral 10. The lifting system 10 preferably comprises two main components which are operatively connected: a support and drive assembly 12, and a movable platform assembly 14. Preferably the lifting system 10 is not integrally associated with a retractable ladder system.

For purposes of disclosing a particular environment in which the lifting system 10 can be advantageously used, FIG. 1 shows selected interior portions of a residential structure 16 having a garage 18 and an attic 20 above the garage 18. The garage 18 has a garage floor 22 and a ceiling 24. The attic 20 has an attic floor 26 and a portal 28, having a portal depth 28*a*, an upper entrance 29*a*, and a lower entrance 29*b*, positioned between and extending completely through the ceiling 24 to the attic floor 26 which allows access to the attic 20 from the garage 18 and through which the movable platform assembly 14 is raised into the attic 20 and lowered to the garage floor 22 as described below in greater detail.

The lifting system 10 is configured to move cargo items including objects such as boxes, trunks, barrels, containers, building materials, equipment, or even persons or animals, from the garage floor 22 of the garage 18 to the attic floor 26 of the attic 20, and vice versa, although it will be appreciated that the lifting system 10 can readily be used to transfer cargo items or persons or animals from locations other than a garage and can be used in other environments as long as there are two separate spaces separated by a floor, ceiling, or other such support structure. For example, the invention can be used to carry objects into a stilted home from below the stilted home, and as an elevator to provide human transport from a lower floor to an upper residential floor, and can be used as well in non-residential applications such as in a manufacturing facility or the like. A typical item for transport is a cargo item 46 (e.g., see FIG. 6), which may be for example a box, trunk or luggage, or any other object desired to be transferred in the manner contemplated herein. In general, the lifting system 10 can be employed to move cargo items 46 between any two adjacent levels in a residence, including the basement level, the ground level, any higher level above ground level, the attic 20, the garage 18 and outdoor levels like decks, balconies, and even rooftops.

The movable platform assembly 14 in a preferred embodiment comprises a closure (lower) platform 30 (for portal closure) and a lifting (upper) platform 32 (for lifting and support), and a platform frame 34 to which both the closure platform 30 and lifting platform 32 are connected, either directly or indirectly. In a key feature of the invention, when the lifting system has a closure platform 30, the platform assembly 14 further comprises a biasing mechanism 35 which provides a biasing force for adjusting the position of the closure platform 30 relative to the position of the lifting platform 32 in a manner described in more detail below.

The support and drive assembly 12 comprises a support frame 36 and a drive mechanism 38. In a preferred embodiment, the drive mechanism 38 is connected to the support frame 36 and is supported thereby over the attic floor 26 and over the portal 28 in a position above the platform assembly 14. The drive mechanism 38 may alternately be attached directly to a portion of the attic floor 26, or to a roof over the attic 20 rather than to the support frame 36. A cable (also referred to herein as a tether, strand or webbing) 40 is connected to and extends from the drive mechanism 38 of the support and drive assembly 12 to the platform frame 34 of the platform assembly 14. The support and drive assembly 12 is thereby engagingly connected to the platform assembly 14 via the cable 40 (which may be made of wire, cable, plastic, rope, webbing or any other suitable material). As noted, cable 40 may also be referred to herein as a tether.

Figure 2:
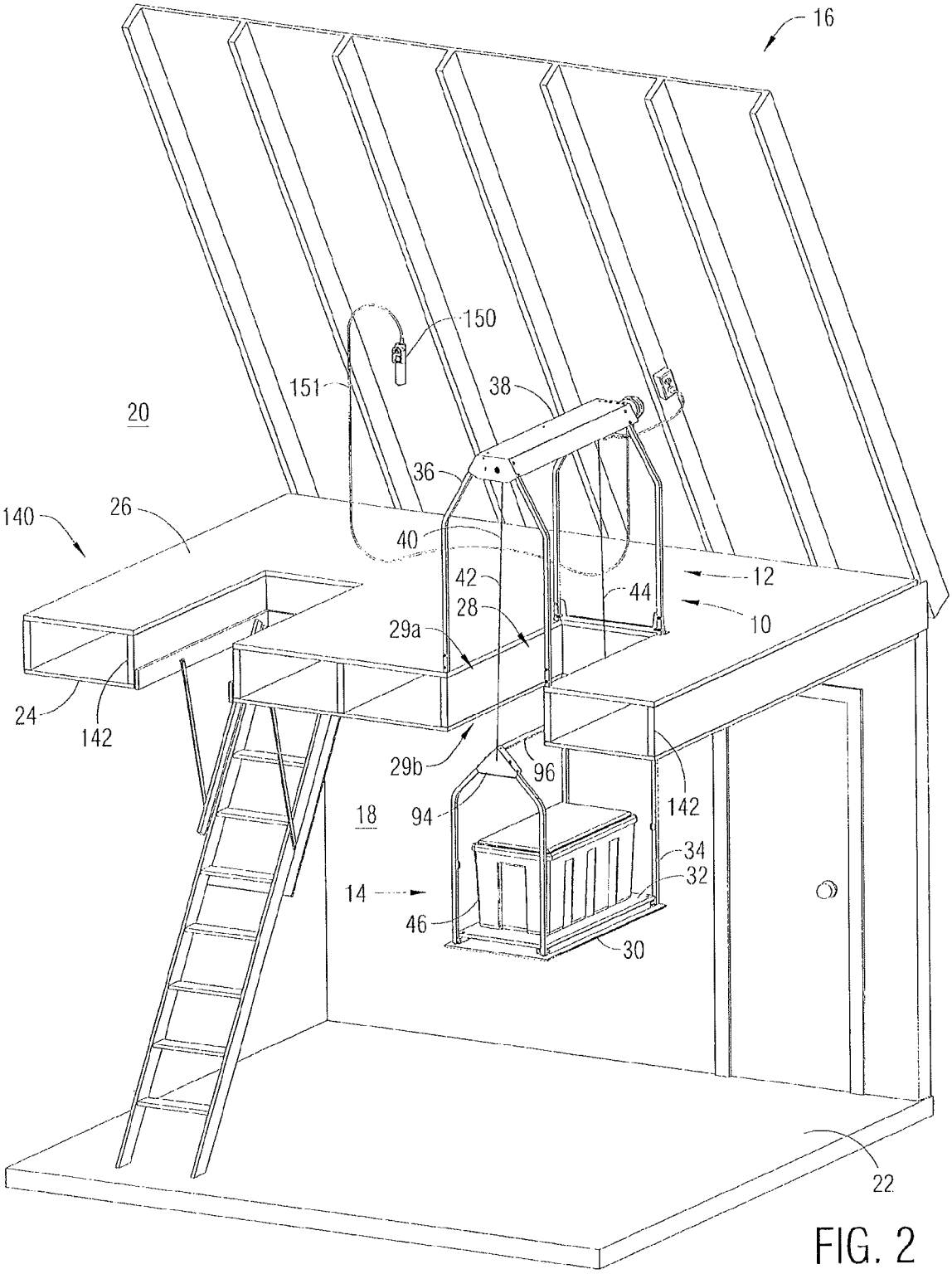
FIG. 2 shows the lifting and closure system of FIG. 1 in a partially raised configuration.
Figure 3:
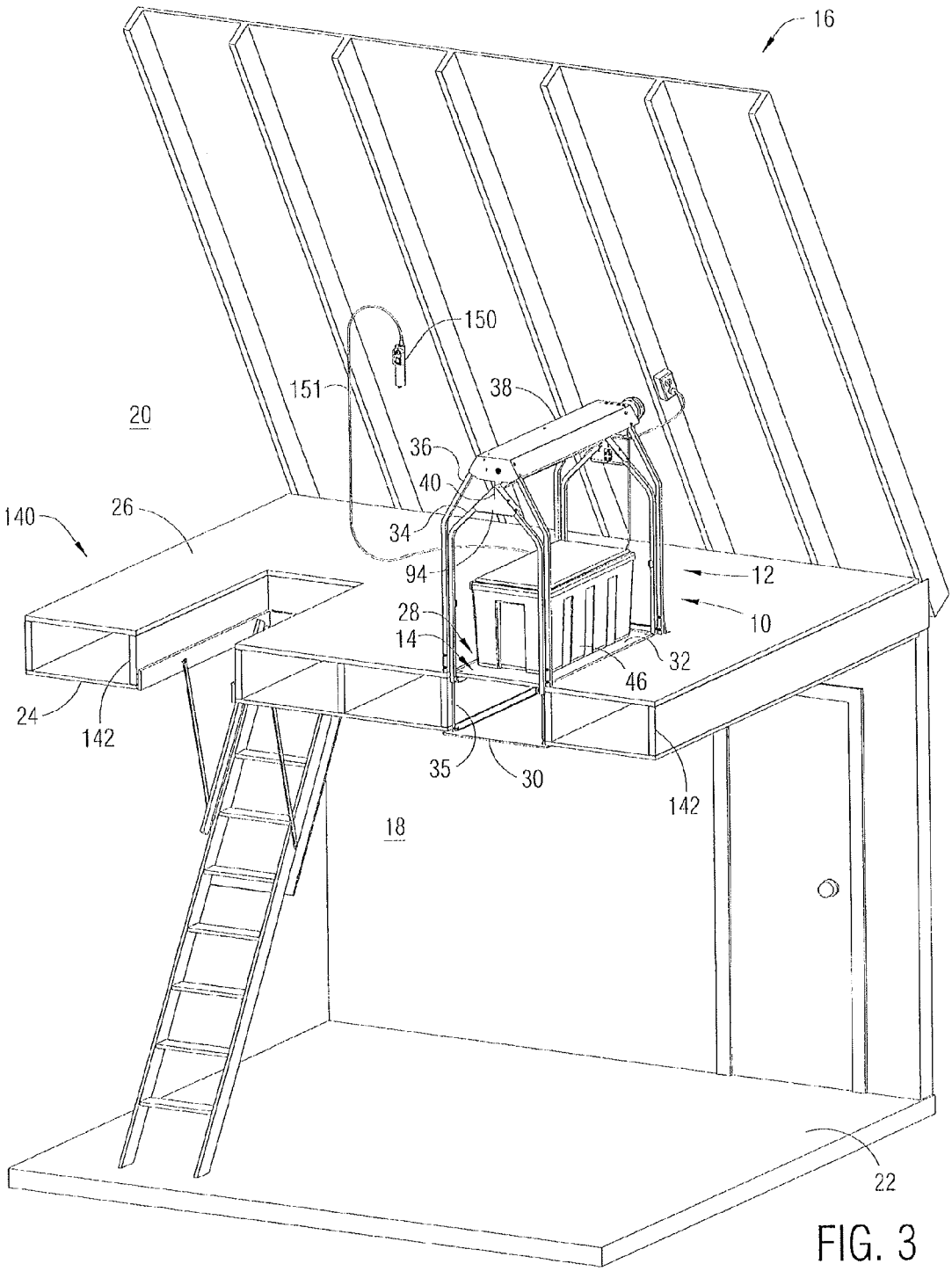
FIG. 3 shows the lifting system of FIG. 1 in a fully raised position.

FIGS. 1, 4, 6, 7 and 8 show the lifting system 10 in a lowered position wherein the platform assembly 14 is resting on the garage floor 22, either after the cargo item 46 has been placed on the lifting platform 32 for lifting or after the cargo item 46 has been removed therefrom after lowering. FIG. 2 shows the lifting system 10 in operation, wherein the platform assembly 14 is suspended in an intermediate position between the garage floor 22 and the ceiling 24. FIGS. 3, 9, 10 and 11 show the lifting system 10 in a raised position wherein the platform assembly 14 has been raised through the portal 28 so the lifting platform 32 is substantially flush with the attic floor 26 and the upper entrance 29*a* and portal attic floor edge 29*d*, and the closure platform 30 abuts the ceiling 24 thereby closing the lower entrance 29*b*.

As is evident from the description herein and particularly FIGS. 3, 9, 10 and 11, it can be seen that two of the main platform components of the platform assembly 14, i.e., the closure platform 30 and the lifting platform 32, function substantially independently and have separate purposes. The function of the lifting platform 32 is to support and carry cargo items 46 up to the attic 20 for storage therein, or for delivery of cargo items 46 from the attic 20 to the garage floor 22 (or other similar surface in a room or enclosure below the attic 20 or other such area, such as a second floor at a home). The function of the closure platform 30 is to act as a door or cover which contactingly engages and abuts the ceiling 24 and closes the lower entrance 29*b* of the portal 28 where it opens into the ceiling 24. Closure of the lower entrance 29*b* of the portal 28 in this way provides a number of benefits, including but not limited to, (1) substantially preventing movement of heat and/or cooled air from the attic 20 to the garage 18 and vice versa, thereby maintaining the insulative capacity of the ceiling 24, (2) preventing debris from falling through the portal 28 from the attic 20 into the garage 18, (3) preventing small animals and insects from gaining entrance to the attic 20 or garage 18 via an open portal 28, and (4) concealing a visible aperture (lower entrance 29*b*) in the ceiling 24 when the lifting platform 32 is in a fully raised position thus cosmetically improving the appearance of the ceiling 24. Furthermore, as will be explained in more detail below, in the raised position of the platform assembly 14, the distance between the lifting platform 32 and the closure platform 30 is automatically adjustable due to the action of the biasing mechanism 35 thereby enabling the closure platform 30 to self-adjust to the portal depth 28*a* (the vertical distance between the attic floor 26 (i.e., upper surface) and the ceiling 24 (i.e., lower surface)) in the portal 28 in a site-specific and situational manner, thereby enabling secure closure of the portal 28 by the closure platform 30 in virtually any circumstance. As will be understood, the present invention differs from some prior art systems in that the door or platform which closes the lower opening 29*b* of the portal 28 is not connected to the ceiling 24, but rather is independent of the ceiling 24.

Figure 4:
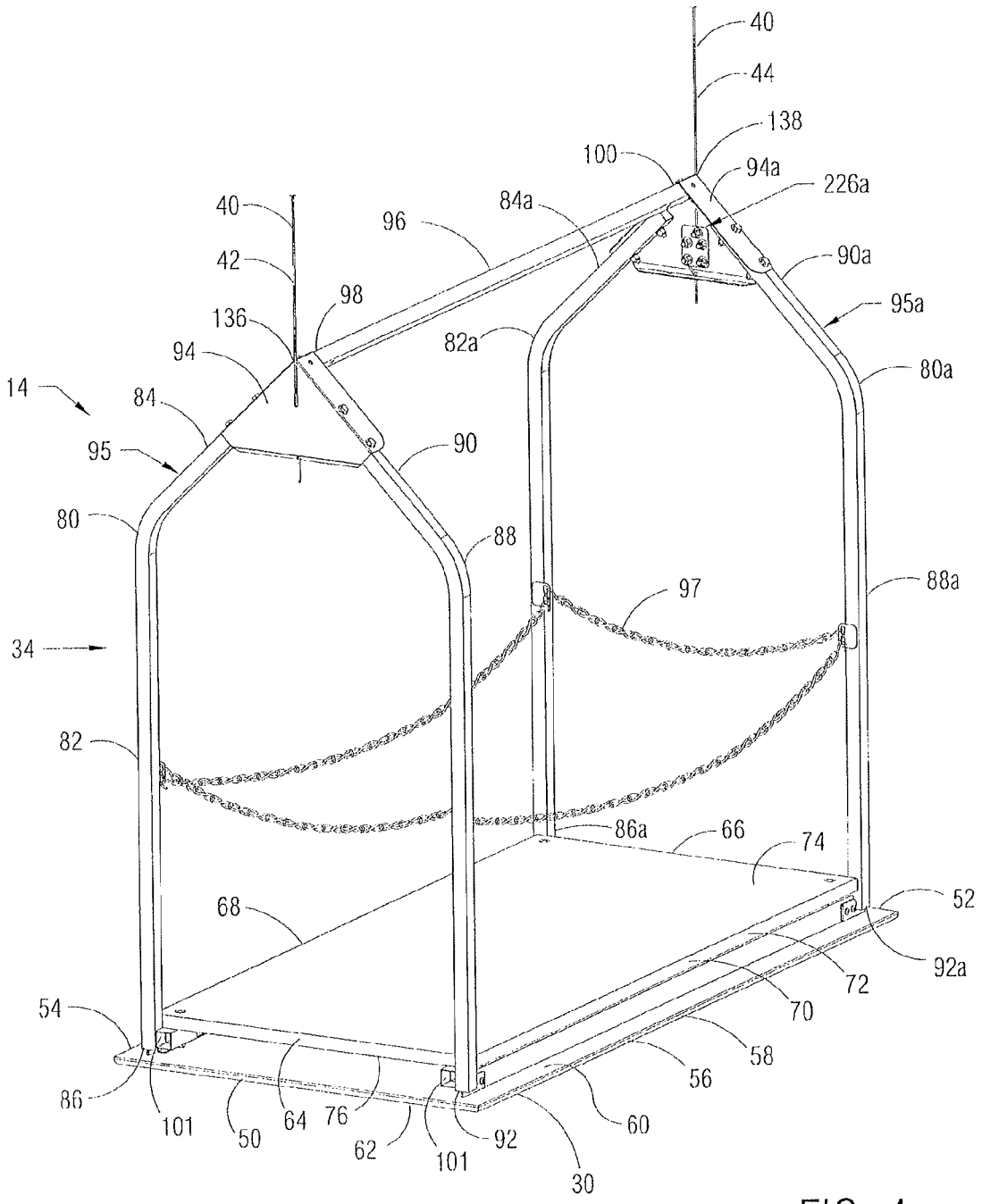
FIG. 4 is a perspective view of a platform assembly of the system of FIGS. 1-3.

Referring now to the platform assembly 14 as shown in FIG. 4, in one embodiment, the closure platform 30 has a first end 50, a second end 52 which opposes the first end 50, a first side 54, a second side 56 which opposes the first side 54, an outer peripheral edge 58 which extends about the circumference of the closure platform 30, an upper surface 60, and a lower surface 62. Similarly, the lifting platform 32 has a first end 64, a second end 66 which opposes the first end 64, a first side 68, a second side 70 which opposes the first side 68, an outer peripheral edge 72 which extends about the circumference of the lifting platform 32, an upper surface 74, and lower surface 76.

The platform assembly 14 is preferably configured so that the lifting platform 32 is as close as practical to the garage floor 22 when in the lowered position as shown in FIGS. 1, 4, 6, 7 and 8.

The platform frame 34 in this embodiment (e.g., FIG. 4) is constructed of a first end frame 80 having a first leg 82 having an upper end 84 and a lower end 86, a second leg 88 having an upper end 90 and a lower end 92, and a first side frame connector 94 which connects the upper end 84 of the first leg 82 to the upper end 90 of the second leg 88. The platform frame 34 is also constructed of a second end frame 80*a* which has a first leg 82*a* having an upper end 84*a* and a lower end 86*a*, a second leg 88*a* having an upper end 90*a* and a lower end 92*a*, and a second side frame connector 94*a* which connects the upper end 84*a* of the first leg 82*a* to the upper end 90*a* of the second leg 88*a*. In a preferred embodiment the platform frame 34 optionally comprises a reinforcing cross bar 96 having a first end 98 and a second end 100, wherein the first end 98 is connected to the first side frame connecter 94 and the second end 100 is connected to the second side frame connector 94*a*. The platform frame 34 is optionally enclosed with a removable chain, strap, band, webbing, net or tether 97 or other such barrier device such as a sidewall (discussed in further detail below). The platform frame 34 is constructed of any suitable material which has the strength and stability required to support operation of the present invention and may include metals such as aluminum, steel and titanium and/or thermoplastic polymeric materials, or other carbon-based materials such as graphite or composite materials or wood. It will be apparent to a person of ordinary skill in the art that the first end frame 80 and second end frame 80*a* could each be of unitary construction wherein the first and second legs 82, 88 and the associated connector 94, for example, could be made in one piece, such as by sheet metal stamping, die cast metal, molded thermoplastic polymer, wood or other suitable construction. In any event, each first leg 82 and second leg 88 is connected at or near first end 64 of the lifting platform 32 and each first leg 82*a* and second leg 88*a* is connected at or near second end 66 of the lifting platform 32.

As indicated above, both the closure platform 30 and the lifting platform 32 are connected to the platform frame 34. The lifting platform 32 preferably is rigidly connected to the platform frame 34, directly by screws, bolts, clamps, or other fastening devices for example, such that the first end frame 80 is connected to or adjacent the first end 64 (or first side 68), and the second end frame 80*a* is connected to or adjacent the second end 66 (or second side 70) wherein the first end frame 80 and second end frame 80*a* face and oppose each other. Alternatively an lifting platform support assembly 101 may be connected to the platform frame 34, and the lifting platform 32 connected to the lifting platform support assembly 101, wherein the lifting platform 32 is attached indirectly to the platform frame 34 via the lifting platform support assembly 101, rather than directly.

The first end frame 80 and second end frame 80*a* may be connected to or are adjacent to portions of the outer peripheral edge 72 of the lifting platform 32 wherein the lower end 86 of the first leg 82, the lower end 92 of the second leg 88, the lower end 86*a* of the first leg 82*a*, and the lower end 92*a* of the second leg 88*a* are exposed and downwardly oriented. In one embodiment, at least a lower portion of each leg 82, 88, 82*a* and 88*a* is hollow for containing a portion of the biasing mechanism 35. Preferably an upper portion of the first end frame 80 is slanted inwardly toward the cable attachment points forming a first end converging portion 95, and an upper portion of the second end frame 80*a* is slanted inwardly forming a second end converging portion 95*a*. First end converging portion 95 has a first end frame apex 136 and second end converging portion 95*a* has a second end frame apex 138.

In the embodiment of FIGS. 1-11, the biasing mechanism 35 comprises a plurality of individual coiled tension springs comprising biasing springs 102*a*, 102*b*, 102*c* and 102*d*, each of which has a first end 104*a*, 104*b*, 104*c* and 104*d*, respectively, which is attached to or substantially contained within the leg 82, 88, 82*a* and 88*a*, respectively, and a second end 106*a*, 106*b*, 106*c* and 106*d* which protrudes from or extends from the leg 82, 88, 82*a* and 88*a*, respectively. The protruding second ends 106*a*-106*d*, each are attached via a fastening device 108*a*-108*d*, respectively, to the closure platform 30 of the platform assembly 14. When the biasing springs 102*a*-102*d* are fully retracted within each leg 82, 88, 82*a* and 88*a*, respectively, the closure platform 30 is urged (biased) in a fully retracted position such that the closure platform 30 is substantially adjacent to the lifting platform 32 (FIGS. 1, 4, 6, 7 and 8). The closure platform 30 is usually in the fully retracted position when the platform assembly 14 is resting on the garage floor 22 in preparation for loading items onto or unloading items from the lifting platform 32 as shown in FIGS. 1, 4, 6, 7 and 8, or when the platform assembly 14 is in a partially elevated (raised) position (as shown in FIG. 2) before the closure platform 30 engages the ceiling 24. When the platform assembly 14 is raised such that the lifting platform 32 is lifted through the portal 28 into the raised position as shown in FIGS. 3, 9, 10 and 11, the closure platform 30 engages and abuts the ceiling 24 and the biasing springs 102*a*-102*d* of the biasing mechanism 35 are extended under tension such that the biasing springs 102*a*-102*d* urge the closure platform 30 against the ceiling 24 as the lifting platform 32 is raised into an attic loading or attic unloading position wherein the closure platform 30 fits against and abuts the ceiling 24 thereby stopping further upward advancement of the closure platform 30 and closing the lower entrance 29*b* of the portal 28 in accordance with the present invention.

As the lifting platform 32 and platform frame 34 of the platform assembly 14 are raised through the portal 28, the upwardly directed force supplied by the cable 40 will overcome the biasing force supplied by the biasing springs 102*a*-102*d* of the biasing mechanism 35 so that distal separation will occur between the closure platform 30 and the lifting platform 32. In other words, the biasing mechanism 35 will enable continued upward movement of the lifting platform 32 while retaining the closure platform 30 in place under tension against the ceiling 24. In this embodiment, the biasing springs 102*a*-102*d* will telescope out of the legs 82, 88, 82*a* and 88*a*, respectively during this operation, as shown in FIGS. 3, 9, 10 and 11. The upper surface 60 of the closure platform 30 may have a gasket (not shown) which lines the outer peripheral edge 58 of the upper surface 60 for engaging the ceiling 24 for forming a more tight fit therebetween. While it is shown herein that the coiled springs 102*a*-102*d* are substantially enclosed within the legs 82, 88, 82*a*, and 88*a* in the foregoing preferred embodiment, other embodiments are also contemplated wherein the coiled springs 102*a*-102*d* are outside of, partially enclosed by, adjacent-to, or parallel-to, the legs 82, 88, 82*a*, and 88*a*, yet still connected to the frame 34 at their upper ends 104*a*-104*d* and to the closure platform 30 at their lower ends 106*a*-106*d*.

The presence of the biasing mechanism 35, a novel feature of the present invention, allows the final elevational height of the lifting platform 32 to be set independently of the elevational height of the closure platform 30 (at least to the extent allowed by the extendability of the biasing springs 102*a*-102*d*). Preferably, the lifting platform 32 is raised until such time that the upper surface 74 of the lifting platform 32 is substantially even (flush) with the elevation of the attic floor 26. This advantageously allows the user to easily slide or otherwise move the cargo items 46 laterally from the lifting platform 32 and onto the attic floor 26, or alternatively from the attic floor 26 to the lifting platform 32. It is therefore generally unnecessary for the user, as in prior art systems, to step onto or otherwise reach down into the portal 28 below the level of the attic floor 26 in order to access the cargo item 46 on the lifting platform 32, or to lift the cargo item 46 up and over one or more platform obstructions (e.g., rims) to remove the cargo item 46 therefrom. Substantially heavier and bulkier loads can thus be readily accommodated by the platform assembly 14.

Figure 5:
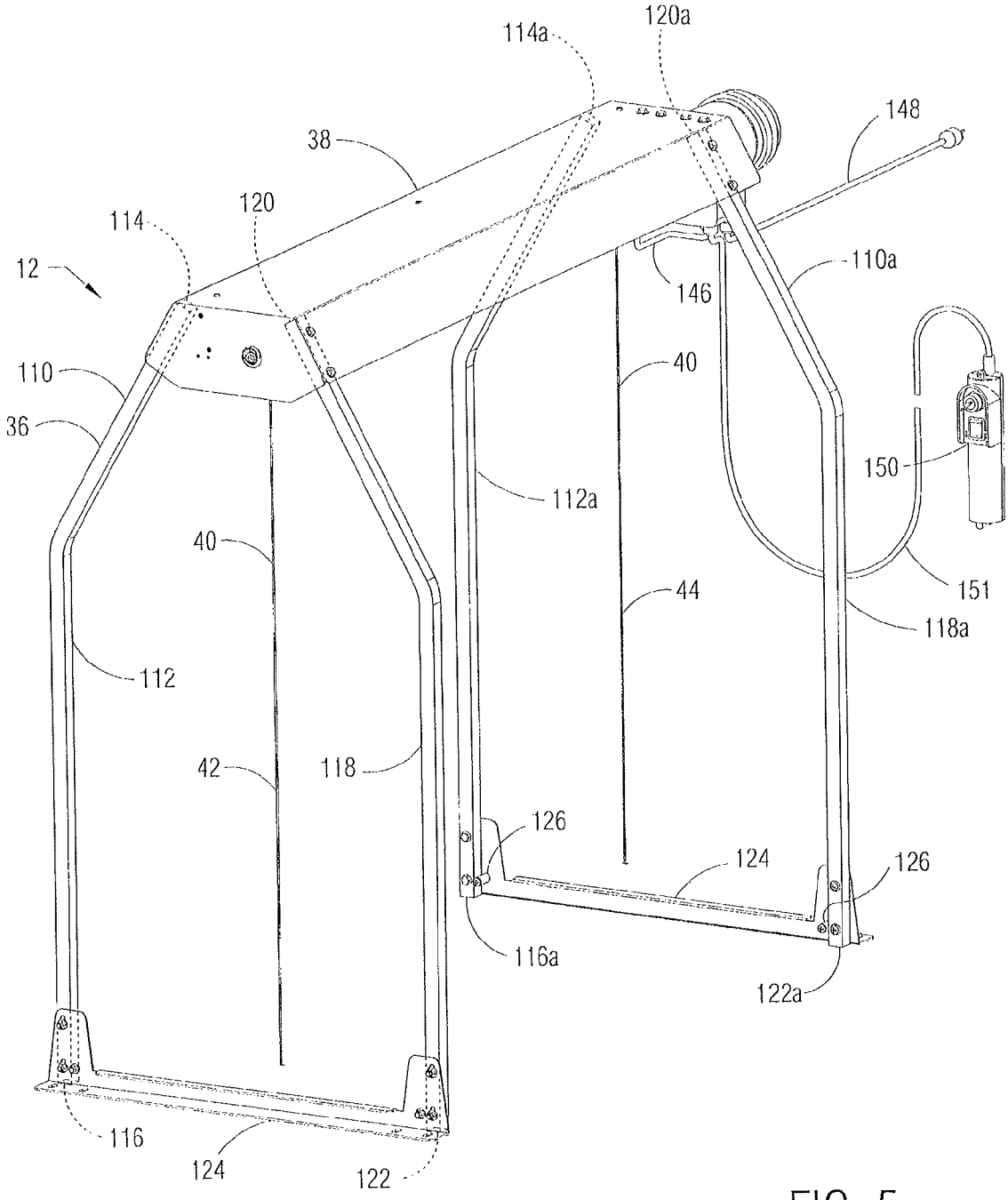
FIG. 5 is a perspective view of a support and drive assembly of the system of FIGS. 1-3.
Figure 6:
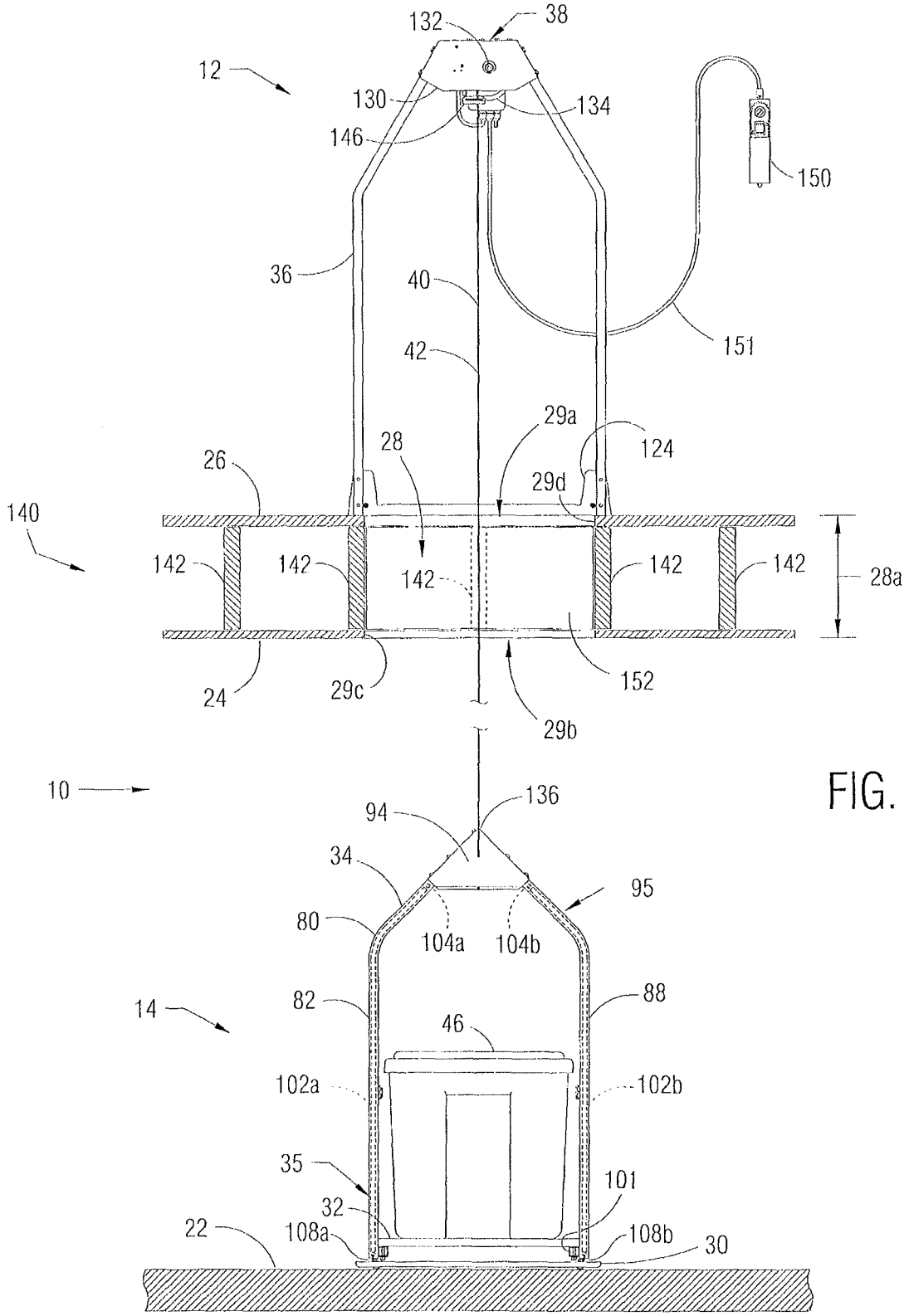
FIG. 6 shows an end view of the lifting system of FIGS. 1-3 with a lifting platform (upper platform) thereof supported on a lower floor surface, such as in a garage.
Figure 7:
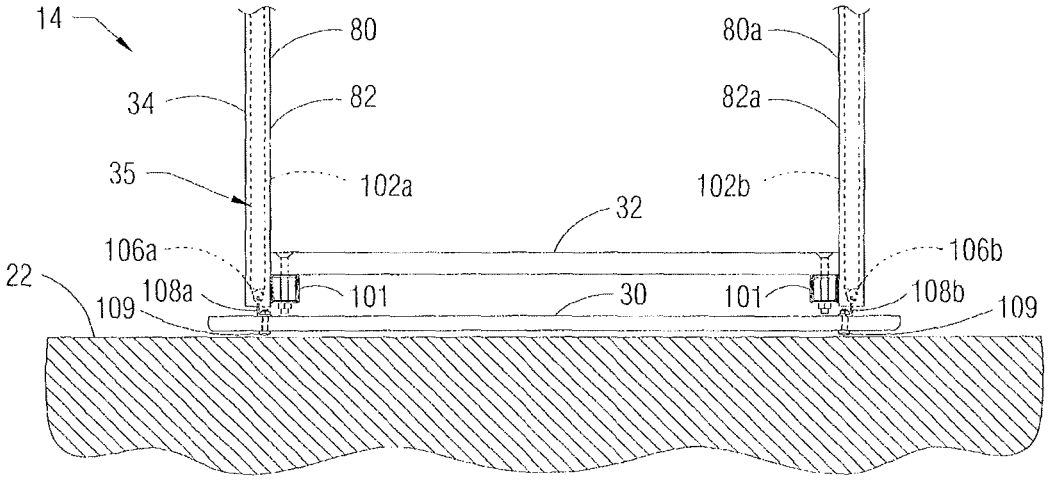
FIG. 7 shows a partial side view of the platform assembly of FIG. 6.
Figure 10:
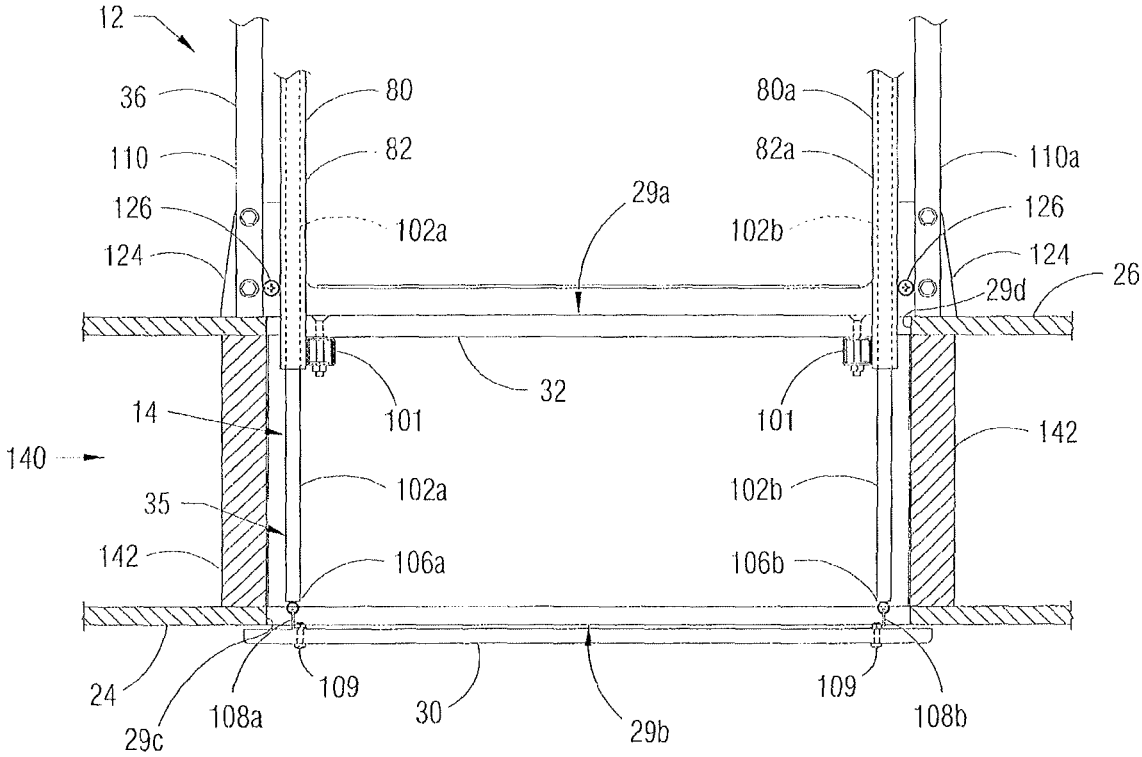
FIG. 10 shows a partial side view of the platform assembly of FIG. 9 in the raised position.

As previously noted, the support and drive assembly 12 comprises a support frame 36 and a drive mechanism 38. As shown in FIG. 5, in one embodiment, the support frame 36 is constructed of a first end frame 110 having at least a first leg 112 (which may be of unitary construction) having an upper end 114 and a lower end 116, and second leg 118 (which may be of unitary construction) having an upper end 120 and a lower end 122. The support frame 36 is also constructed of a second end frame 110*a* which has at least a first leg 112*a* (which may be of unitary construction) having an upper end 114*a* and a lower end 116*a*, and a second leg 118*a* (which may be of unitary construction) having an upper end 120*a* and a lower end 122*a*. It is also contemplated herein that the first end frame 110 and second end frame 110*a* can each be of unitary construction wherein, for example, the first and second legs 112, 114, and optionally the floor rail 124, can be made in one piece, such as by sheet metal stamping, die cast metal, molded thermoplastic polymer, wood or other suitable construction.

The support frame 36 is constructed of any suitable material which has the strength and stability required to support operation of the present invention and may include metals such as aluminum, steel and titanium and/or thermoplastic polymeric materials, or carbon-based materials such as graphite or composite materials or even wood. In an alternate embodiment, first leg 112 and second leg 118 of first end frame 110 each may be of non-unitary construction, i.e., constructed from more than one element, and first leg 112*a* and second leg 118*a* of second side frame 110*a* each may also be non-unitary of non-unitary construction, as noted above. In any event each first leg 112 and 112*a* and second leg 118 and 118*a* is, in one embodiment, attached to a floor rail assembly 124 which is securely attached to the attic floor 26 adjacent to the portal 28 (e.g., FIGS. 5, 6, and 8-11). Alternatively, each leg 112, 112*a*, 118, and 118*a* may be individually directly attached to the attic floor 26. The function of the support frame 36 is to support the drive mechanism 38 in a position in the attic 20 above the portal 28.

As shown in FIG. 5, the support frame 36 optionally further comprises a plurality of spacers 126 which may be attached either to the legs 112, 112*a*, 118 and 118*a* near the lower ends 116, 116*a*, 122, and 122*a* thereof, respectively, or, as shown in FIG. 5, to portions of the floor rail assembly 124 in positions near the floor 26 and adjacent the legs 112, 112*a*, 118, and 118*a* of the support frame 36. The spacers 126 are preferably constructed of a durable yet smooth material such as nylon or other thermo-plastic material, or metal. The spacers 126 are preferably attached such that they are able to roll when exposed to a surface pressure and function to maintain separation between the platform frame 34 and the portal attic floor edge 29*d* and the support frame 36, and to properly align, guide and center the platform frame 34 within the portal 28 as shown for example in FIGS. 9, 10, 12B, 14B, 16 and 17.

Figure 11:
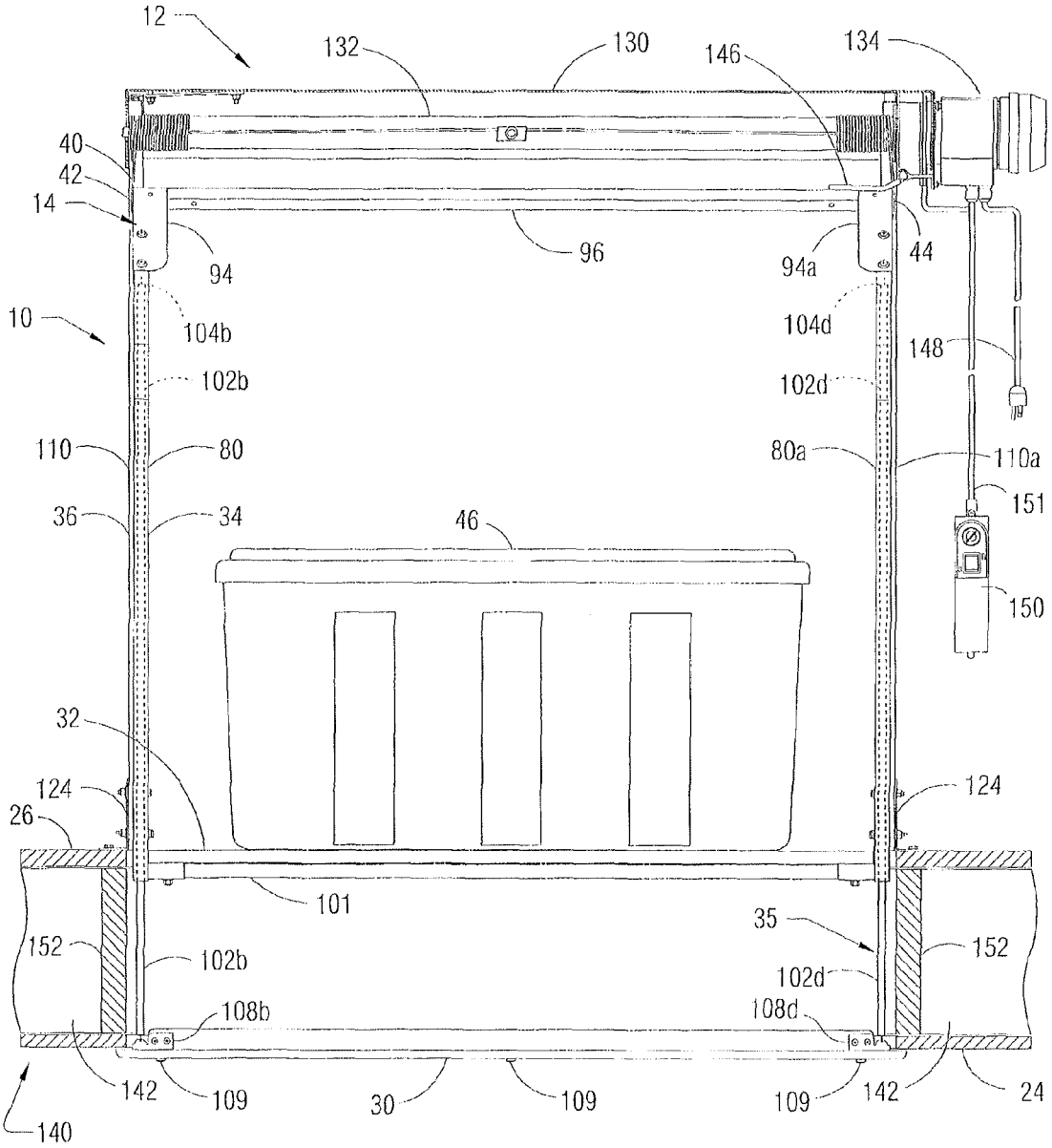
FIG. 11 shows a side view of the lifting system as shown in FIG. 9.
Figure 12A:
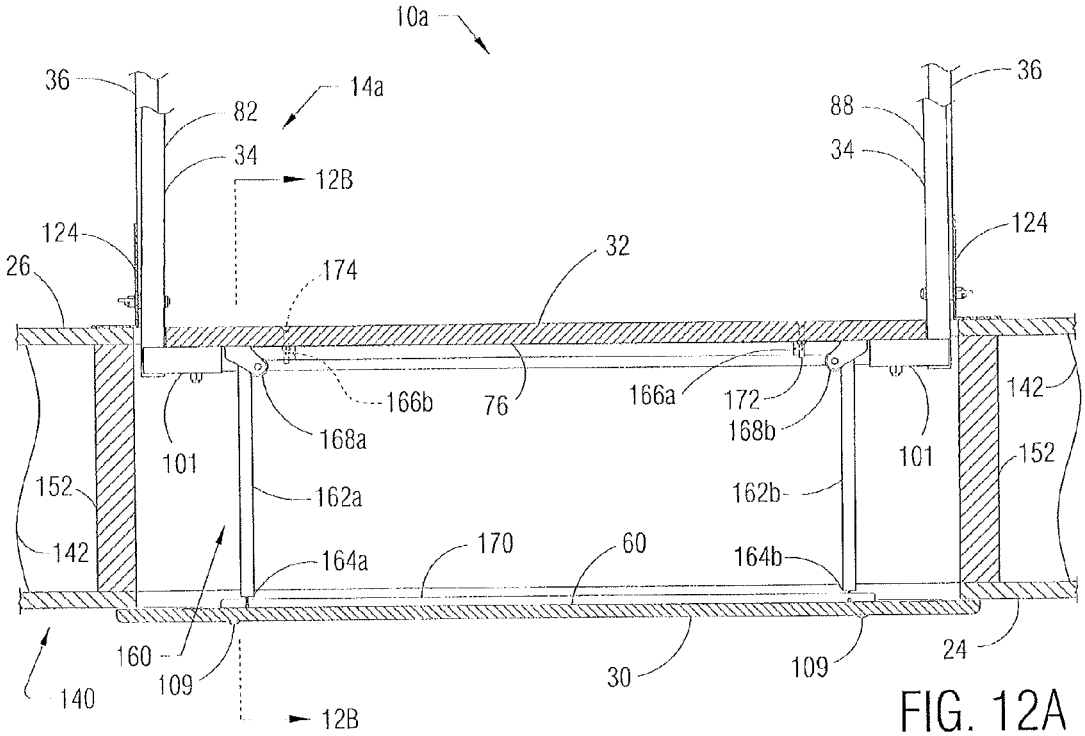
FIGS. 12A and 12B show side and end views, respectively, of an embodiment of the present invention having an alternate biasing mechanism when the platform assembly is in a raised position.
Figure 21:
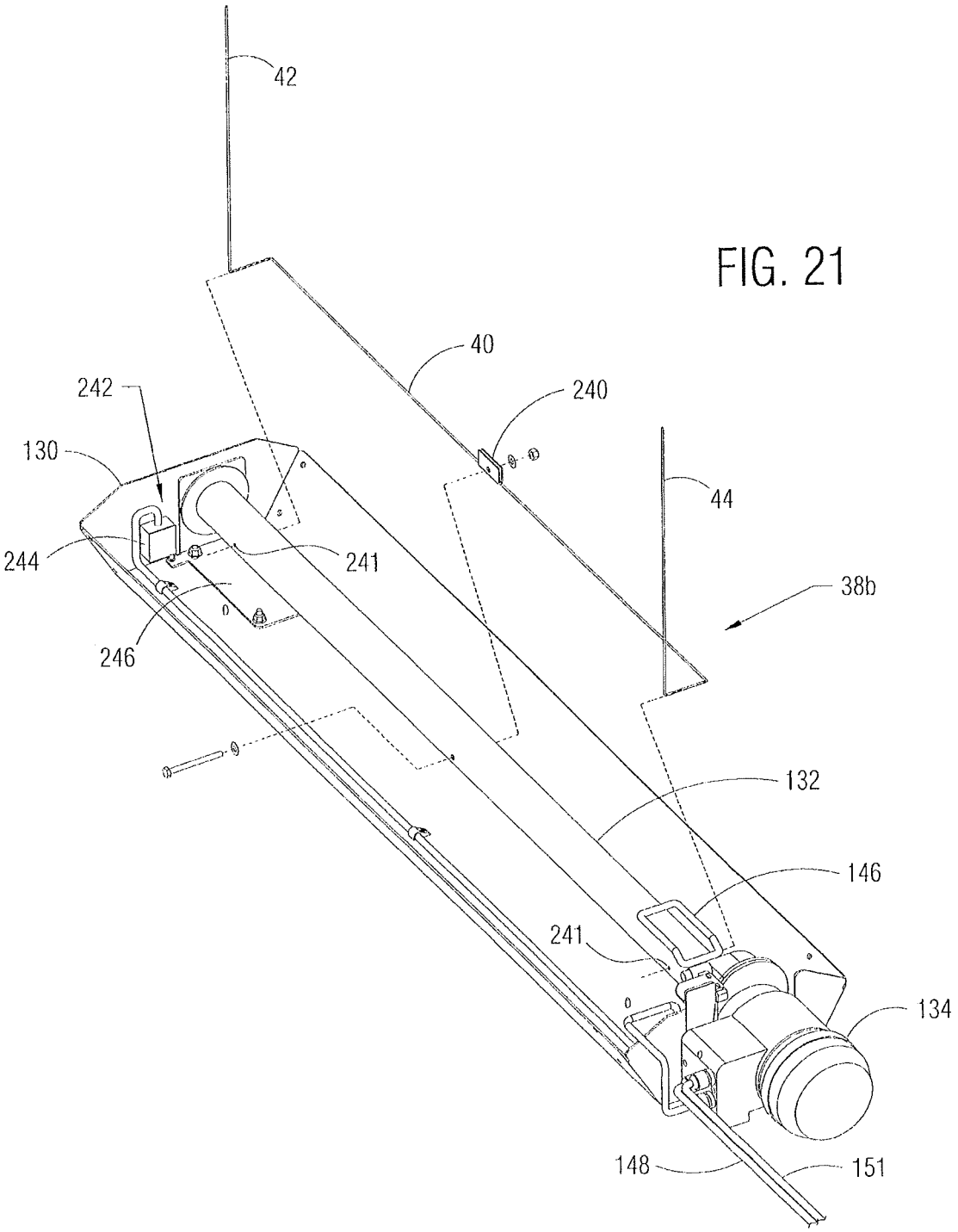
FIG. 21 is a bottom perspective view of a drive assembly of the present invention.

As shown in FIGS. 11 and 21, the drive mechanism 38 is constructed of a winch housing 130 transversely connected at one end to the first end frame 110 and at an other end to second end frame 110*a* of the support frame 36. A winch tube assembly 132 extends longitudinally within the winch housing 130 and is operatively connected to a winch motor 134 which causes rotation of the winch tube assembly 132 for raising and lowering the cable 40 which is attached to the winch tube assembly 132.

Any number of suitable motors are commercially available for use as the winch motor 134. One particularly suitable motor is Electric Hoist Motor Model 40765 by Chicago Electric, Inc., which has a rated lifting capacity of 250 lbs.

The cable 40 (also referred to herein as a tether) has a first cable arm 42 (also referred to herein as tether arm 42) and a second cable arm 44 (also referred to herein as tether arm 44) (e.g., see FIGS. 1, 2, 4, 5, 8, 21) which are coupled to the movable platform assembly 14 and which extend from the winch tube assembly 132. A center portion of the cable 40 is preferably secured to the winch tube assembly 132 at a medial position thereof (as shown in more detail in FIG. 21), and first cable arm 42 and second cable arm 44 of the cable 40 each extends from the winch tube assembly 132 downwardly, where the first cable arm 42 is attached to the first side frame connector 94 of the first side frame 80, and the second cable arm 44 is attached to the second side frame connector 94*a* of the second side frame 80*a*.

Figure 8:
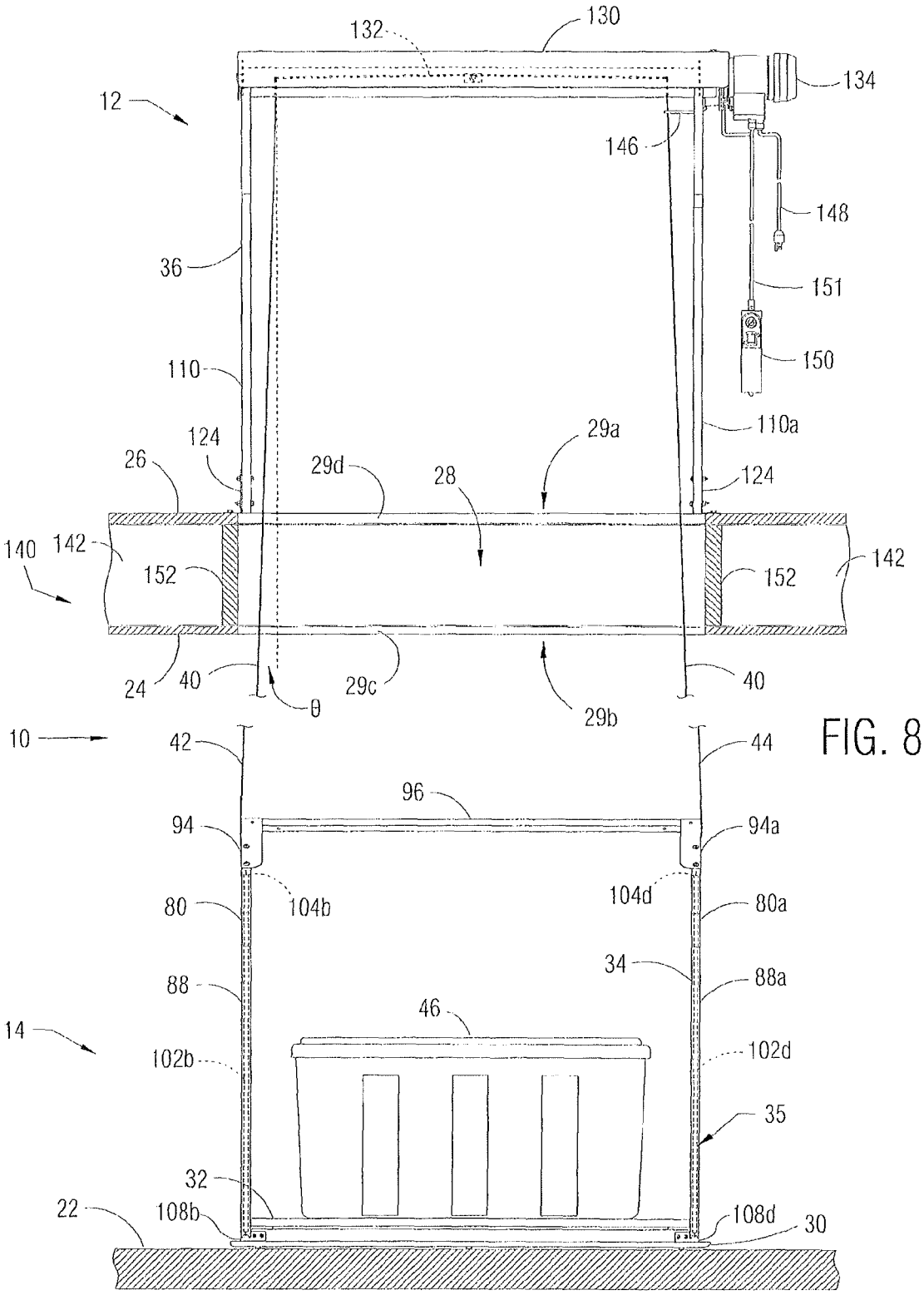
FIG. 8 shows a side view of the lifting system of FIG. 6.
Figure 9:
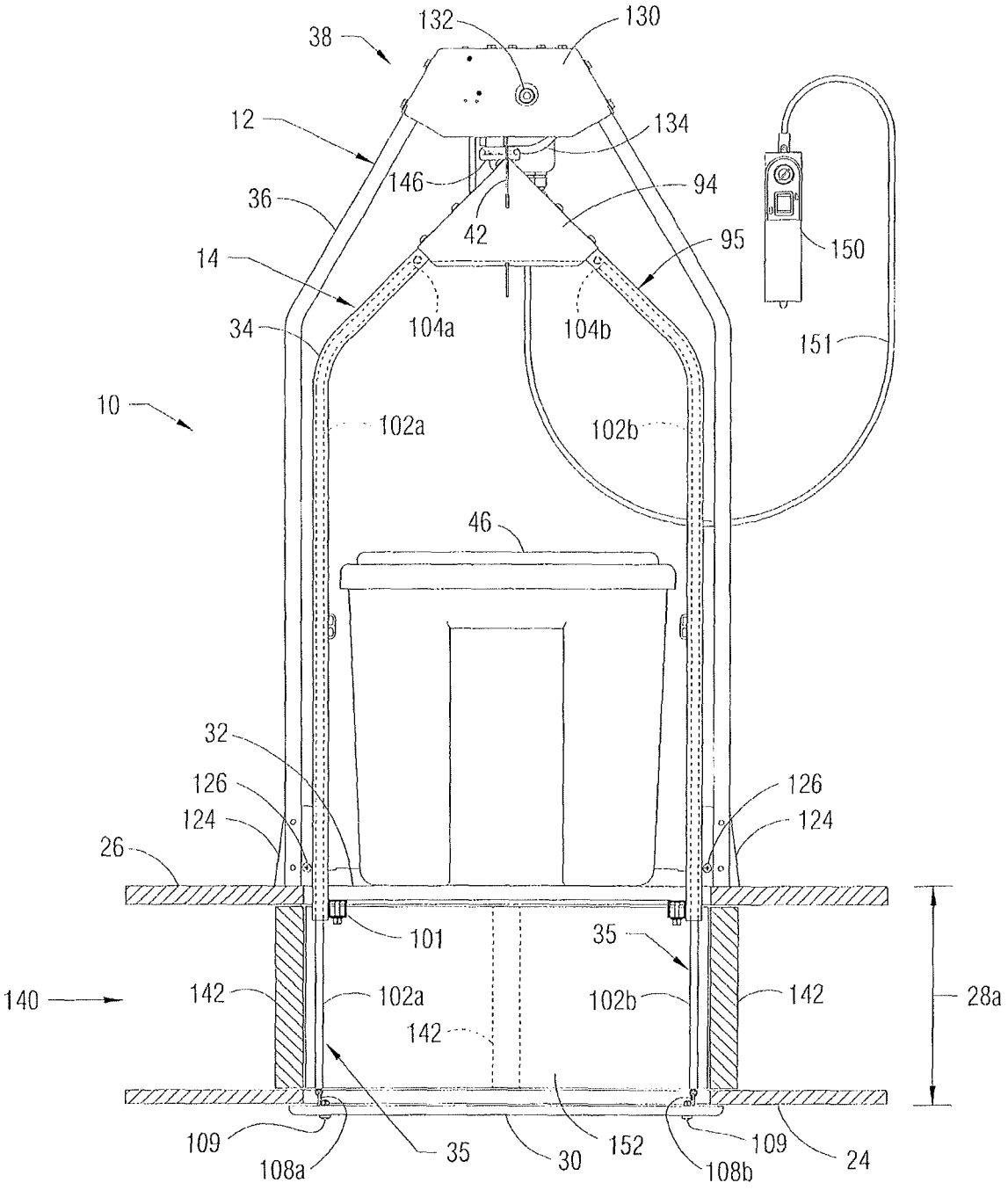
FIG. 9 shows an end view of the lifting system of FIG. 1 with the platform system raised and aligned with an upper floor surface, such as in an attic over a garage.

As shown in FIGS. 8 and 11, each first cable arm 42 and second cable arm 44 of cable 40 preferably extends at a slightly off-vertical angle with respect to vertical when the platform assembly 14 is in the lowermost position. As the winch tube assembly 132 is rotated, the cable 40 wraps about the winch tube assembly 132 thereby raising the first cable arm 42 and second cable arm 44 of the cable 40 and the platform assembly 14. In this way, the off-vertical angle approximates the winding pitch of the cable 40 on the winch tube 132 as the platform assembly 14 is raised, and the first cable arm 42 and second cable arm 44 of cable 40 will be either vertically aligned or remain off-vertical when the platform assembly 14 is in an uppermost position. This cable configuration advantageously reduces the likelihood that rubbing contact will occur between portions of the cable 40 and edge portions of the portal 28 and enhances level winding of the cable 40 onto the winch tube 132.

While the platform assembly 14 is preferably only supported by the cable 40 at two opposing ends of the platform assembly 14, stability is nevertheless enhanced due to the configuration of the platform frame 34 with respect to the length and width dimensions of the lifting platform 32 of the platform assembly 14.

More specifically, the upwardly directed forces supplied by the cable 40 are transferred to the first end 64 and second end 66 of the lifting platform 32. Thus, even if the center of gravity of the cargo item 46 is significantly offset from a centerline of the lifting platform 32, it is contemplated that relatively little tilting of the lifting platform 32 will take place as the lifting platform 32 is raised.

The platform frame 34 is preferably configured to engage a portal ceiling edge 29*c* of the portal 28 to correct any twisting or other misalignments of the lifting platform 32 as it is raised, thereby ensuring that the platform assembly 14 is guided properly into the portal 28 in the upright position shown in FIGS. 3, 9, 10 and 11. Thus, to the extent that any tilting or other misalignment of the platform assembly 14 occurs during lifting, such will be corrected as the platform frame 34 enters the portal 28, providing alignment before the cargo 46 and the lifting platform 32 enter the portal 28.

Another advantage of the platform frame 34 of the present invention is that the legs 82, 88, 82*a* and 88*a* stabilize the lifting platform 32 against both upward and downward relative motion of the respective corners of the lifting platform 32. For example, in an apparatus wherein four separate cables are attached directly to a platform with one at each corner (as in the prior art), it can be readily seen that each of said corners would be secured against downward motion due to the respective tension in the associated cable. However, if an event occurred during lifting of such a 4-cable platform, such as a shift in the center of gravity of the cargo or an obstruction such as with the ceiling surface, there may be nothing to prevent one side of the prior art platform from rising (i.e., advancing upwardly faster than the draw rate of the associated cables) and causing the platform to undergo a tilt to substantially vertical orientation, thereby allowing the cargo to fall off the 4-cable platform. Further, if one cable becomes fouled, tangled, or jammed while the 4-cable platform is being lowered, then one corner would be halted while the others proceed downward causing the platform to progressively tilt to a substantially vertical orientation, spilling the cargo.

Thus, the respective legs 82, 88, 82*a* and 88*a* of the platform frame 34 of the present invention significantly enhance the stability of the lifting platform 32 by resisting both compressive and tension forces upon the corners of the first end 64 and second end 66 of the lifting platform 32 that would otherwise tend to move the lifting platform 32 out of the stable orientation.

As shown in FIGS. 1-3, 6, and 8-11, the attic floor 26 and ceiling 24 form an upper surface and a lower surface, respectively (having a portal depth 28*a* therebetween) of an upper support structure 140 which has a plurality of joists 142 perpendicularly oriented to the attic floor 26 and ceiling 24. In a preferred embodiment the joists 142 are contemplated as comprising conventional 2×12 lumber members located on 16 inch spacings, although other configurations, including different types and sizes of joist members and/or spacings, can readily be accommodated as understood by a person of ordinary skill in the art.

Another advantage of the platform assembly 14 as contemplated herein is that it readily adapts to different portal depths 28*a* of the portal 28 in the upper support structure 140 (i.e., wherein portal depth 28*a* is defined herein as the distance between the attic floor 26 (upper surface) and ceiling 24 (lower surface) as determined by the dimensions of the joists 142). For example, if the joists 142 comprise 2×10 boards or planks instead of 2×12s, the overall thickness of the upper support structure 140 (i.e., distance between the attic floor 26 and ceiling 24 and equivalent to the portal depth 28*a*) would be accordingly reduced by almost two inches. If the joists 142 were 2×16s, the thickness would be increased by about 4 inches.

Nevertheless, the platform assembly 14 would operate substantially as before with the closure platform 30 engaging and abutting the ceiling 24 and the lifting platform 32 continuing upwardly to the final position level with the attic floor 26 since the biasing springs 102*a*-102*d* are automatically adjustable. In this case (wherein the joists 142 are 2×10s), the only substantive operational difference would be that the biasing springs 102*a*-102*d* would generally undergo a reduced amount of extension, so that the final separation distance between the lifting platform 32 and the closure platform 30 would be reduced.

The closure platform 30 preferably comprises a series of small support members (not shown), such as elastomeric cushion members at each corner of the lower surface 62. These support members of closure platform 30 support the weight of the platform assembly 14 and the loaded cargo item 46 when the platform assembly 14 is in the lowermost (resting) position on the garage floor 22 (see e.g., FIGS. 1, 6 and 7), thus preventing contact between the closure platform 30 and the garage floor 22. This advantageously prevents the transfer of oil, dirt or other contaminants from the garage floor 22 to the closure platform 30 (oil stains on garage floor 22 may be acceptable, while oil stains on ceiling 24 are generally not). Alternately, fasteners 109 used to attach fastening device 108*a*-108*d* to the closure platform 30, such as shown in FIGS. 7, 9, 10, 11, 12B and 14A, may be provided with well-known plastic screw head covers or other devices that can serve the same purposes as the aforementioned elastomeric cushion members.

Referring now to the support and drive assembly 12, as shown in FIGS. 6, 8, 9 and 11, an upper limit switch lever 146 extends from the winch motor 134 adjacent the winch tube assembly 132. As the lifting platform 32 reaches the final desired elevation, the uppermost portion of the second side frame connector 94*a* of platform frame 34 (or other appropriate portion of the platform frame 34, such as the reinforcing cross bar 96) toggles the upper limit switch lever 146 upwardly, activating an internal limit switch of the winch motor 134 to turn the winch motor 134 off. Preferably, the upper limit switch lever 146 has an enclosed aperture (shown in FIG. 21) through which the cable 40 extends. In this way, the cable 40 is captured by the upper limit switch lever 146, ensuring that the second side frame connector 94*a* will remain properly aligned with the upper limit switch lever 146.

As shown in FIGS. 8 and 11, power is supplied to the lifting system 10 such as by way of a power cord 148. Alternatively, the lifting system 10 can be hardwired using a dedicated electrical junction box, or powered by a removable extension cord. User control inputs are preferably provided by way of a control module 150. It is contemplated that the control module 150 may be configured to require the user to be physically located within a radius defined by the length of the control module cord 151, in order to operate the lifting system 10. Alternatively the support and drive assembly 12 may be operated remotely by a wireless controller, such as used for garage door openers and well known in the art.

Suitable lockout and safety precautions are preferably enacted to prevent unauthorized use of the system, such as by unattended children. In one preferred embodiment shown in FIG. 20, the control module is disabled electrically by a key-locking switch 151*b*. Other preferred embodiments are also contemplated. For example, the control module 150 can be made to be removable from the rest of the lifting system 10 and safely stored or locked up elsewhere by a responsible adult. Similarly, the lifting system 10 can be configured to accommodate keyed padlocks or other mechanisms (such as on the upper limit switch lever 146) to ensure that the lifting system 10 is not operated by unauthorized personnel.

As mentioned previously, the upper support structure 140 is contemplated in the present example to comprise a series of joists 142 on 16 inch centers, which can be a commonly employed residential construction configuration. A preferred configuration for the lifting system 10 provides the lifting platform 32 with a width of nominally 32 inches or slightly less, or about two 16 inch spans. In this way, during original construction or retrofit of an existing structure, a portion of one of the joists 142 in the upper support structure 140 can be removed and a pair of end boards 152 secured perpendicularly between two adjacent joists 142 to define the portal 28, as shown in FIGS. 8 and 11.

In another alternative residential construction configuration, joists 142 may be positioned on 24 inch centers. In this case, the lifting platform may have a width of nominally 24 inches, sufficient to fit within a single span. A pair of end boards 152 can be supplied as before to define and enclose the portal 28 between adjacent joists 142. While 24 and 32 inch widths of portal 28 provide particular advantages, it will be understood by a person of ordinary skill in the art that this is merely illustrative and is in no way limiting; rather, any number of different widths and lengths for the lifting platform 32 can be employed depending on the requirements of a given application.

As desired, the lifting system 10 or any lifting system described herein can be provided as a kit able to accommodate both the 24 and 32 inch (or other) sizes. Adjustment mechanisms can readily be configured by the skilled artisan to permit either size to be erected by the installer or end user. For example, the lifting platform 32 can comprise 8 inch wide planks (laid transversely to the direction shown in FIGS. 1-3), such that three planks will provide a 24 inch width, and four such planks will provide a 32 inch width of the lifting platform 32. Similarly, extension pieces can be configured to expand or contract the sizes of components of the platform frame 34 and/or support frame 36 to meet the 24 or 32 inch version, and so on. In an alternate embodiment of the present invention, a lifting system 10*a* is similar in all ways to lifting system 10 or any other lifting system described herein except in having an alternate configuration of a platform assembly 14*a* which has an alternate biasing mechanism such as that shown in FIGS. 12A, 12B, 13A and 13B and designated therein by the general reference numeral 160. Biasing mechanism 160 is constructed of a plurality of biasing springs (e.g., tension springs) 162*a*, 162*b*, 162*c* and 162*d*, each of which is attached to both lifting platform 32 and closure platform 30 of the platform assembly 14. In other words, the biasing mechanism is not directly attached to portions of the legs 82, 82*a*, 88 and 88*a* of the platform frame 34 and to the closure platform 30, but rather to the lower surface 76 of the lifting platform 32 and to the upper surface 60 of the closure platform 30. In particular, biasing springs 162*a*, 162*b*, 162*c*, and 162*d* have first ends 164*a*, 164*b*, 164*c*, and 164*d*, respectively and second ends 166*a*, 166*b*, 166*c*, and 166*d*, respectively. Biasing spring 162*a* opposes and is adjacent to biasing spring 162*b*, and biasing spring 162*c* opposes and is adjacent to biasing spring 162*d*, in a manner such as that shown in FIGS. 12A-13B. Biasing spring 162*a* is attached at its first end 164*a* to closure platform 30 by a mounting bracket 170 and at its second end 166*a* to lifting platform 32 by a fastening device 172 and is entrained and supported at an intermediate position by a roller 168*a* which is secured to the lower surface 76 of the lifting platform 32. Similarly, biasing spring 162*b* is opposingly secured at its first end 164*b* to closure platform 30 by the mounting bracket 170 and at its second end 166*b* to lifting platform 30 by a fastening device 174 and is entrained and supported at an intermediate position by a roller 168*b* which is secured to the lower surface 76 of the lifting platform 32.

Figure 13A:
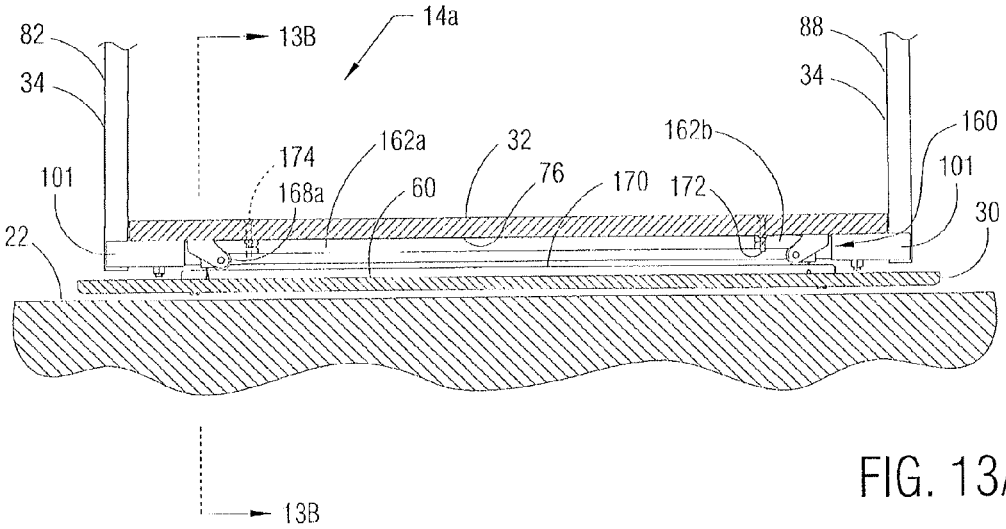
FIGS. 13A and 13B shown side and end views of the biasing mechanism of FIGS. 12A and 12B when the platform assembly is in a lowered position.
Figure 12B:
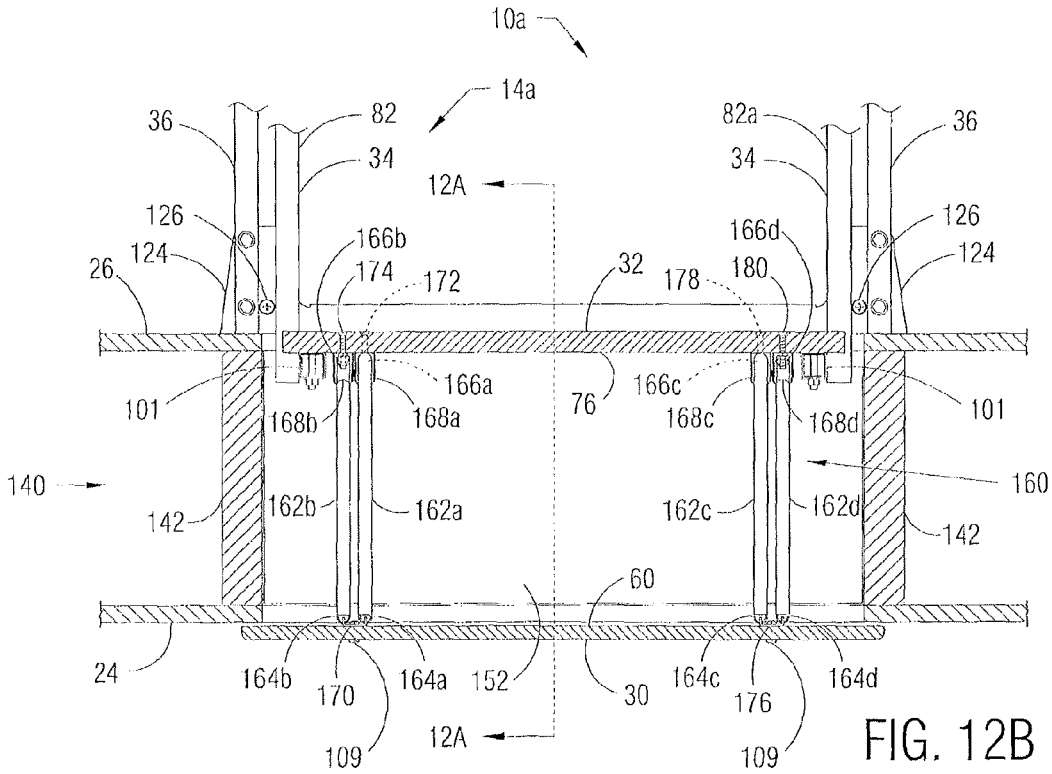
Figure 13B:
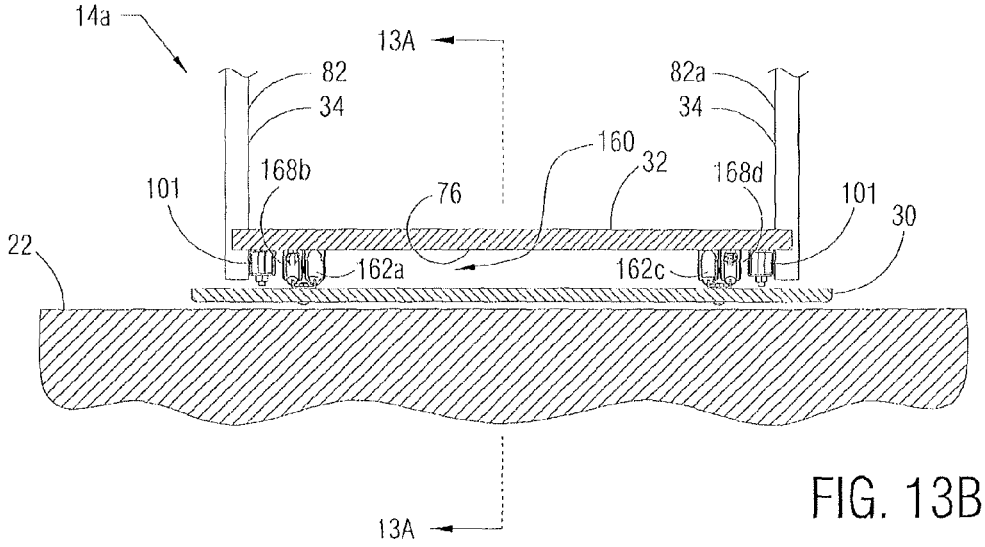
Figure 14A:
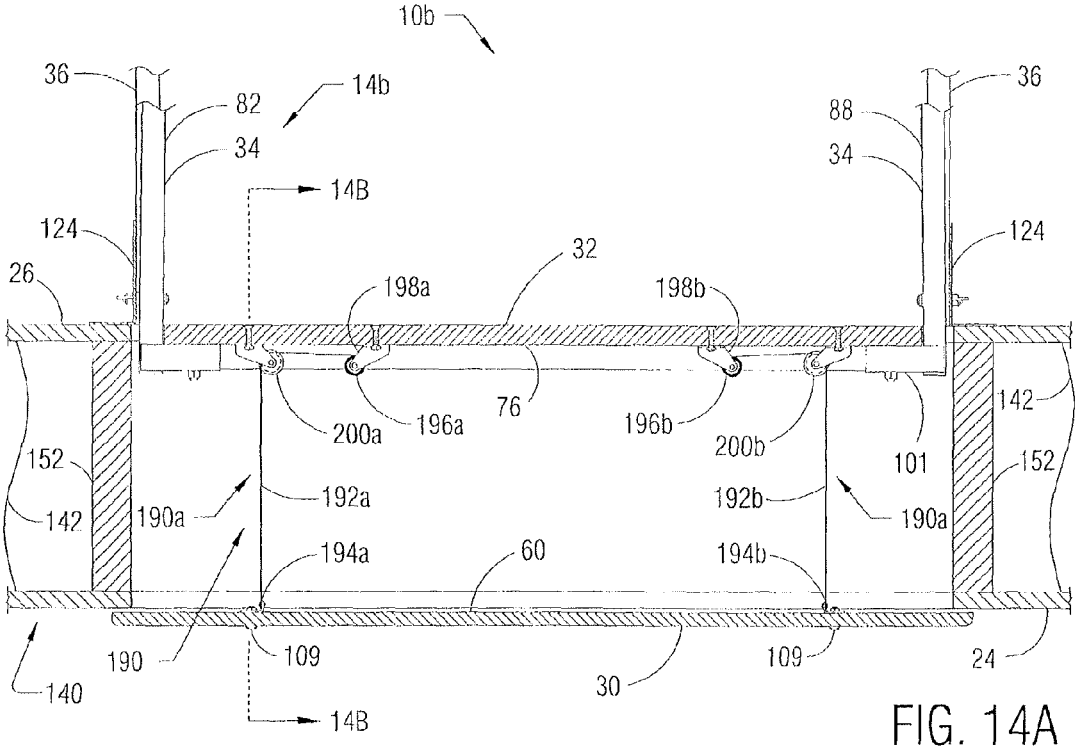
FIGS. 14A and 14B show side and end views, respectively, of an alternate embodiment of the invention having a biasing mechanism comprising a constant force spring, wherein the platform assembly is in a raised position.
Figure 15A:
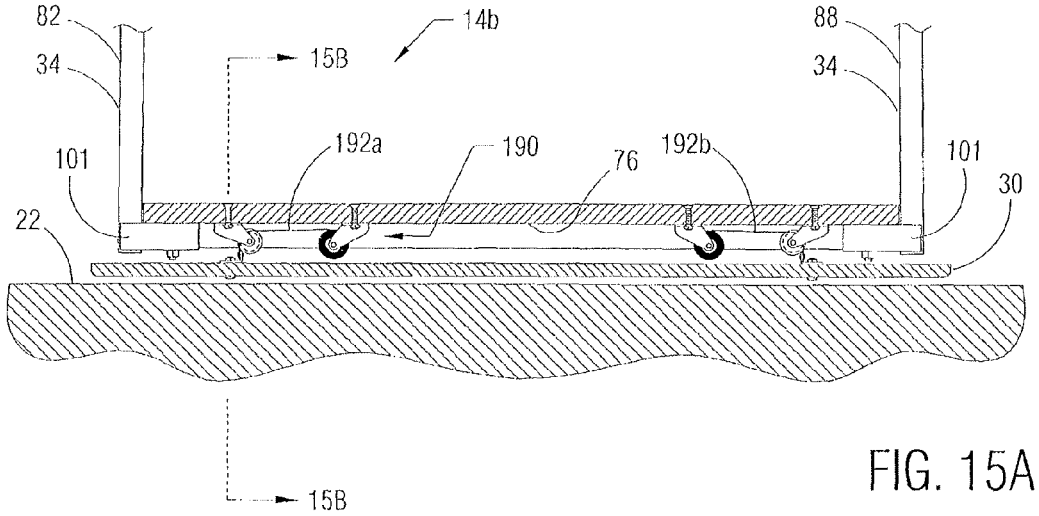
FIGS. 15A and 15B show side and end views, respectively, of the embodiment of FIGS. 14A and 14B when the platform assembly is in a lowered position.
Figure 14B:
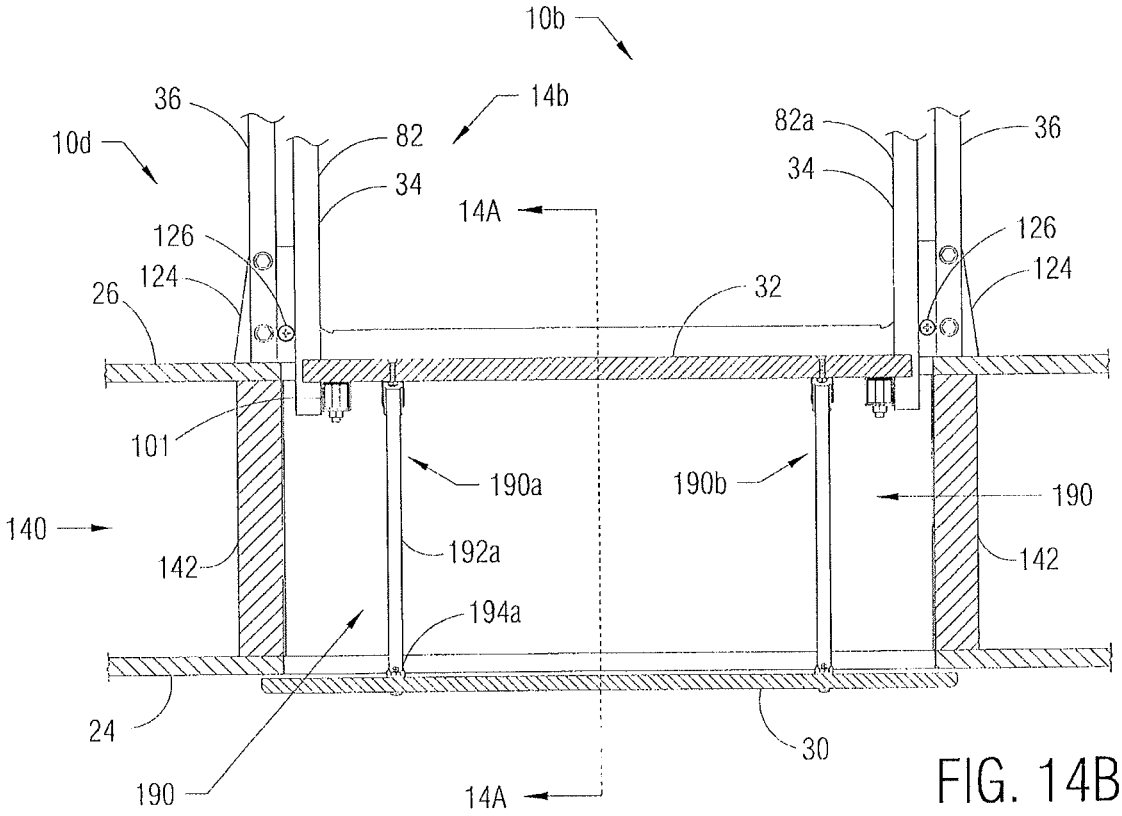
Figure 15B:
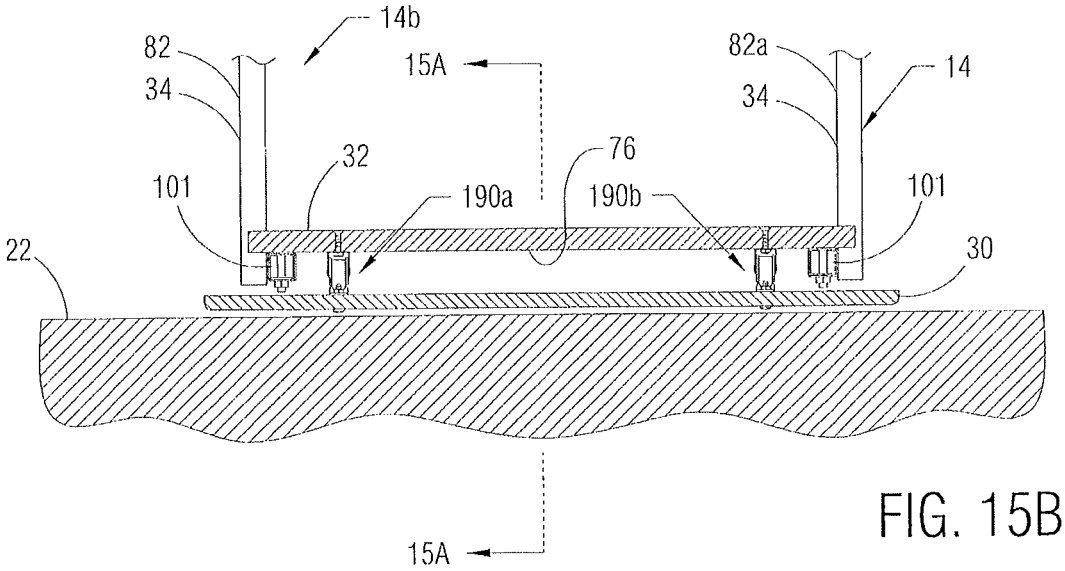

Biasing spring 162*c* is similarly attached at its first end 164*c* to closure platform 30 by a mounting bracket 176, and at its second end 166*c* to lifting platform 32 by a fastening device 178 and is entrained and supported at an intermediate position by a roller 168*c* which is secured to the lower surface 76 of the lifting platform 32. Similarly, biasing spring 162*d* is opposingly secured at its first end 164*d* to closure platform 30 by the mounting bracket 176 and at its second end 166*d* to lifting platform 32 by a fastening device 180 and is entrained and supported at an intermediate position by a roller 168*d* which is secured to the lower surface 76 of the lifting platform 32. Each biasing spring 162*a*, 162*b*, 162*c*, and 162*d* is substantially parallel to the lower surface 76 of the lifting platform 32 from its connection at the fastening device 172, 174, 178 and 180, respectively, to the roller 168*a*, 168*b*, 168*c*, and 168*d*, respectively, where each biasing spring 162*a*-162*d* is turned approximately 90 degrees toward the closure platform 30, where each biasing spring 162*a*-162*d* is attached as described above. In this manner, the biasing springs 162*a*-162*d* extend and roll over the rollers 168*a*-168*d* to provide the biasing force, as described elsewhere herein such that the closure platform 30 is abuttingly urged against the ceiling 24 to close the lower entrance 29*b* when the platform assembly 14 is raised through the portal 28 (FIGS. 12A-12B), and then retracts to urge the closure platform 30 in a position against the lifting platform 32 when the platform assembly 14 is lowered again below the portal 28 (FIGS. 13A-13B).

In an alternate version of the present invention, a lifting system referred to in FIGS. 14A, 14B, 15A and 15B by the general reference numeral 10*b* is similar to lifting system 10 or 10*a* or any other lifting system contemplated herein except in having an alternate configuration of a platform assembly 146, which has an alternate version of a biasing mechanism, referred to therein by general reference numeral 190. Biasing mechanism 190 is similar to biasing mechanism 160 of lifting system 10*a* except biasing mechanism 190, instead of comprising coiled tension springs, comprises a first pair of biasing springs 190*a* and a second pair of biasing springs 190*b* which are constant force springs. Each pair of biasing springs 190*a* and 190*b* comprise two constant force springs which are positioned in parallel on opposing sides of the platform assembly 14*b*. First pair of biasing springs 190*a* has a left hand spring 192*a* having a first end 194*a* attached to the closure platform 30 and a second end 196*a* attached to a pickup roller 198*a* which is secured to the lifting platform 32, and which is entrained over a payout roller 200*a*, also attached to lifting platform 32. First pair of biasing springs 190*a* further comprises an opposing right hand spring 192*b* having a first end 194*b* attached to the closure platform 30 and a second end 196*b* attached to a pickup roller 198*b* which is secured to lifting platform 32 and which is entrained over a payout roller 200*b*, also which is secured to the lifting platform 32. The second pair of biasing springs 190*b* is parallel to first pair of biasing springs 190*a* and is constructed in exactly the same configuration. The biasing mechanism 190 may comprise more than two pairs of constant force biasing springs. The biasing mechanism 190 functions to cause the closure platform 30 to be extended (FIGS. 14A and 14B) or retracted (FIGS. 15A and 15B) in a manner similar to that for the previously described lifting systems 10-10*a* and indeed the biasing mechanism 190 can be used in substitution of biasing mechanisms 35 or 160 in lifting systems 10-10*a*, or any other such lifting and closure system described or contemplated herein.

In an alternate embodiment the biasing mechanism may be a "scissor-type" mechanism (not shown) in which the biasing force tends to try keep the "scissor-type" mechanism in a closed (retracted) position, as with the other biasing mechanisms described herein.

Figure 16:
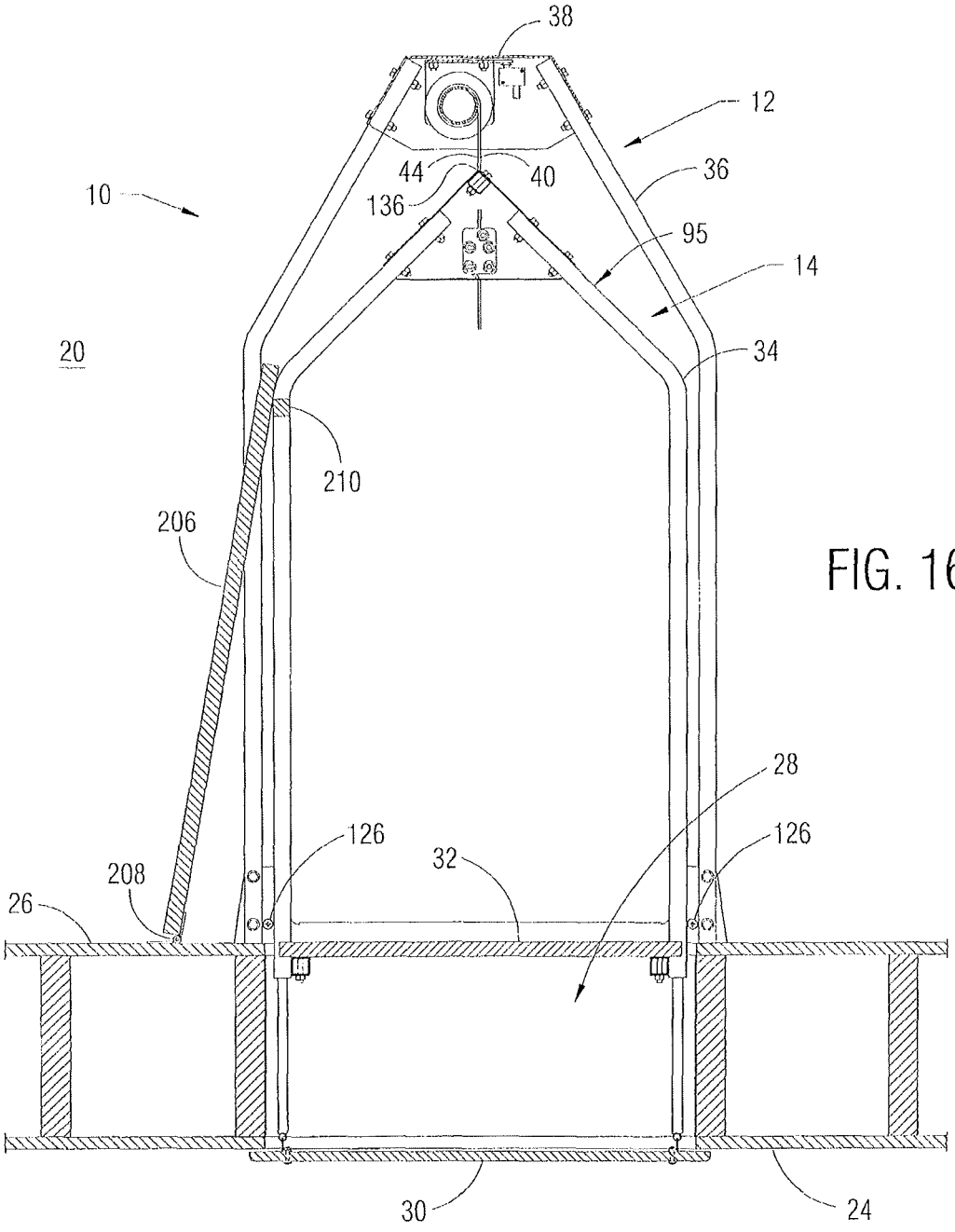
FIG. 16 shows an end view of a lifting system of the present invention which utilizes a portal closure door wherein the portal closure door is in a raised position.
Figure 17:
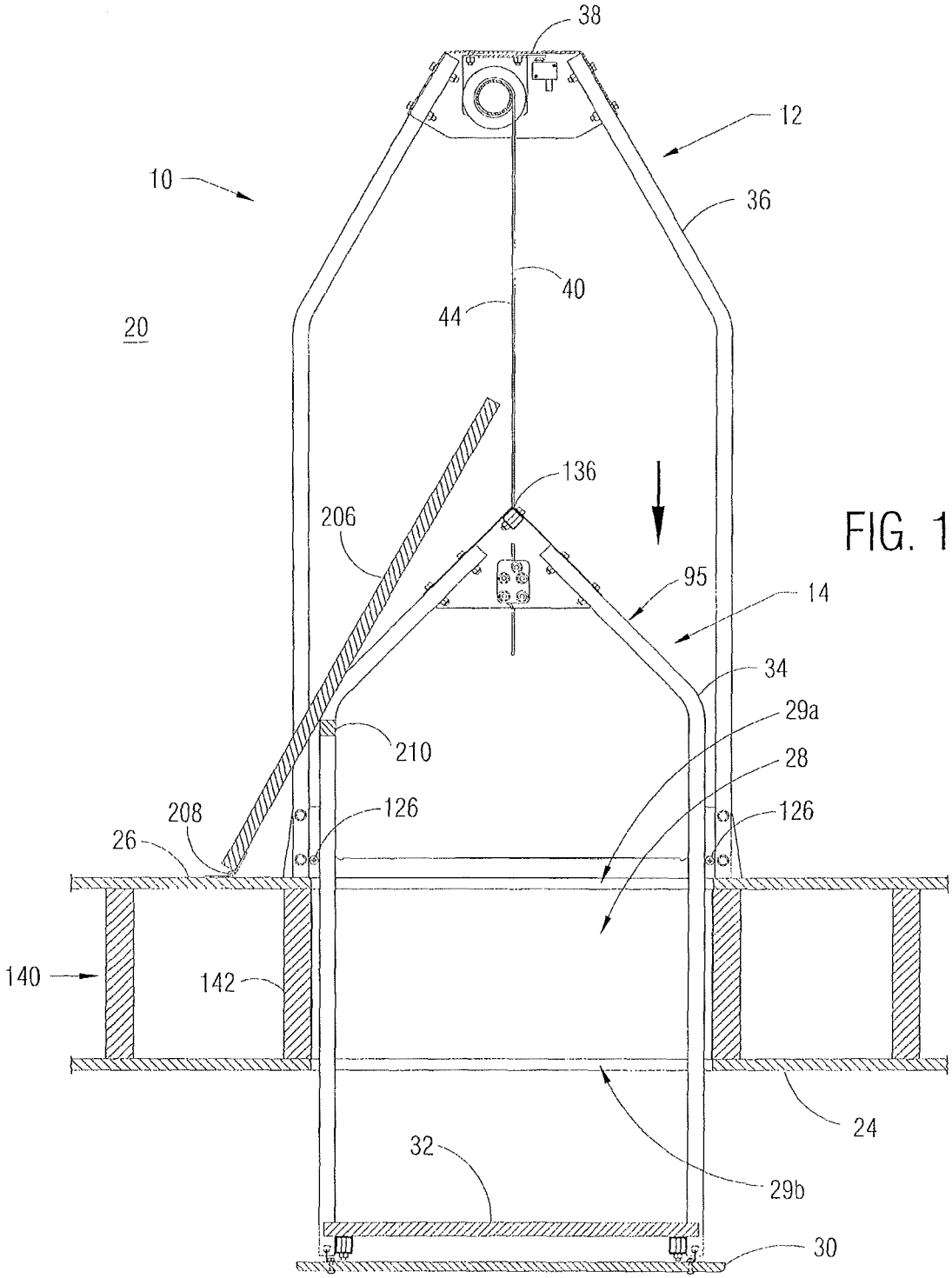
FIG. 17 is an end view of the embodiment of FIG. 16 wherein the portal closure door is in a partially lowered position.
Figure 18:
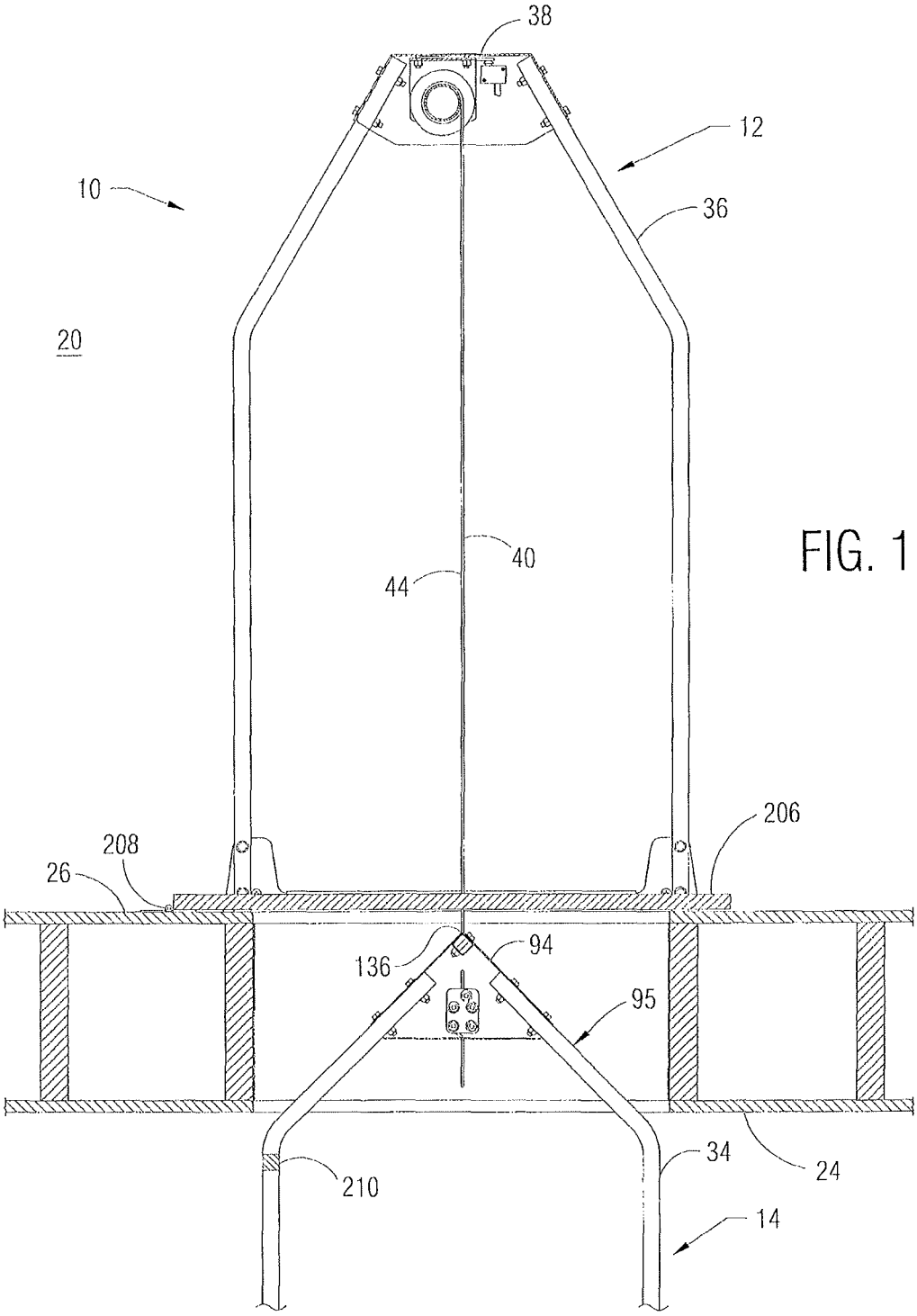
FIG. 18 is an end view of the embodiment of FIG. 16 wherein the portal closure door is in a fully lowered position and rests against an attic floor.

FIGS. 16-18 show an alternate embodiment of the present invention wherein lifting system 10 or any other lifting system contemplated herein is additionally equipped with a portal closure door 206. As noted above, lifting system 10 has a support and drive assembly 12 (having a support frame 36 and a drive assembly 38) and a platform assembly 14 having a closure platform 30, an lifting platform 32 and a platform frame 34. The portal closure door 206 is attached by a hinge 208 or other suitable movable attachment device to the attic floor 26 and is sized to substantially cover the upper entrance 29*a* of the portal 28. The platform frame 34 in one preferred embodiment has a horizontal bar 210 which extends between first leg 82 and first leg 82*a* of the platform frame 34. When the platform assembly 14 is in the raised position as shown in FIG. 16, the portal closure door 206 leans upwardly against the horizontal bar 210, such that the lifting platform 32 is exposed and available for use in the attic 20 in the manner described elsewhere herein. As the platform assembly 14 is lowered through and below the portal 28, the portal closure door 206 is lowered until it lays flat on the attic floor 26, substantially covering the upper entrance 29*a* of the portal 28 (FIGS. 17 and 18), thereby serving as a safety feature to prevent individuals in the attic 20 from stepping or falling accidentally into the portal 28, or preventing objects or small animals in the attic 20 from entering or falling into the portal 28, and additionally to provide a further insulative effect to minimize heat gain or heat loss from the attic 20 into the garage 18, or vice versa. It will be understood further that the portal closure door 206 may be raised and lowered by features other than the horizontal bar 210 on the platform frame 34, for example, the portal closure door 206 may be raised and lowered by a pulley system (not shown) which is activated as the platform assembly 14 is raised and lowered. Alternatively, the horizontal bar 210 may be absent and the portal closure door 206 may be raised and lowered by the edges of the first leg 82 and first leg 82*a* of the platform frame 34. The portal closure door 206 may be a feature of any of the lifting systems described or contemplated herein.

Figure 19A:
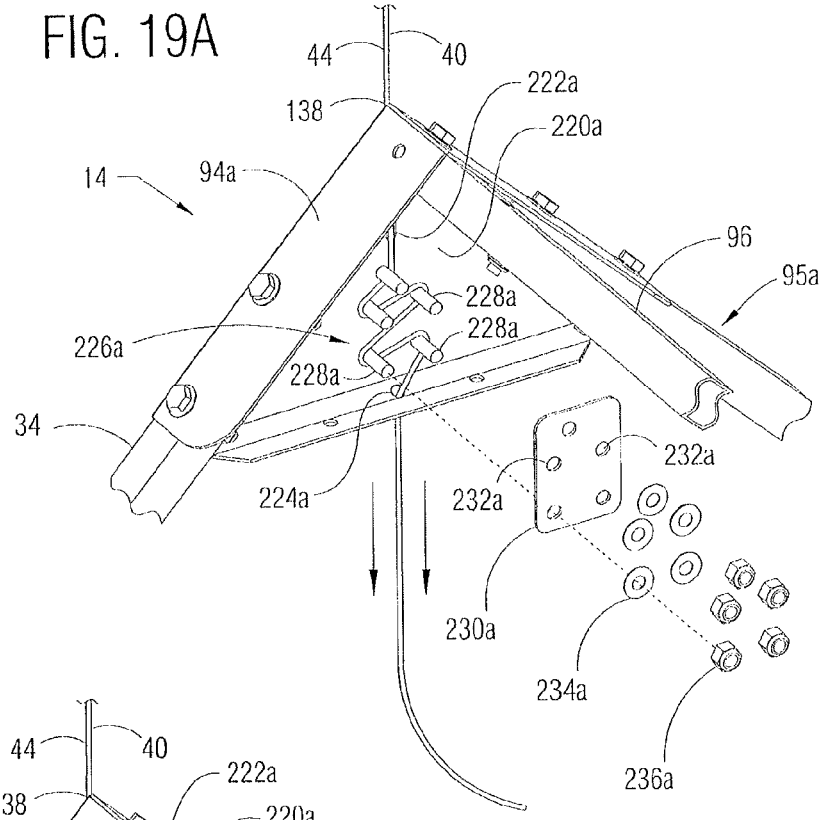
FIGS. 19A and 19B are fragmentary views of a cable clamping system of the present invention.
Figure 19B:
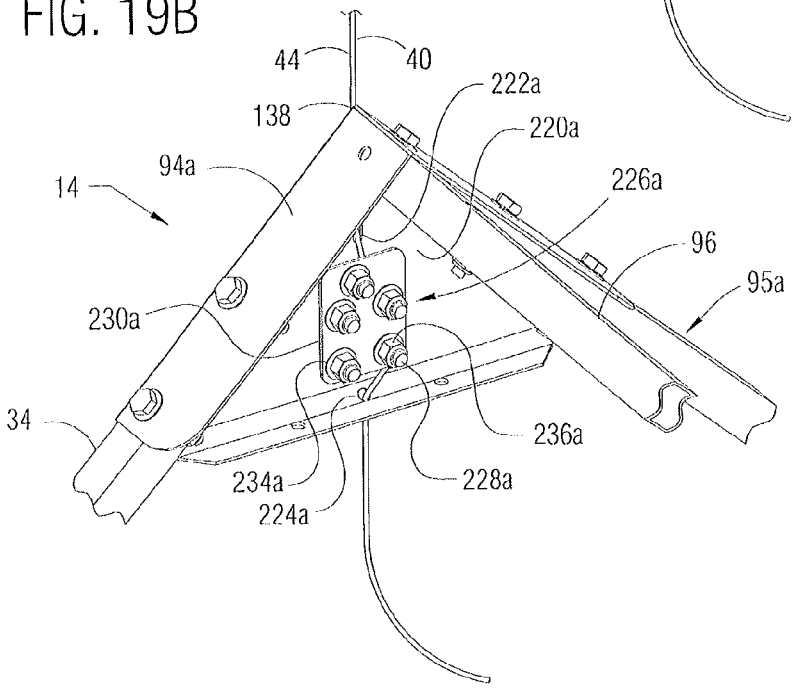

The novel manner of the attachment of the cable 40 to the platform frame 34 provides a number of benefits. As shown in FIG. 4, and in further detail in FIGS. 19A-19B, the cable 40 is attached via separate cable arms 42 and 44 thereof to the first side frame connector 94 and to the second side frame connector 94*a*, respectively. Referring to FIGS. 19A and 19B, the second side frame connector 94*a* has an inner surface 220*a*, an upper cable opening 222*a* and a lower cable opening 224*a*. The second side frame connector 94*a* further comprises a cable clamping system 226*a* secured to the inner surface 220*a*. Although not shown herein the first side frame connector 94 also has a cable clamping system exactly the same as cable clamping system 226*a*. The cable clamping system 226*a* is constructed of a plurality of posts or studs 228*a* which extend from the inner surface 220*a*. A pressure clamping plate 230*a* has a plurality of holes 232*a* therein which are positioned in complement with the pattern of posts 228*a* such that the pressure clamping plate 230*a* can fit over the posts 228*a* (as shown in FIG. 19B). When the posts 228*a* have threads, the pressure clamping plate 230*a* can be secured (bolted) to the inner surface 220*a* of the second side frame connector 94*a* with a plurality of washers 234*a* and lock nuts 236*a* in a conventional and well understood manner, as shown in FIG. 19B. When the posts 228*a* are not threaded the pressure clamping plate 230*a* may be secured to the second side frame connector 94*a* by other means known in the art, such as by screwing the pressure clamping plate 230*a* directly to the inner surface 220*a*.

The cable clamping system 226*a* functions to adjustably secure the cable arm 44 to the platform frame 14. The cable arm 44 inserted through the upper cable opening 222*a* and through the lower cable opening 224*a* and is threaded around and through the posts 228*a* such that the cable arm 44 is frictionally and non-slippingly secured by the plurality of posts 228*a* (FIG. 19A). The pressure clamping plate 230*a* is then secured against the portion of the cable arm 44 threaded among the posts 228*a* (FIG. 19B). In typical prior art systems, cables used for lifting have permanently swaged sleeves forming loops at each end and are not adjustable. It requires special tools to swage sleeves or lugs for lifting applications. Thus, in prior art systems the cable length cannot be adjusted without cutting and re-swagging the cable. In the present system, the length of cable arm 42 or 44 which is passed through the first or second side frame connector 94 or 94*a*, respectively, can be easily and readily adjusted with ordinary tools such as wrenches common to home owners. In another aspect of the invention, each cable arm 42 and 44 enters the upper cable opening 222*a* from the outside of the first or second side frame connector 94 and 94*a*, respectively. This is, each cable arm 42 and 44 is essentially outside of the platform frame 34 which prevents any edge of the platform frame 34 from becoming caught on a portion of the portal 28 such as the portal ceiling edge 29*c*, thus promoting the efficient movement of the platform frame 34 through the portal 28 as discussed in further detail below.

Figure 20:
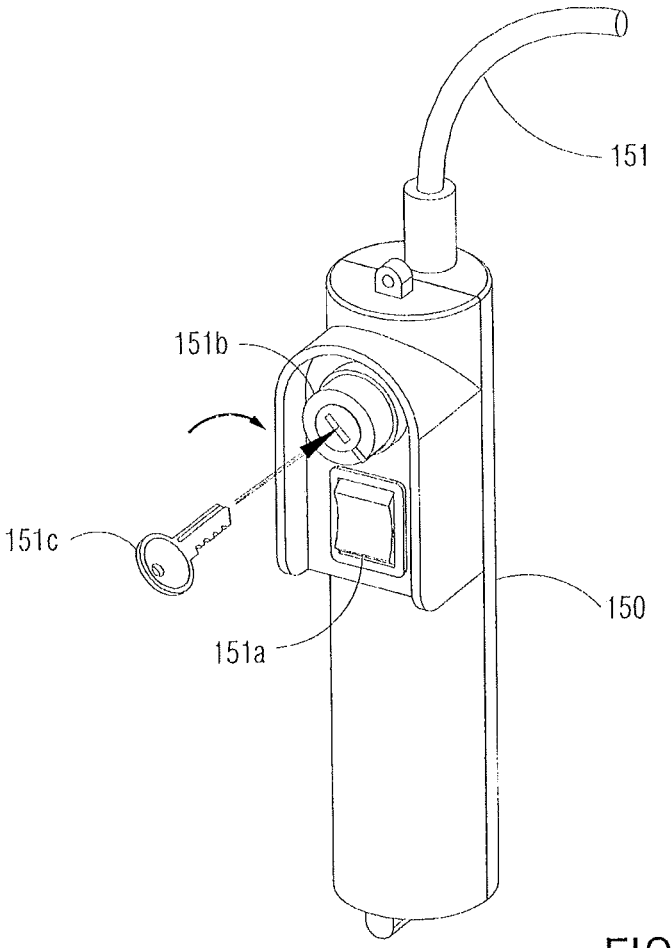
FIG. 20 is a perspective view of a control module of the present invention.

FIG. 20 shows the control module 150 which is, in a preferred embodiment, connected by a cord 151 to the drive mechanism 38 or winch motor 134. The cord 151 is preferably from 10 to 20 feet in length but may be any length suitable for a particular application. The control module 150 has a control module momentary switch 151*a* which immediately turns off and stops the winch motor 134 when the user's finger is removed from the control module momentary switch 151*a* thereby enhancing the safe use of the lifting and closure system claimed herein. Further, the control module 150 preferably includes a locking mechanism 151*b* for preventing unauthorized or accidental operation of the system, and which can be unlocked, for example with a key 151*c*.

Figure 22:
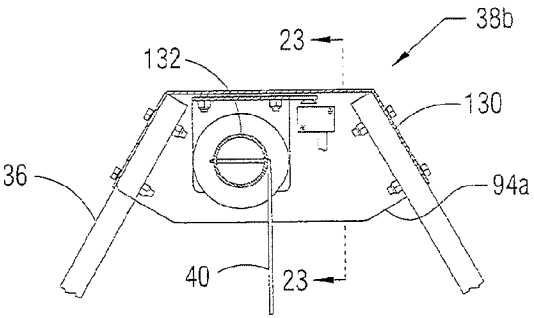
FIG. 22 is an end view of the drive assembly of FIG. 21.
Figure 23:
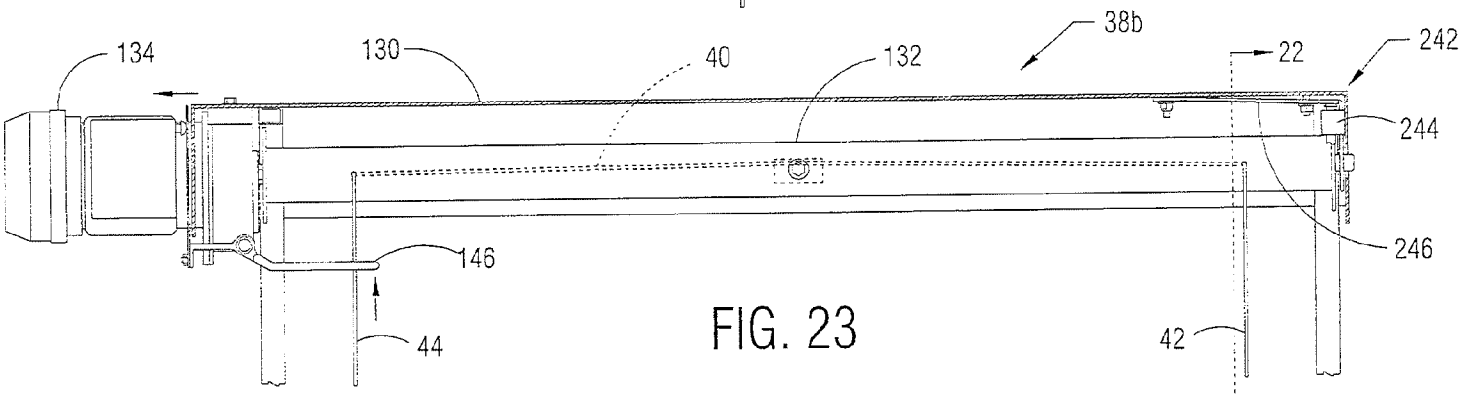
FIG. 23 is a side view taken through the drive assembly of FIG. 21.

Shown in FIG. 21 (and in side views in FIGS. 22-23) is a bottom perspective view of an embodiment of the drive mechanism designated by the reference numeral 38*b*. The drive mechanism 38*b* comprises, as for drive mechanism 38, a winch housing 130, a winch tube assembly 132, a winch motor 134, an upper limit switch lever 146 and a power cord 148 leading to a power source. Cable 40 is secured to the winch tube assembly 132 via a cable clamp assembly 240 attached to a medial portion of the cable 40 and first cable arm 42 and second cable arm 44 are passed through holes 241 in the winch tube assembly 132 and extend downwardly therefrom. The drive assembly 38*b* has a tension detection switch assembly 242 which causes the winch tube assembly 132 to stop paying out cable automatically when the weight (tension) of the platform assembly 14 is removed from the cable arm 42. The tension detection switch assembly 242 comprises a momentary switch 244 and a spring bracket 246 which is attached to the winch housing 130 and to the winch tube assembly 132. The spring bracket 246 is upwardly biased and supports the end of the winch tube assembly 132.

The tension detection switch assembly 242 serves a plurality of functions which enhance the safe and dependable operation of the present invention. A first function is to limit the downward travel of the platform assembly 14, stopping the drive mechanism 38 instantly when the platform assembly 14 comes to rest on the garage floor 22. A second function provided is to sense if the lifting platform 32 and the cargo item 46 thereon becomes lodged in the portal 28 while descending thereby stopping the drive mechanism 38 instantly upon sensing this condition. A third function provided is to sense a jammed or fouled condition of the cable arm 44 while descending which produces slack in cable arm 42, and thereupon stopping the drive mechanism 38 instantly upon sensing this condition. A fourth function provided is to instantly stop the drive mechanism 38 upon the breakage or disconnect of cable arm 42 while descending.

When the winch tube assembly 132 is weighted by the cable arm 42 and the platform assembly 14, the spring bracket 246 depresses the momentary switch 244 and enabling the downward motor circuit and the winch motor 134 can be downwardly actuated with the control module switch 151*a* causing the winch tube assembly 132 to lower the cable arm 42. When the weight of the cable arm 42 is released from the winch tube assembly 132, for example when the platform assembly 14 rests on a floor, or when the opposing cable arm 44 is jammed or caught or otherwise ceases being spooled out, the winch tube assembly 132 becomes unweighted via the cable arm 42 whereupon the momentary switch 244 opens the downward motor circuit and the winch motor 134 is automatically and immediately stopped causing cessation of movement of the platform assembly 14 and of the cable arm 42 wherein the cable arm 42 does not continue to spool out, even when the control module switch 151*a* continues to be depressed for downward travel. This prevents the cable arm 42 from becoming tangled or fouled which could require repair. This system enables the cable arm 42 to be stopped without requiring the control module momentary switch 151*a* to be released at the exact instant that the platform assembly 14 reaches the floor. Further, since the tension detection switch assembly 242 is contained entirely within the drive assembly 38*b*, and not upon some element of the platform assembly 14, the tension detection switch assembly 242 can be preset, for example at the factory, for reliable operation without user intervention or requiring a trained installer. The lifting system 10 (or any other lifting system contemplated herein) will stop immediately if the platform assembly 14 becomes lodged in the portal 28 when traveling downward. This is a vital safety issue. If the platform assembly 14 becomes lodged while the cable 40 continues to pay out, at least one cable arm would accumulate slack, possibly becoming fouled or jammed. Then if the platform assembly 14 were to suddenly dislodge while the cable arm was slack, it could free-fall some distance from the portal 28 possibly spilling the cargo item 46 or even breaking the cable 40. This event could cause costly damage and possible serious personal injury. In the present invention, since the tension detection switch assembly 242 causes cable movement to cease immediately, the movement of the platform assembly 14 will cease immediately, thus the platform assembly 14 will resist spilling the cargo item 46 from the lifting platform 32.

Figure 24:
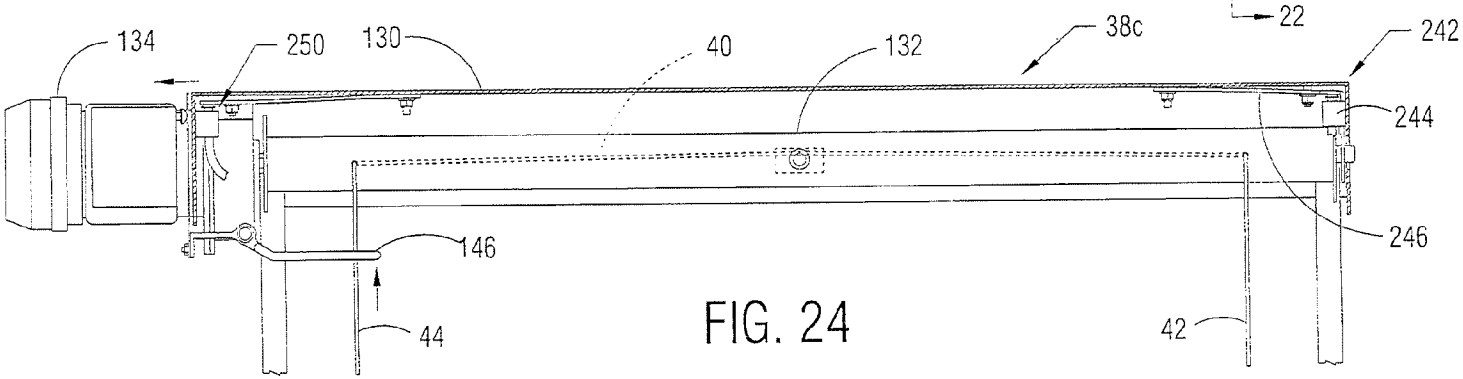
FIG. 24 is a side view of an alternate embodiment of the drive assembly of the present invention.

Shown in FIG. 24 is an alternate version of a drive mechanism of the present invention designated by the general reference numeral 38*c* which not only has tension detection switch assembly 242 for detecting when weight is released from cable arm 42, but also has a second tension detection switch assembly 250 at the opposing end of the winch tube assembly 132 and which functions to stop movement of the drive assembly 38*b* when weight is released from cable arm 44 in a manner similar to the operation of tension detection switch assembly 242. The drive assembly of the present invention may be constructed without a tension detection switch assembly, with only a single tension detection switch assembly, or with a pair of tension detection switch assemblies.

Figure 25:
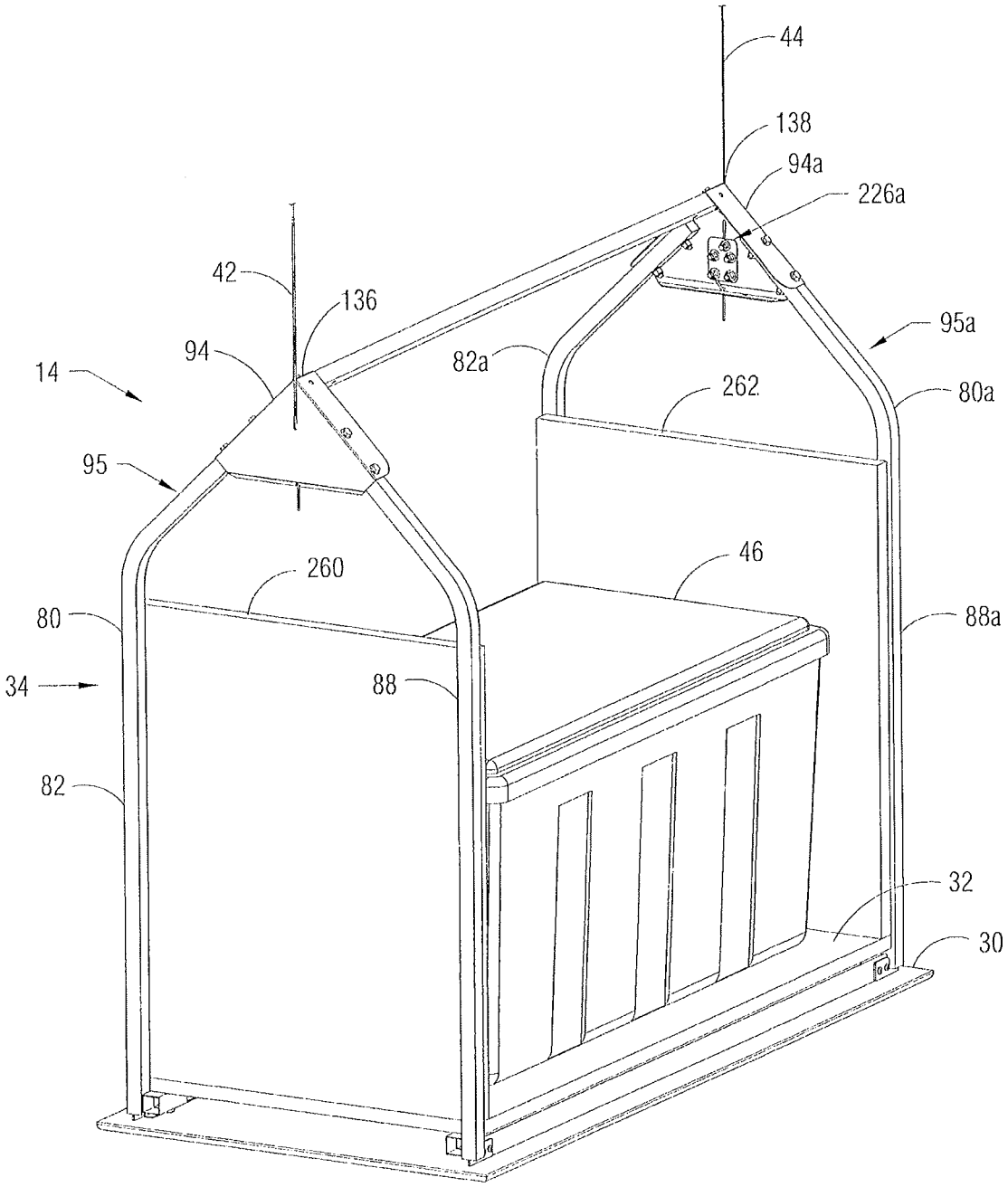
FIG. 25 is a perspective view of a platform assembly of the present invention which has sidewalls.

In an alternate embodiment of the invention as shown in FIG. 25, the platform assembly 14 may be modified with the addition of a first sidewall 260 and a second sidewall 262. The first sidewall 260 is attached to an inwardly facing surface of first side frame 80 and second sidewall 262 is attached to an inwardly facing surface of second side frame 80*a* by screws, bolts, clips, adhesives, cements, wire, or any other appropriate fastening means known to a person of ordinary skill in the art. The first and second sidewalls 260 and 262 may be attached to outwardly facing surfaces of the first and second end frames 80 and 80*a*, respectively, as well. The sidewalls 260 and 262 are shown in FIG. 25 as extending entirely from near the lifting platform 32 to near a point of angular change of each of legs 82 and 88 of first end frame 80 and each of legs 82*a* and 88*a* of second end frame 80*a*, respectively. The size of the sidewalls 260 and 262 is not limited to the size shown in FIG. 25 however and may in fact be a lesser size, or even may be larger.

Figure 26:
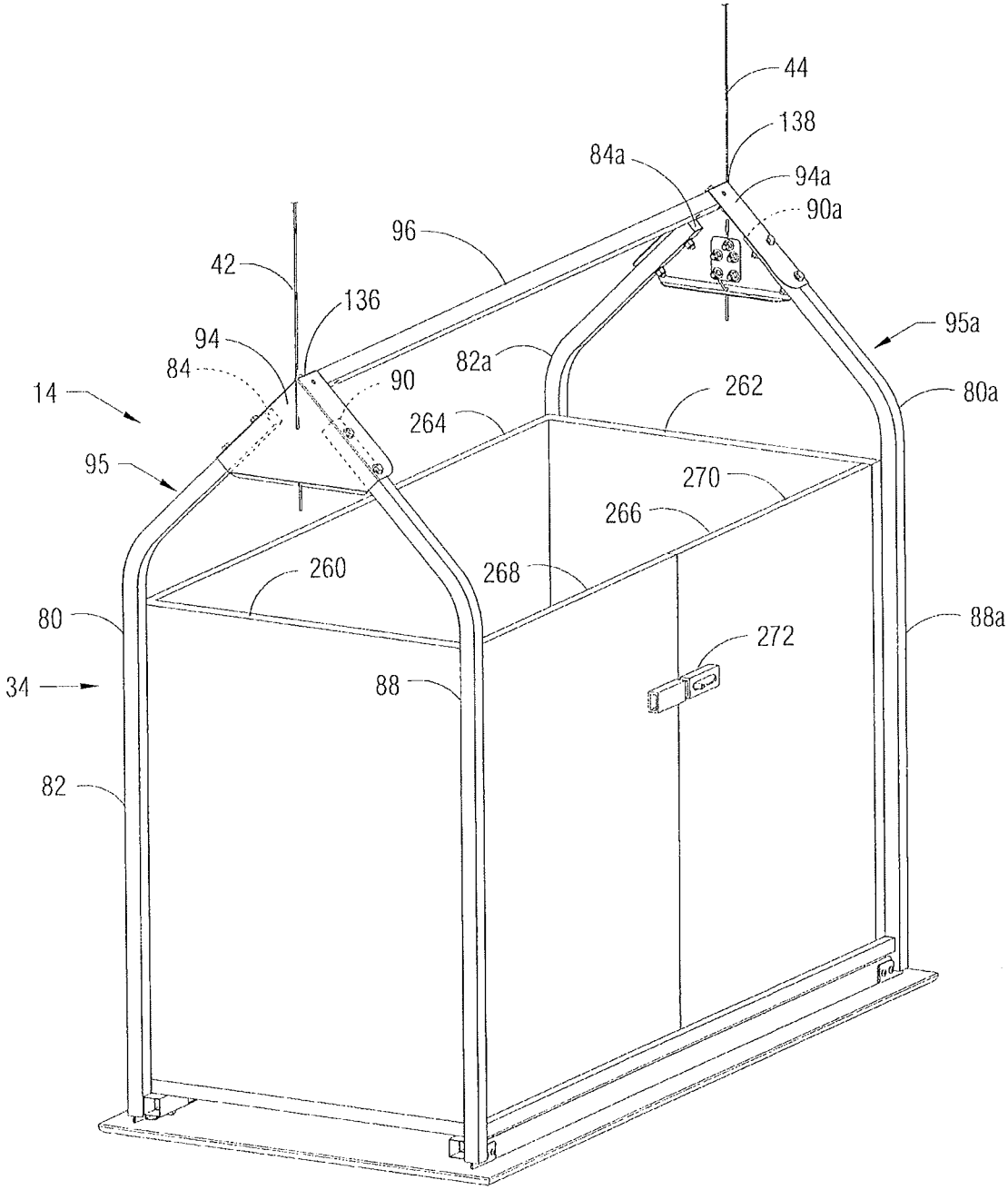
FIG. 26 is a perspective view of a platform assembly of the present invention having sidewalls, a back wall and a front door assembly.

Alternatively, the platform assembly 14 of the embodiment of FIG. 25 may be further equipped with a backwall 264, and a front door assembly 266, as shown in FIG. 26. The backwall 264 is constructed in a manner similar to that of sidewalls 260 and 262 except the backwall 264 extends between first leg 82 of the first end frame 80 and first leg 82*a* of the second end frame 80*a*. The front door assembly 266 comprises a first hinged door 268 and a second hinged door 270 which both can be opened outwardly for unloading or loading cargo items 46 onto the lifting platform 32. The first and second hinged doors 268 and 270 can be securely closed via door closure device 272. Such door closure devices are well known to those of ordinary skill in the art. Optionally, the backwall 264 may be constructed to have a pair of opening doors in a manner similar to that of front door assembly 266. Alternatively, the platform assembly 14 may be constructed only with sidewalls 260 and 262, and with backwall 264, and without a front door assembly 266.

Figure 27:
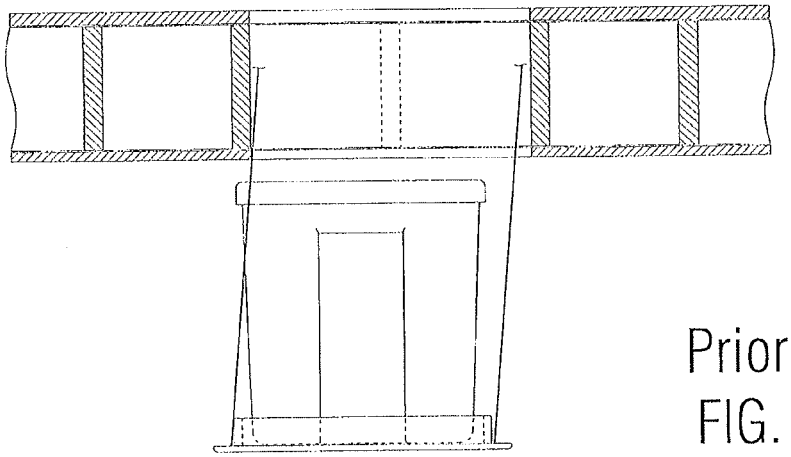
Prior Art FIG. 27
FIG. 27 is an isometric view of a prior art lifting system in a swaying condition.
Figure 28:
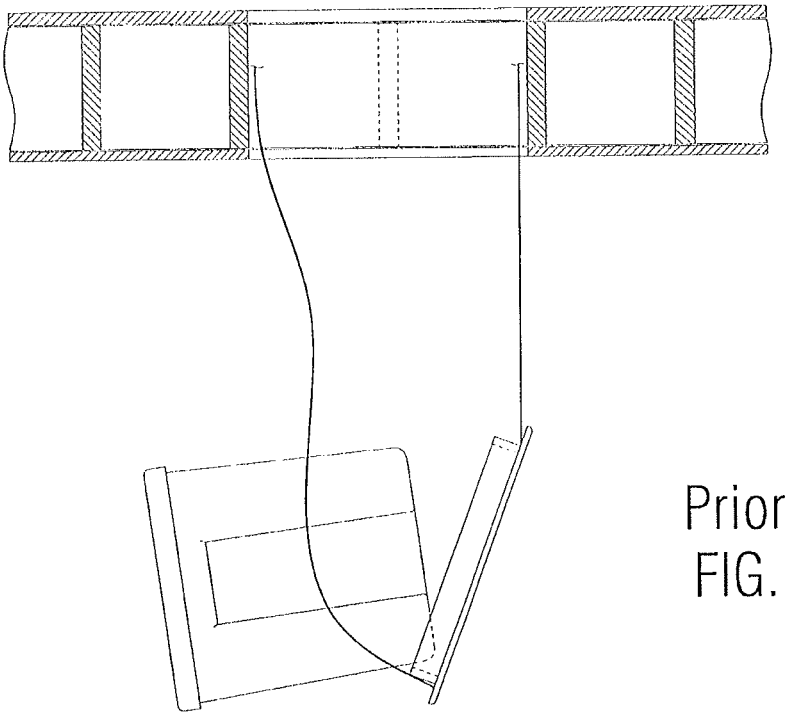
Prior Art FIG. 28
FIG. 28 is an isometric view of a prior art lifting system in a tilted condition.

As noted above, certain prior art lifting systems propose controlling the lifting platform using only cables to provide support and stability. This arrangement will support vertical loads but lacks dynamic stability. In such systems, the cables attach at or near the platform and therefore the cable attachment points are always below the center of gravity of any load placed on the platform as shown, for example in FIG. 27. It is easy to see that any large load would inherently become unstable if the platform tipped due to an obstruction or any fouling or jamming of one of the supporting cables. Once the platform and load become unbalanced, the platform can flip completely over, dumping the load, e.g., as shown in FIG. 28. This is because cables or tethers can resist downward forces but cannot resist the upward forces created by an unbalanced platform. In addition to the balance problem, supporting the platform directly with four cable attachment points as taught in the prior art, leaves another important safety problem unsolved. The cables naturally allow some swaying of the lifting platform as it moves upward (see FIG. 27). When the platform carries a load that approaches the maximum load dimensions, then any swaying of the upwardly moving platform can allow misalignment between the load and the ceiling opening. When this occurs, the load and platform can become jammed as shown in FIG. 27 or the load spilled as exemplified in FIG. 28. Further, as depicted in FIG. 28, if one of the cables in a prior art system becomes fouled, tangled, or jammed while the 4-cable platform is being lowered, then the one corner supported by the fouled, tangled or jammed cable would be halted while the other corners would continue to proceed downward causing the lifting platform to progressively tilt to a substantially vertical orientation, spilling the cargo.

The configuration of the platform assembly 14 of the present invention solves the instability problems associated with the prior art, and solves the problems of swaying which occur when the loading platform of the prior art is raised, and solves the problems which occur in prior art systems due to the center of gravity of the load being above the point of attachment of the cables (i.e., the "top heaviness"). The present invention provides a platform frame 14 that not only protects and guides the load through the portal 28, but also provides cable attachment points well above the center of gravity of any load, creating an extremely stable platform that substantially resists tipping over and spilling the load.

Figure 30:
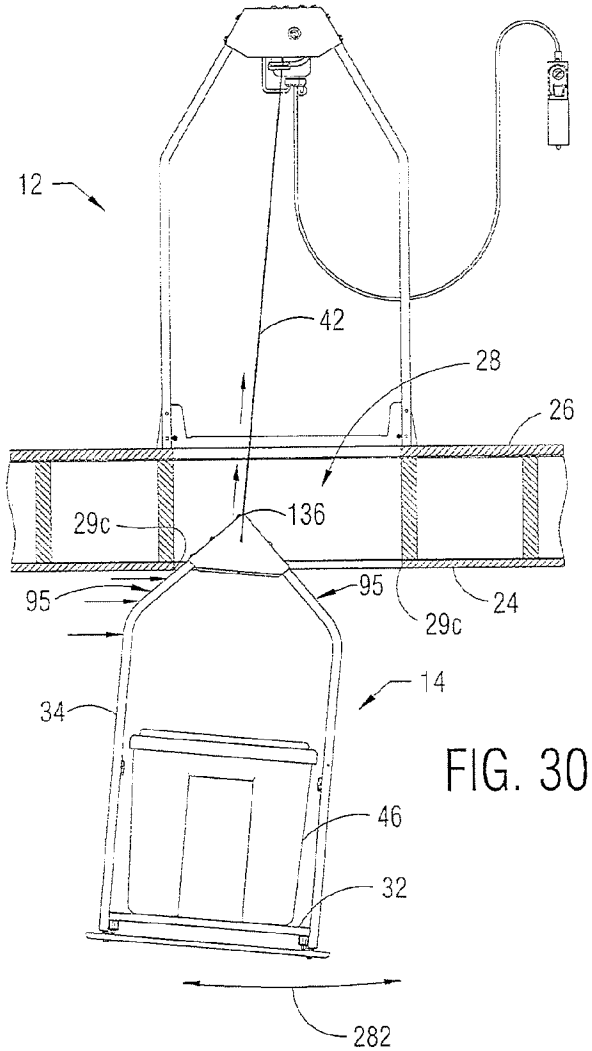
FIG. 30 is a side view of the lifting system of the present invention showing the platform assembly swaying side to side.
Figure 29:
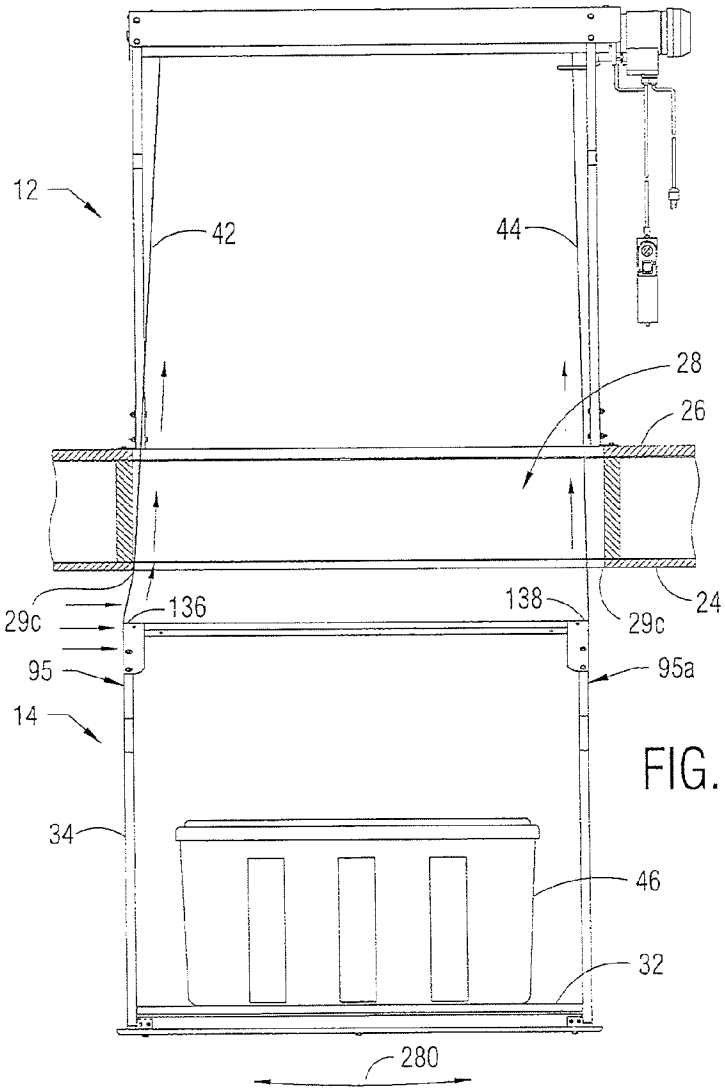
FIG. 29 is a side view of the lifting system of the present invention showing the platform assembly swaying end to end.

As shown in FIG. 29, in some instances, when the platform assembly 14 is raised toward the portal 28, the platform assembly 14 will begin to sway in an end-to-end direction 280. In such an instance, as the platform assembly 14 is raised, the cable arm 42 (or 44) will tend to engage the portal ceiling edge 29*c* and will self-align and guide the platform frame 34 into the portal 28, thereby overcoming the tendency of the platform frame 34 to be caught at the portal ceiling edge 29*c*. Similarly, as shown in FIG. 30, as the platform assembly 14 is raised, it may begin to sway in a side-by-side direction 282. In such an instance, the slanted portion 95 of the platform frame 34 will engage the portal ceiling edge 29*c* at the lower entrance 29*b* and will cause the platform frame 34 to become aligned with and guided into the portal 28, thereby overcoming the tendency of the platform frame 34 to be caught at the portal ceiling edge 29*c*. Recalling FIG. 27, which shows a cargo item on a prior art system about to become caught on a portal ceiling edge, it is clear how the configuration of the platform frame 34 of the present invention solves this problem of swaying and misalignment by the platform. This configuration of the lifting and closure system of the present invention eliminates the need for costly, complicated roller guide tracks, telescoping columns, rails and the like while maintaining substantially all of the benefits of stability and guidance normally provided by these devices. This is accomplished with a novel platform frame structure that substantially improves stability of the loaded platform while automatically correcting misalignment between the loaded platform and the portal while reliably guiding the platform assembly safely into the opening.

Figure 31:
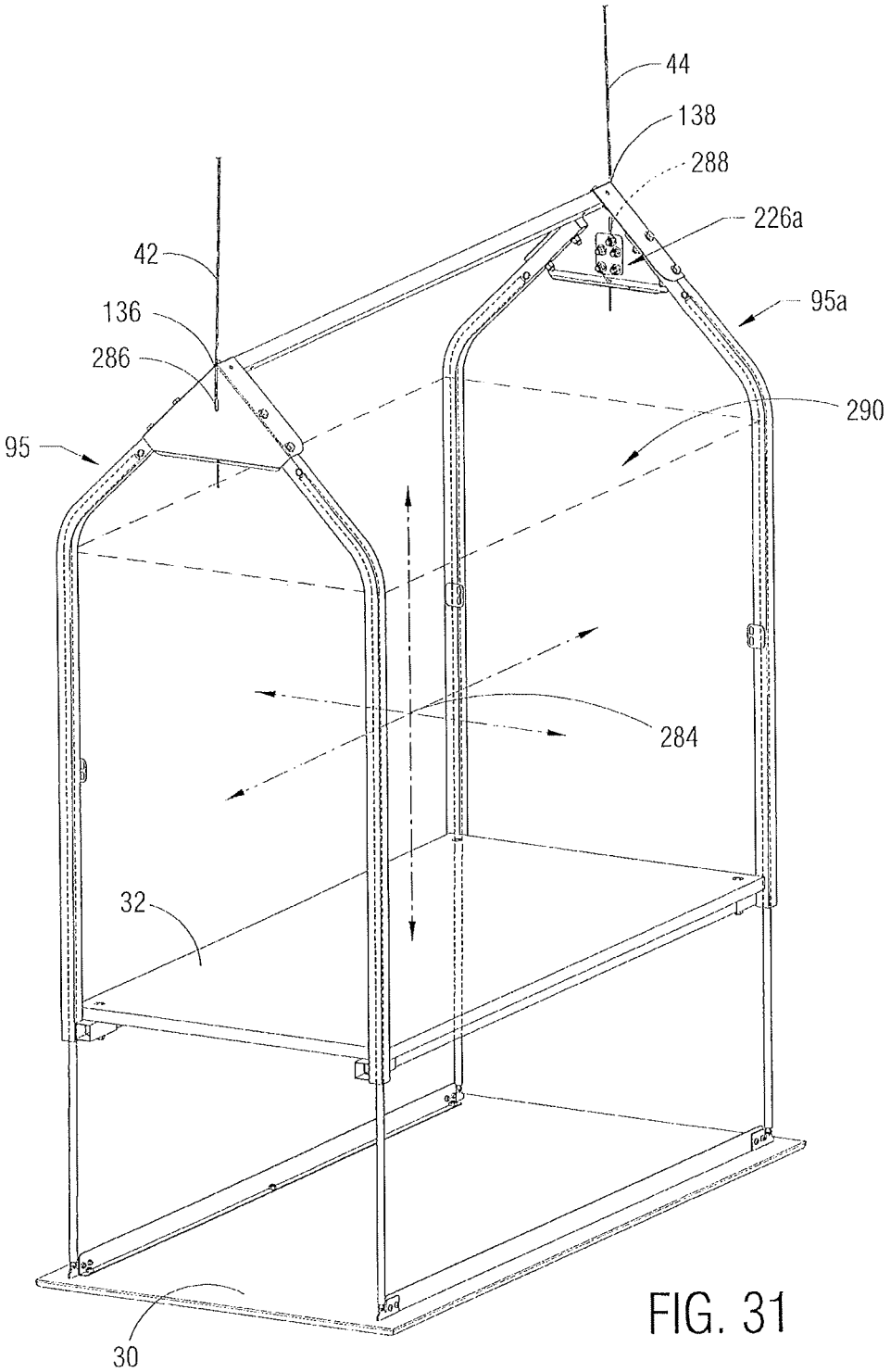
FIG. 31 is a perspective view of a platform assembly of the present invention indicating the cargo maximum center of gravity in relation to the points of attachment of the cable arms.

As noted above, and as graphically demonstrated in FIG. 31, the platform assembly 14 and platform frame 34 of the present invention places a maximum center of gravity 284 of the cargo item 46 well below attachment points 286 and 288 of the cable arms 42 and 44. As demonstrated in FIG. 31, this configuration substantially stabilizes the cargo item 46 and prevents the lifting platform 32 and platform frame 34 from imbalance, even when one cable arm 42 or 44 becomes jammed and the other cable arm is completely slack. The platform frame 34 defines a cargo space (cargo volume) 290, preventing impact between the cargo item 46 and the portal ceiling edge 29*c*, so long as the cargo item 46 is within the defined cargo space 290.

Figure 32:
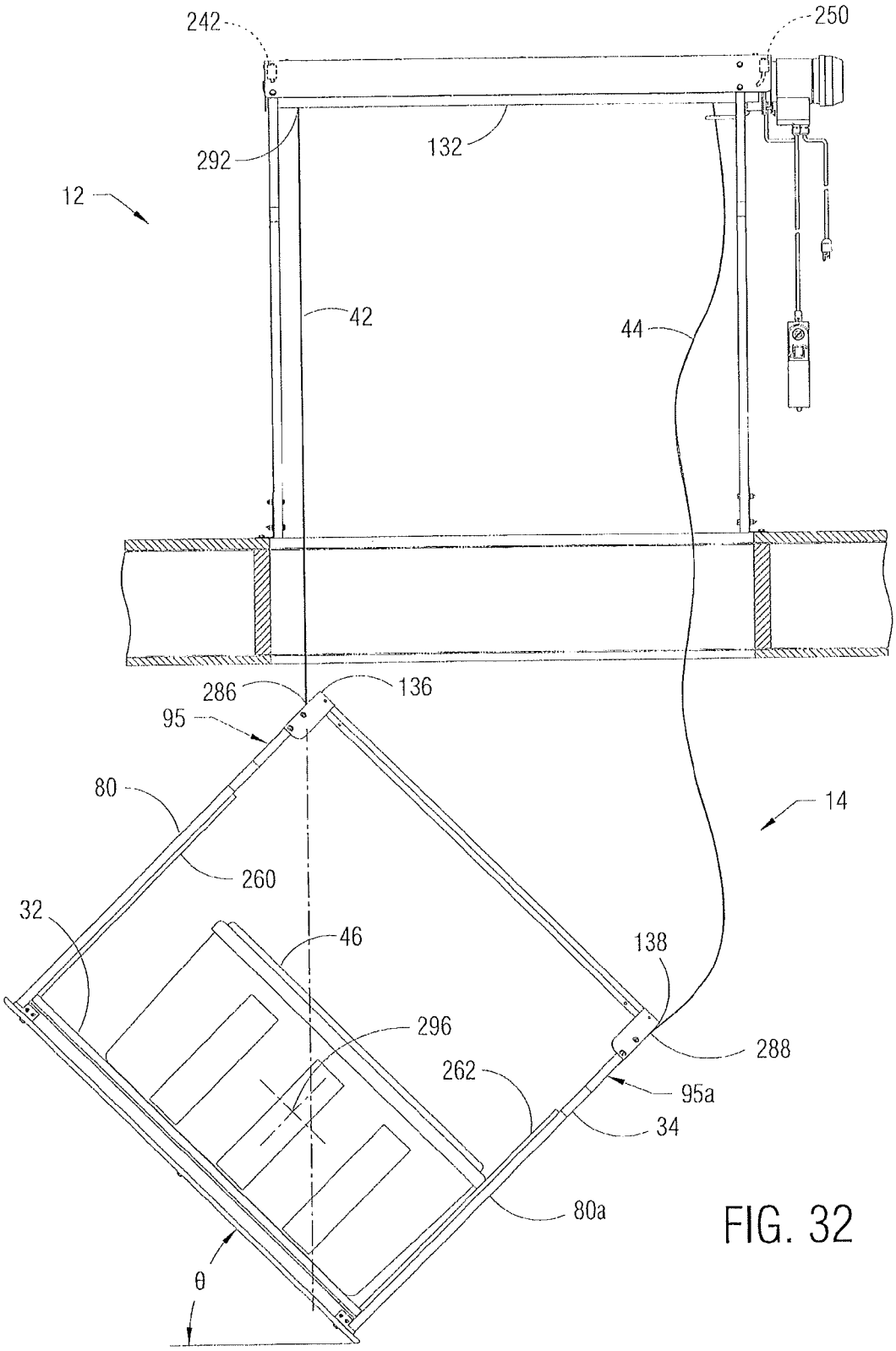
FIG. 32 is a side view of the present invention showing the platform assembly in an unbalanced state, hanging by a single cable arm.
Figure 33:
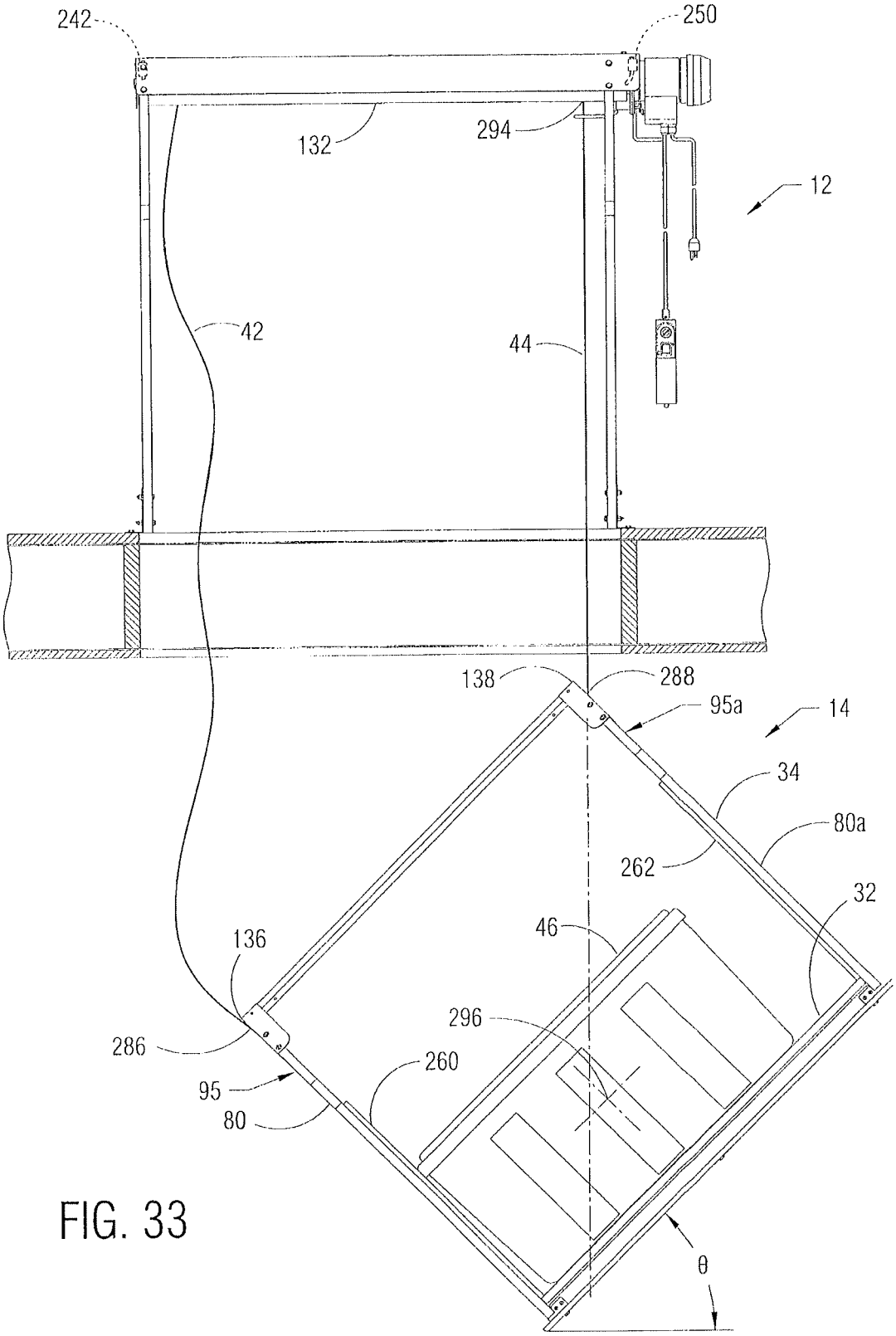
FIG. 33 is a side view of the present invention showing the platform assembly in an unbalanced state, hanging by the alternate cable arm.

As described above, the present invention has significant advantages, particularly regarding preventing tipping or spillage of the cargo item 46 from the lifting platform 32 in the event of a malfunction of the cable 40 or support and drive assembly 12. FIGS. 32 and 33 show situations in which one cable arm becomes jammed or caught while a second cable arm continues to spool out. For example, in FIG. 32 the cable arm 42 is shown jamming at point 292 on the winch tube assembly 132 wherein the cable arm 44 has continued to spool out, causing the platform frame 34 to tilt downwardly toward second side frame 80*a* and causing the cargo item 46 to slide downwardly and be arrested by second sidewall 262 thereby preventing it from spilling from the lifting platform 32. Slack in the cable arm 44 is detected by the second tension detection switch assembly 250, thereby automatically stopping the drive mechanism 38. As indicated in the figure, center of gravity 296 of cargo item 46 is well below the cable attachment point 286 and the platform frame 14 hangs at an angle θ of about 45 degrees to the floor.

Similarly, as shown in FIG. 33, the cable arm 44 is shown jamming at point 294 on the winch tube assembly 132 wherein the cable arm 42 has continued to spool out, causing the platform frame 34 to tilt downwardly toward first end frame 80 and causing the cargo item 46 to slide downwardly and be arrested by first sidewall 260 preventing it from spilling from the lifting platform 32. Slack in the cable arm 42 is detected by the first tension detection switch assembly 242 thereby automatically stopping the drive mechanism 38. As indicated in the figure, center of gravity 296 of cargo item 46 is well below the cable attachment point 288 and the platform frame 14 hangs at an angle θ of about 45 degrees to the floor.

Figure 34:
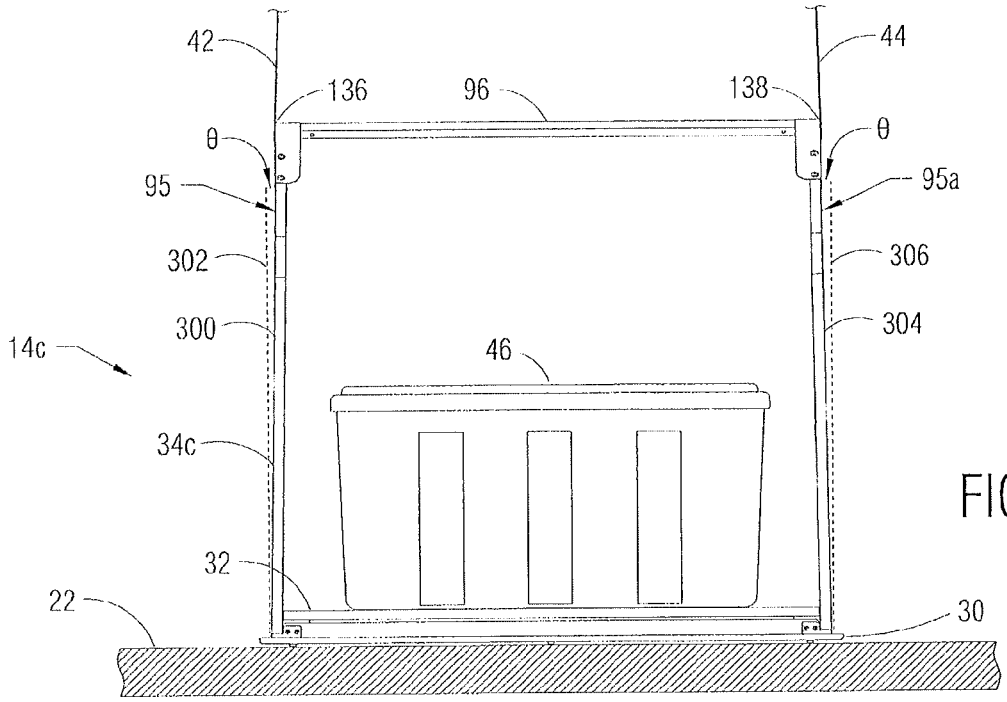
FIG. 34 is a side view of an alternate embodiment of the platform frame of the present invention.

Shown in FIG. 34 and designated therein by reference numeral 14*c* is an alternate version of a platform assembly of the present invention. Platform assembly 14*c* comprises a platform frame 34*c* which is the same in all regards to the other platform frames contemplated herein except that platform frame 34*c* comprises a first end frame 300 which is slanted at an angle θ inwardly (toward the cargo area) from a vertical axis 302, and a second end frame 304 which is slanted at angle θ inwardly (toward the cargo area) from a vertical axis 306. Angle θ is preferably from 0° to 30°, more preferably from 1° to 25°, though may be greater than 30°.

Figure 35:
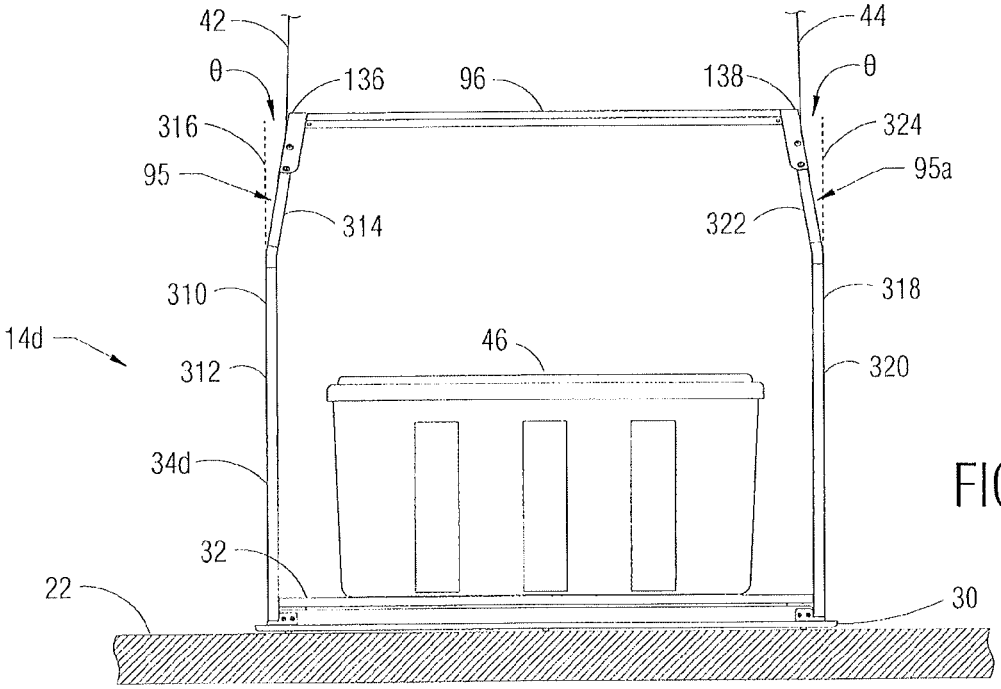
FIG. 35 is a side view of an alternate embodiment of the platform frame of the present invention.

Shown in FIG. 35 and designated therein by reference numeral 14*d* is an alternate version of a platform assembly of the present invention. Platform assembly 14*d* comprises a platform frame 34*d* which is the same in all regards to the other platform frames contemplated herein except that platform frame 34*d* comprises a first end frame 310 having a lower portion 312 which is substantially vertical and an upper portion 314 which is slanted at an angle 0 inwardly (toward the cargo area) from a vertical axis 316. Platform frame 34*d* further comprises a second end frame 318 having a lower portion 320 which is substantially vertical and an upper portion 322 which is slanted at angle θ inwardly from a vertical axis 324. Angle θ is preferably 0° to 30°, more preferably from 1° to 25°, but may be greater than 30°.

The slanted configurations of platform frames 34*c* and 34*d* enhance the ability of the platform assemblies 14*c* and 14*d*, respectively, to be guided into the portal 28 without rubbing or becoming caught against any portion of portal 28, thereby enhancing the safety and ease of use of the lifting system as constructed with either of platform assemblies 14*c* or 14*d*.

It will now be appreciated that the various embodiments discussed herein (and other versions easily contemplated by persons of ordinary skill in the art) regarding the lifting systems of the present invention offer several advantages over the prior art. The novel configurations of the platform frames and support frames advantageously provide greater platform stability and effectively align and guide the lifting platforms through the portal in the attic floor. The novel closure platform of some embodiments advantageously operates to provide a ceiling cover to close the lower opening of the portal in the ceiling while still facilitating any number of desired final elevational placements of the lifting platform in its uppermost position, including level with or slightly above the adjacent attic floor. The lifting system of the present invention is also inexpensive, reliable and easy to install. In view of the foregoing, preferred embodiments of the present invention can be characterized without limitation as a method and apparatus for manipulating the elevational height of an object such as a cargo item. In accordance with preferred embodiments, such as described below, the lifting systems described herein are constructed to have a stationary support and drive assembly and movable platform assembly as contemplated herein.

In one preferred embodiment, the invention is a lifting and closure system, comprising a platform assembly comprising a lifting platform, a closure platform positioned below and facing the lifting platform, and a biasing mechanism attached to the closure platform for urging the closure platform toward the lifting platform, and a support and drive assembly positioned on a support structure, the support structure having an upper surface, a lower surface and a portal, the support and drive assembly positioned above the platform assembly and operatively connected to the platform assembly for raising the platform assembly into the portal, the portal having an upper entrance extending through the upper surface of the support structure, and a lower entrance extending through the lower surface of the support structure in a position below the upper entrance, and wherein the portal has a portal depth comprising a distance between the upper surface and the lower surface of the support structure, and wherein when the platform assembly is raised into the portal, the closure platform engages and is urged against the lower surface of the support structure by the biasing mechanism causing the closure platform to cover the lower entrance of the portal, and wherein the biasing mechanism is self-adjustable to enable the closure platform to be positioned a variable distance from the lifting platform for adjusting to differences in portal depths among different support structures.

In this embodiment, the platform assembly is operatively connected to the support and drive assembly, for example by a tether system. The lifting and closure system may further comprise a portal closure door for closing the upper entrance of the portal when the platform assembly is in a lowered position. The support and drive assembly may comprise a drive mechanism for raising and lowering the platform assembly and a support frame for supporting the drive mechanism. The platform assembly may comprise a platform frame for supporting the lifting platform and closure platform, the platform frame connected to the support and drive assembly, and wherein the lifting platform is secured to the platform frame. The biasing mechanism may be connected to the platform frame and to the closure platform, thereby connecting the closure platform to the platform frame. The biasing mechanism may be connected to the lifting platform and to the closure platform, thereby connecting the closure platform to the lifting platform. The biasing mechanism may comprise at least one pair of springs. The at least one pair of springs may comprise coiled tension springs. The at least one pair of springs may comprise constant force springs. The biasing mechanism may comprise two pairs of springs. The platform frame may comprise two pairs of legs having lower ends, each pair of legs having an upper end, wherein the lifting platform is attached near the lower ends of the two pairs of legs. The platform assembly may be attached to the support and drive assembly via a tether system attached to the upper ends of the two pairs of legs of the platform frame. Each leg of each pair of legs may have a lower vertical portion and an upper slanted portion wherein the upper slanted portions of each leg terminate at the upper end of the pair of legs. The tether system may be adjustably connected to the platform assembly at attachment points on the platform assembly such that the positions of attachment of the tether to the platform assembly are adjustable without affecting the length of the tether system. The lifting and closure system may comprise a tension detection switch positioned within the drive mechanism for immediately stopping the motion of the drive mechanism upon detection of a reduction in tension on at least one tether arm of the tether system. The tension detection switch may have a pre-set setting for detecting the reduction in tension. The platform assembly may further comprise one or more barriers for constricting movement of a cargo item on the lifting platform. The barrier may be a wall, a chain, a rope, a web, a net, a cable, a brace, a band, a bar, and combinations thereof. When a cargo item having a center of gravity is placed on the lifting platform of the platform assembly, the center of gravity of the cargo item is preferably below the point of operative connection between the support and drive assembly and the platform assembly.

The platform assembly may comprise a platform frame supportingly connected to the lifting platform which is substantially horizontal, and having a first end and a second end opposite the first end, said platform frame having a first end frame connected to the platform first end, and a second end frame opposite the first end frame and connected to the platform second end, each first end frame and second end frame having a width at least as wide as the first end and second end, respectively, of the lifting platform, wherein the first end frame and the second end frame each extend upwardly from the lifting platform, and the first end frame and second end frame defining a cargo space therebetween, and each first and second end frame having an inner side facing toward the other and each first end frame and second end frame having an outer side facing away from the other, and each first end frame and second end frame having a first side and a second side of substantially equal length and extending upwardly from the lifting platform for a lower portion of their length and converge toward each other for an upper portion of their length thereby forming a first side converging portion of the first end frame, the first side converging portion having an upper end forming a first end frame apex and a second end converging portion of the second end frame, the second side converging portion having an upper end forming a second end frame apex.

The support and drive assembly may be operatively connected to the platform assembly by at least two tethers, each of which is attached to the platform frame through an outer opening in the opposite outer side of each first end frame and second end frame at a point at or below the first frame apex and second frame apex, respectively, and the at least two tethers fastened securely within the platform frame for the purpose of raising the platform assembly and any cargo placed on the lifting platform into the portal, the portal having an upper entrance extending through the upper surface of the support structure, and a lower entrance extending through the lower surface of the support structure in a position below the upper entrance, and wherein the portal has a portal depth comprising a distance between the upper surface and the lower surface of the support structure, and wherein when the platform assembly is raised to the portal, the first frame apex of the first end frame and the second frame apex of the second end frame are drawn and guided into the portal lower entrance by the at least two tethers which extend from the outer sides of the first and second end frames of the platform frame and which thereby inhibit the first and second frame apexes from impacting the lower portal entrance as they are drawn in by the at least two tethers, and wherein as the platform assembly advances upward into the portal, the first side converging portion and the second side converging portion of each first end frame and second end frame can engage a portion of the lower portal entrance to progressively urge the platform frame into a proper alignment for entering the portal as the platform frame is drawn upwardly into the portal thereby preventing contact between a portal edge and the lifting platform or cargo disposed thereon and within the cargo space.

The support and drive assembly may have a drive mechanism comprising an electrically operated winch mechanism for winding up or paying out the tether to raise or lower the platform assembly upwardly or downwardly through the portal, the winch mechanism having an upward bias within the drive mechanism so that when the tether is weighted by the platform assembly, the winch mechanism moves against the upward bias closing a tension detection switch and causing the winch mechanism to pay out of the tether, and wherein when the tether is not weighted by the platform assembly, the winch mechanism moves toward the upward bias thereby opening the tension detection switch and disabling the winch mechanism and stopping pay out of the tether, thereby halting movement of the platform assembly immediately when the platform assembly comes to rest on a floor surface below the portal opening, or when the platform assembly or tether becomes lodged or caught in the portal or is otherwise arrested from movement.

The present invention further contemplates a method of vertically transferring an object between locations, comprising providing a lifting and closure system, comprising a platform assembly comprising a lifting platform, a closure platform positioned below and facing the lifting platform, and a biasing mechanism attached to the closure platform for urging the closure platform toward the lifting platform and wherein the biasing mechanism is self-adjustable to enable the closure platform to be positioned a variable distance from the lifting platform, and a support and drive assembly positioned on a support structure, the support structure having an upper surface, a lower surface and a portal, the support and drive assembly positioned above the platform assembly and operatively connected to the platform assembly for raising the platform assembly into the portal, the portal having an upper entrance extending through the upper surface of the support structure, and a lower entrance extending through the lower surface of the support structure in a position below the upper entrance, and wherein the portal has a portal depth comprising a distance between the upper surface and the lower surface of the support structure, orienting the platform assembly in a loading position on a surface below the portal and disposing an object on the lifting platform of the platform assembly, and actuating the support and drive assembly to raise the platform assembly into the portal wherein the closure platform engages and is urged against the lower surface of the support structure by the biasing mechanism causing the closure platform to cover the lower entrance of the portal.

The platform assembly of the lifting and closure system of this method is preferably operatively connected to the support and drive assembly by a tether system. The lifting and closure system of the method may further comprises a portal closure door for closing the upper entrance of the portal when the platform assembly is in a lowered position. The support and drive assembly of the lifting and closure system of the method may comprise a drive mechanism for raising and lowering the platform assembly, and a support frame for supporting the drive mechanism in a position above the portal. The platform assembly of the lifting and closure system of the method may comprise a platform frame for supporting the lifting platform and closure platform, the platform frame connected to the support and drive assembly, and wherein the lifting platform is secured to the platform frame. The biasing mechanism of the platform assembly of the method may be connected to the platform frame and to the closure platform, thereby connecting the closure platform to the platform frame. The biasing mechanism of the platform assembly of the method may be connected to the lifting platform and to the closure platform, thereby connecting the closure platform to the platform. The biasing mechanism of the platform assembly of the method may comprise at least one pair of springs. The at least one pair of springs of the biasing mechanism may comprise coiled tension springs. The at least one pair of springs of the biasing mechanism may comprise constant force springs. The biasing mechanism of the platform assembly may comprise two pairs of springs. The platform frame of the platform assembly of the method may comprise two pairs of legs having lower ends, each pair of legs having an upper end, wherein the lifting platform is attached near the lower ends of the two pairs of legs. The platform assembly of the lifting and closure system of the method may be attached to the support and drive assembly via a tether system attached to the upper ends of the two pairs of legs of the platform frame. Each leg of each pair of legs of the platform frame has a lower vertical portion and an upper slanted portion wherein the upper slanted portions of each leg terminate at the upper end of the pair of legs. The tether system of the lifting and closure system of the method may be adjustably connected to the platform assembly at attachment points on the platform assembly such that the positions of attachment of the tether to the platform assembly are adjustable without affecting the length of the tether system. The lifting and closure system of the method may further comprise a tension detection switch positioned within the drive mechanism for immediately stopping the motion of the drive mechanism upon detection of a reduction in tension on at least one tether arm of the tether system. The tension detection switch of the drive mechanism of the method may have a pre-set setting for detecting the reduction in tension. The platform assembly of the lifting and closure system of the method may further comprise one or more barriers for constricting movement of a cargo item on the lifting platform. The barrier of the platform assembly may be a wall, a chain, a rope, a web, a net, a cable, a brace, a band, a bar, and combinations thereof. When a cargo item having a center of gravity is placed on the lifting platform of the platform assembly, the center of gravity of the cargo item is below the point of operative connection between the support and drive assembly and the platform assembly.

In one embodiment the invention is a kit for assembling a lifting and closure system, wherein the kit comprises platform components comprising an lifting platform, a closure platform, a biasing mechanism, and platform frame components which when assembled comprise a platform assembly having a platform frame for supporting the lifting platform, with the closure platform positioned below and facing the lifting platform, and wherein the biasing mechanism is attachable to the closure platform in a configuration for urging the closure platform toward the lifting platform, support and drive components comprising support frame components and a drive assembly comprising a motor, and a winch assembly, which when assembled comprise a support and drive assembly able to be positioned on a support structure, the support structure having an upper surface, a lower surface and a portal, and a tether for operatively connecting the platform assembly to the support and drive assembly, wherein the tether can be connected to the winch assembly such that a first tether arm and a second tether arm of the tether can extend from the winch assembly of the drive assembly to connect to the platform frame of the platform assembly, wherein in use the support and drive assembly can be positioned on the support structure above the platform assembly and when in operation is able to raise the platform assembly into the portal and lower the platform assembly through the portal, the portal having an upper entrance extending through the upper surface of the support structure, and a lower entrance extending through the lower surface of the support structure in a position below the upper entrance, and the portal having a portal depth comprising a distance between the upper surface and the lower surface of the support structure, wherein when the platform assembly is raised into the portal, the closure platform engages and is urged against the lower surface of the support structure by the biasing mechanism causing the closure platform to cover the lower entrance of the portal and fit against the lower surface of the support structure, and wherein the biasing mechanism is self-adjustable to enable the closure platform to be positioned a variable distance from the lifting platform for adjusting to differences in portal depths among different support structures.

The lifting platform of the kit is preferably attachable to the platform frame. The biasing mechanism of the kit may be connectable to the platform frame and to the closure platform. The biasing mechanism of the kit may be connectable to the lifting platform and to the closure platform. The biasing mechanism of the kit may comprise at least one pair of springs. The at least one pair of springs of the kit may comprise coiled tension springs. The at least one pair of springs of the kit may comprise constant force springs. The biasing mechanism of the kit may comprise two pairs of springs. The platform components of the kit may comprise two pairs of legs having lower ends, each pair of legs having an upper end, wherein the lifting platform is attachable near the lower ends of the two pairs of legs. The platform assembly of the kit may be attachable to the support and drive assembly via the first tether arm and the second tether arm wherein each is attachable to the upper ends of the two pairs of legs of the platform frame. Each leg of each pair of legs of the platform components may have a lower vertical portion and an upper slanted portion wherein the upper slanted portions of each leg terminate at the upper end of the pair of legs. The tether of the kit may be adjustably connectable to the platform assembly at attachment points on the platform assembly such that the points of attachment of the tether to the platform assembly are adjustable without affecting the length of the tether system. The kit may comprise a tension detection switch positioned within the drive mechanism for immediately stopping the motion of the drive mechanism upon detection of a reduction in tension on at least one tether arm of the tether system. The tension detection switch of the kit may have a pre-set setting for detecting the reduction in tension. The kit may comprise one or more barriers for attachment to the platform frame for constricting movement of a cargo item on the lifting platform. The barrier may be a wall, a chain, a rope, a web, a net, a cable, a brace, a band, a bar, and combinations thereof When a cargo item having a center of gravity is placed on the lifting platform of the assembled platform assembly, the center of gravity of the cargo item is below the point of operative connection between the support and drive assembly and the platform assembly. The kit may comprise a portal closure door for closing the upper entrance of the portal when the platform assembly is in a lowered position.

In one embodiment, the invention is a lifting system comprising a platform assembly comprising a platform frame supportingly connected to a lifting platform which is substantially horizontal, and having a first end and a second end opposite the first end, said platform frame having a first end frame connected to the first end of the lifting platform, and a second end frame opposite the first end frame and connected to the second end of the lifting platform, each first end frame and second end frame having a width at least as wide as the first end and second end, respectively, of the lifting platform, wherein the first end frame and the second end frame each extend upwardly from the lifting platform, and the first end frame and second end frame defining a cargo space therebetween, and each first end frame and second end frame having an inner side facing toward the other and each first end frame and second end frame having an outer side facing away from the other, and each first end frame and second end frame having a first side and a second side of substantially equal length and extending upwardly from the lifting platform for a lower portion of their length and converge toward each other for an upper portion of their length thereby forming a first end converging portion of the first end frame, the first side converging portion having an upper end forming a first end frame apex and a second end converging portion of the second end frame, the second side converging portion having an upper end forming a second end frame apex; and a support and drive assembly positioned on a support structure, the support structure having an upper surface, a lower surface and a portal, the support and drive assembly positioned above the platform assembly and operatively connected to the platform assembly by at least two tethers, each of which is attached to the platform frame through an outer opening in the opposite outer side of each first end frame and second end frame at a point at or below the first frame apex and second frame apex, respectively, and the at least two tethers fastened securely within the platform frame for the purpose of raising the platform assembly and any cargo placed on the lifting platform into the portal, the portal having an upper entrance extending through the upper surface of the support structure, and a lower entrance extending through the lower surface of the support structure in a position below the upper entrance, and wherein the portal has a portal depth comprising a distance between the upper surface and the lower surface of the support structure, and wherein when the platform assembly is raised to the portal, the first frame apex of the first end frame and the second frame apex of the second end frame are drawn and guided into the lower entrance of the portal by the at least two tethers which extend from the outer sides of the first end frame and second end frame of the platform frame and which thereby inhibit the first frame apex and second frame apex from impacting the lower entrance of the portal as they are drawn in by the at least two tethers, and wherein as the platform assembly advances upward into the portal, the first side converging portion and the second side converging portion of each first end frame and second end frame can engage a portion of the lower entrance of the portal to progressively urge the platform frame into a proper alignment for entering the portal as the platform frame is drawn upwardly into the portal thereby preventing contact between a portal edge and the lifting platform or cargo disposed thereon and within the cargo space.

The lifting system may further comprise a closure platform positioned below and facing the lifting platform, and a biasing mechanism attached to the closure platform for urging the closure platform toward the lifting platform wherein when the platform assembly is raised into the portal, the closure platform engages and is urged against the lower surface of the support structure by the biasing mechanism causing the closure platform to cover the lower entrance of the portal, and wherein the biasing mechanism is self-adjustable to enable the closure platform to be positioned a variable distance from the lifting platform for adjusting to differences in portal depths among different support structures.

The biasing mechanism may be connected to the platform frame and to the closure platform, thereby connecting the closure platform to the platform frame, or the biasing mechanism may be connected to the upper platform and to the closure platform, thereby connecting the closure platform to the lifting platform. The biasing mechanism may comprise at least one pair of springs, and in one embodiment comprises two pairs of springs. The at least one pair of springs may comprise coiled tension springs, or the at least one pair of springs may comprise constant force springs. The tether system is preferably adjustably connected to the platform assembly at attachment points on the platform assembly such that the positions of attachment of the tether to the platform assembly are adjustable without affecting the length of the tether system. The lifting system further comprises a tension detection switch positioned within the drive mechanism for immediately stopping the motion of the drive mechanism upon detection of a reduction in tension on at least on tether arm of the tether system. The tension detection switch may have a pre-set setting for detecting the reduction in tension. The platform assembly may further comprise one or more barriers for constricting movement of a cargo item on the lifting platform. The barrier may be a wall, a chain, a rope, a web, a webbing, a net, a cable, a brace, a band, a bar, and combinations thereof. In the lifting system described above when a cargo item having a center of gravity is placed on the lifting platform of the platform assembly, the center of gravity of the cargo item is below the point of operative connection between the support and drive assembly and the platform assembly. The lifting system may further comprise a portal closure door for closing the upper entrance of the portal when the platform assembly is in a lowered position.

The support and drive assembly may have a drive mechanism comprising an electrically operated winch mechanism for winding up or paying out the tether to raise or lower the platform assembly upwardly or downwardly through the portal, the winch mechanism having an upward bias within the drive mechanism so that when the tether is weighted by the platform, the winch mechanism moves against the upward bias closing a tension detection switch and causing the winch mechanism to pay out of the tether, and wherein when the tether is not weighted by the platform, the winch mechanism moves toward the upward bias thereby opening the tension detection switch and disabling the winch mechanism and stopping pay out of the tether, thereby halting movement of the platform assembly immediately when the platform assembly comes to rest on a floor surface below the portal opening, or when the platform assembly or tether becomes lodged or caught in the portal or is otherwise arrested from movement.

The invention also contemplates a kit for supplying the components of this system and a method utilizing this system.

In another embodiment, the invention is a lifting system comprising a platform assembly comprising a lifting platform, and a support and drive assembly positioned on a support structure, the support structure having an upper surface, a lower surface and a portal, the support and drive assembly positioned above the platform assembly and operatively connected to the platform assembly by at least one tether for raising the platform assembly into the portal, and the support and drive assembly having a drive mechanism comprising an electrically operated winch mechanism for winding up or paying out the tether to raise or lower the platform assembly upwardly or downwardly through the portal, the winch mechanism having an upward bias within the drive mechanism so that when the tether is weighted by the platform assembly, the winch mechanism moves against the upward bias thereby closing a tension detection switch and causing the winch mechanism to pay out the tether, and wherein when the tether is not weighted by the platform assembly, the winch mechanism moves toward the upward bias thereby opening the tension detection switch and disabling the winch mechanism and stopping pay out of the tether, thereby halting movement of the platform assembly immediately when the platform assembly comes to rest on a floor surface below the portal opening, or when the platform assembly or tether becomes lodged or caught in the portal or is otherwise arrested from movement.

The lifting system may further comprise a closure platform positioned below and facing the lifting platform, and a biasing mechanism attached to the closure platform for urging the lower platform toward the lifting platform. The portal has an upper entrance extending through the upper surface of the support structure, and a lower entrance extending through the lower surface of the support structure in a position below the upper entrance, and a portal depth comprising a distance between the upper surface and the lower surface of the support structure and, wherein when the platform assembly is raised into the portal, the closure platform engages and is urged against the lower surface of the support structure by the biasing mechanism causing the closure platform to cover the lower entrance of the portal, and wherein the biasing mechanism is self-adjustable to enable the closure platform to be positioned a variable distance from the lifting platform for adjusting to differences in portal depths among different support structures.

The platform assembly may comprise a platform frame supportingly connected to the lifting platform which is substantially horizontal, and having a first end and a second end opposite the first end, said platform frame having a first end frame connected to the platform first end, and a second end frame opposite the first end frame and connected to the platform second end, each first end frame and second end frame having a width at least as wide as the first end and second end, respectively, of the lifting platform, wherein the first end frame and the second end frame each extend upwardly from the lifting platform, and the first end frame and second end frame defining a cargo space therebetween, and each first and second end frame having an inner side facing toward the other and each first end frame and second end frame having an outer side facing away from the other, and each first end frame and second end frame having a first side and a second side of substantially equal length and extending upwardly from the lifting platform for a lower portion of their length and converge toward each other for an upper portion of their length thereby forming a first end converging portion of the first end frame, the first side converging portion having an upper end forming a first end frame apex and a second end converging portion of the second end frame, the second side converging portion having an upper end forming a second end frame apex. The support and drive assembly may be operatively connected to the platform assembly by at least two tethers, each of which is attached to the platform frame through an outer opening in the opposite outer side of each first end frame and second end frame at a point at or below the first frame apex and second frame apex, respectively, and the at least two tethers fastened securely within the platform frame for the purpose of raising the platform assembly and any cargo placed on the lifting platform into the portal, wherein when the platform assembly is raised to the portal, the first frame apex of the first end frame and the second frame apex of the second end frame are drawn and guided into the portal lower entrance by the at least two tethers which extend from the outer sides of the first and second end frames of the platform frame and which thereby inhibit the first and second frame apexes from impacting the lower portal entrance as they are drawn in by the at least two tethers, and wherein as the platform assembly advances upward into the portal, the first side converging portion and the second side converging portion of each first end frame and second end frame can engage a portion of the lower portal entrance to progressively urge the platform frame into a proper alignment for entering the portal as the platform frame is drawn upwardly into the portal thereby preventing contact between a portal edge and the lifting platform or cargo disposed thereon and within the cargo space.

The biasing mechanism may be connected to the platform frame and to the closure platform, thereby connecting the closure platform to the platform frame, or the biasing mechanism may be connected to the upper platform and to the closure platform, thereby connecting the closure platform to the lifting platform. The biasing mechanism may comprise at least one pair of springs, and in one embodiment comprises two pairs of springs. The at least one pair of springs may comprise coiled tension springs, or the at least one pair of springs may comprise constant force springs. The tether system is preferably adjustably connected to the platform assembly at attachment points on the platform assembly such that the positions of attachment of the tether to the platform assembly are adjustable without affecting the length of the tether system. The lifting system further comprises a tension detection switch positioned within the drive mechanism for immediately stopping the motion of the drive mechanism upon detection of a reduction in tension on at least on tether arm of the tether system. The tension detection switch may have a pre-set setting for detecting the reduction in tension. The platform assembly may further comprise one or more barriers for constricting movement of a cargo item on the lifting platform. The barrier may be a wall, a chain, a rope, a web, a webbing, a net, a cable, a brace, a band, a bar, and combinations thereof. In the lifting system described above when a cargo item having a center of gravity is placed on the lifting platform of the platform assembly, the center of gravity of the cargo item is below the point of operative connection between the support and drive assembly and the platform assembly. The lifting system may further comprise a portal closure door for closing the upper entrance of the portal when the platform assembly is in a lowered position.

The invention also contemplates a kit for supplying the components of this system and a method utilizing this system.

Although the present disclosure and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, means, kits, methods and steps described in the specification. As one of ordinary skill in the art will readily appreciate from the disclosure of the present invention, processes, machines, manufacture, means, kits, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, means, kits, methods, or steps.

What is claimed is:

1. An apparatus comprising:

a winch member;

a winch motor adapted to rotate the winch member in a first direction to wrap a portion of a cable about the winch member to raise a lifting platform assembly and to rotate the winch member in an opposing second direction to unwrap said portion of the cable from the winch member to lower the lifting platform assembly; and a tension detection switch assembly comprising a switch connected to the winch motor and a biasing member which exerts a bias force upon the winch member to nominally deflect the winch member to a first position which sets the switch to deactivate the winch motor in an absence of tension in the cable from the lifting platform assembly, wherein a presence of tension in the cable from the lifting platform assembly deflects the winch member to a second position which sets the switch to activate the winch motor, wherein the biasing member supports a selected end of the winch member relative to a winch housing, and wherein the presence of tension in the cable deflects the selected end of the winch member away from the winch housing and the absence of tension in the cable facilitates retraction of the selected end of the winch member by the biasing member toward the winch housing.

2. The apparatus of claim 1, further comprising said lifting platform assembly, wherein the tension a detection switch assembly deactivates the motor responsive to the lifting platform assembly being lowered onto and at least partially resting on an obstructing surface below the platform assembly.

3. The apparatus of claim 2, in which the obstructing surface is a floor surface.

4. The apparatus of claim 1, wherein the winch member is characterized as an elongated, substantially cylindrical member with opposing first and second ends and a central axis, wherein the motor is affixed to the first end of the winch member to rotate the winch member in said first and second directions about the central axis, and the tension detection switch assembly is mounted to the winch housing proximate the second end of the winch member.

5. The apparatus of claim 1, in which the cable comprises opposing first and second ends and a medial portion, wherein the medial portion is affixed to an interior of the winch member and the opposing first and second ends are adapted for attachment to opposing ends of the lifting platform assembly, wherein the cable concurrently wraps about opposing ends of the winch member during rotation in the first direction.

6. The apparatus of claim 1, further comprising a control circuit connected to the switch and to the winch motor, wherein the control switch selectively activates and deactivates the winch motor responsive to the switch moving between open and closed positions.

7. The apparatus of claim 1, in which the bias member comprises a spring bracket which supports a first end of the winch member.

8. The apparatus of claim 1, in which the bias member exerts the bias force in a substantially upward direction and in which the weight of the lift platform assembly pulling on the winch member overcomes the upwardly directed bias force and transitions an end of the winch member in a downward direction.

9. The apparatus of claim 1, further comprising a support structure comprising at least one support leg which supports the winch housing above a support surface having an aperture through which extends the cable, the winch member adapted to raise and lower the lifting platform assembly into and out of the aperture.

10. The apparatus of claim 1, further comprising an upper switch limiter assembly comprising a deflectable arm and a second switch connected to the winch motor, the deflectable arm moveable between a first position and a second position, the first position setting the switch to facilitate activation of the winch motor, wherein operation of the winch motor to raise the lifting platform assembly to a location adjacent the winch member induces contact between the lifting platform assembly and the deflectable arm to transition the deflectable arm to the second position which sets the switch to deactivate the winch motor.

11. The apparatus of claim 1, further comprising an upper switch limiter assembly comprising a deflectable arm and a second switch connected to the winch motor, the deflectable arm moveable between a first position and a second position, the first position setting the switch to facilitate activation of the winch motor, wherein operation of the winch motor to raise the lifting platform assembly to a location adjacent the winch member induces contact between the lifting platform assembly and the deflectable arm to transition the deflectable arm to the second position which sets the switch to deactivate the winch motor.

12. An apparatus comprising:

a lifting platform assembly adapted to be lowered onto a base surface and raised above the base surface;

a cable having opposing first and second portions along a length thereof, the first portion of the cable attached to the lifting platform assembly;

a support and drive assembly positioned on a support structure above the base surface, the support and drive assembly comprising:

a deflectable winch member to which the second portion of the cable is attached;

a winch motor adapted to raise the lifting platform assembly by rotating the winch member in a first direction to wrap the second portion of the cable about the winch member, the winch motor further adapted to lower the lifting platform assembly by rotating the winch an opposing second direction to selectively unwind the second portion of the cable from the winch member; and a tension detection switch assembly comprising a switch connected to the winch motor and a biasing member which exerts an upwardly directed bias force upon the winch member, wherein when the lifting platform assembly is in a raised position above the base surface, the weight of the lifting platform assembly is imparted to the winch member via the cable to exert a downwardly directed force greater than the upwardly directed bias force to deflect the winch member to a first position to activate the switch and energize the winch motor, and when the lifting platform assembly is in a lowered position on the base surface, the weight of the lifting platform is no longer imparted to the winch member via the cable and the upwardly directed bias force from the biasing member urges the winch member to a second position which activates the switch to deenergize the winch motor, wherein the bias member exerts the bias force in a substantially upward direction and the weight of the lift platform assembly pulling on the winch member overcomes the upwardly directed bias force and transitions an end of the winch member in a downward direction.

13. The apparatus of claim 12, in which the support and drive assembly further comprises a winch housing that supports the winch motor, the winch member and the tension detection switch assembly, wherein the winch member has an end that is deflected with respect to the winch housing between the first and second positions.

14. The apparatus of claim 12, wherein the winch member is characterized as an elongated, substantially cylindrical member with opposing first and second ends and a central axis, wherein the motor is affixed to the first end of the winch member to rotate the winch member in said first and second directions about the central axis, and the tension detection switch assembly is mounted to the winch housing proximate the second end of the winch member.

15. The apparatus of claim 12, in which the support and drive assembly further comprises a winch housing, wherein the biasing member supports a selected end of the winch member relative to the winch housing, wherein the presence of tension in the cable deflects the selected end of the winch member away from the winch housing, and the absence of tension in the cable facilitates retraction of the selected end of the winch member by the biasing member toward the winch housing.

16. The apparatus of claim 12, further comprising a control circuit connected to the switch and to the winch motor, wherein the control switch selectively activates and deactivates the winch motor responsive to the switch moving between open and closed positions.

17. The apparatus of claim 12, in which the bias member comprises a spring bracket which supports a first end of the winch member.

18. The apparatus of claim 12, further comprising said lifting platform assembly, wherein the tension detection switch assembly deactivates the motor responsive to the lifting platform assembly being lowered onto and at least partially resting on an obstructing surface below the platform assembly.

19. The apparatus of claim 12, further comprising an upper switch limiter assembly comprising a deflectable arm and a second switch connected to the winch motor, the deflectable arm moveable between a first position and a second position, the first position setting the switch to activate the winch motor, wherein operation of the winch motor to raise the lifting platform assembly to a location adjacent the winch member induces contact between the lifting platform assembly and the deflectable arm to transition the deflectable arm to the second position which sets the switch to deactivate the winch motor.

20. An apparatus comprising:

a winch member;

a winch motor adapted to rotate the winch member in a first direction to wrap a portion of a cable about the winch member to raise a lifting platform assembly and to rotate the winch member in an opposing second direction to unwrap said portion of the cable from the winch member to lower the lifting platform assembly, wherein the cable comprises opposing first and second ends and a medial portion, wherein the medial portion is affixed to an interior of the winch member and the opposing first and second ends are adapted for attachment to opposing ends of the lifting platform assembly, wherein the cable concurrently wraps about opposing ends of the winch member during rotation in the first direction; and a tension detection switch assembly comprising a switch connected to the winch motor and a biasing member which exerts a bias force upon the winch member to nominally deflect the winch member to a first position which sets the switch to deactivate the winch motor in an absence of tension in the cable from the lifting platform assembly, wherein a presence of tension in the cable from the lifting platform assembly deflects the winch member to a second position which sets the switch to facilitate activation of the winch motor; wherein the bias member exerts the bias force in a substantially upward direction and in which the weight of the lift platform assembly pulling on the winch member overcomes the upwardly directed bias force and transitions an end of the winch member in a downward direction.

21. An apparatus comprising:

a lifting platform assembly adapted to be lowered onto a base surface and raised above the base surface;

a cable having opposing first and second portions along a length thereof, the first portion of the cable attached to the lifting platform assembly;

a support and drive assembly positioned on a support structure above the base surface, the support and drive assembly comprising:

a winch housing;

a deflectable winch member to which the second portion of the cable is attached;

a winch motor adapted to raise the lifting platform assembly by rotating the winch member in a first direction to wrap the second portion of the cable about the winch member, the winch motor further adapted to lower the lifting platform assembly by rotating the winch an opposing second direction to selectively unwind the second portion of the cable from the winch member; and a tension detection switch assembly comprising a switch connected to the winch motor and a biasing member which supports a selected end of the winch member relative to the winch housing and exerts an upwardly directed bias force upon the winch member, wherein when the lifting platform assembly is in a raised position above the base surface, the weight of the lifting platform assembly is imparted to the winch member via the cable to exert a downwardly directed force greater than the upwardly directed bias force to deflect the winch member to a first position to activate the switch and energize the winch motor and when the lifting platform assembly is in a lowered position on the base surface, the weight of the lifting platform is no longer imparted to the winch member via the cable and the upwardly directed bias force from the biasing member urges the winch member to a second position which activates the switch to deenergize the winch motor, and wherein the presence of tension in the cable deflects the selected end of the winch member away from the winch housing and the absence of tension in the cable facilitates retraction of the selected end of the winch member by the biasing member toward the winch housing.

22. The apparatus of claim 21, wherein the winch member is characterized as an elongated, substantially cylindrical member with opposing first and second ends and a central axis, wherein the motor is affixed to the first end of the winch member to rotate the winch member in said first and second directions about the central axis, and the tension detection switch assembly is mounted to the winch housing proximate the second end of the winch member.

23. The apparatus of claim 21, in which the bias member comprises a spring bracket which supports a first end of the winch member.

24. The apparatus of claim 21, further comprising an upper switch limiter assembly comprising a deflectable arm and a second switch connected to the winch motor, the deflectable arm moveable between a first position and a second position, the first position setting the switch to facilitate activation of the winch motor, wherein operation of the winch motor to raise the lifting platform assembly to a location adjacent the winch member induces contact between the lifting platform assembly and the deflectable arm to transition the deflectable arm to the second position which sets the switch to deactivate the winch motor.

* * * * *